US010388290B2

(12) United States Patent
Shirahama

(10) Patent No.: US 10,388,290 B2
(45) Date of Patent: Aug. 20, 2019

(54) MULTIFUNCTIONAL AUDIO SIGNAL GENERATION APPARATUS

(71) Applicant: Yamaha Corporation, Hamamatsu-shi, Shizuoka-ken (JP)

(72) Inventor: Taro Shirahama, Hamamatsu (JP)

(73) Assignee: Yamaha Corporation, Hamamatsu Shi (JP)

( * ) Notice: Subject to any disclaimer, the term of this patent is extended or adjusted under 35 U.S.C. 154(b) by 0 days.

(21) Appl. No.: 15/698,626

(22) Filed: Sep. 7, 2017

(65) Prior Publication Data

US 2017/0372711 A1 Dec. 28, 2017

Related U.S. Application Data

(63) Continuation of application No. 14/626,784, filed on Feb. 19, 2015, now Pat. No. 9,792,916.

(30) Foreign Application Priority Data

Feb. 21, 2014 (JP) ..... 2014-031724

(51) Int. Cl.
*G10H 7/04* (2006.01)
*G10L 19/008* (2013.01)
(Continued)

(52) U.S. Cl.
CPC ..... *G10L 19/008* (2013.01); *G10H 1/08* (2013.01); *G10H 7/04* (2013.01); *G10L 13/02* (2013.01);
(Continued)

(58) Field of Classification Search
CPC ..... G10L 19/008; G10L 13/02; G10L 13/06; G10L 2013/021; G10L 19/24; G10L 21/038; G10H 1/08; G10H 7/04
(Continued)

(56) References Cited

U.S. PATENT DOCUMENTS 4,623,915 A * 11/1986 Bolger ..... H04N 5/45 348/566
2007/0027943 A1* 2/2007 Jensen ..... H03H 17/0664 708/300
(Continued)

FOREIGN PATENT DOCUMENTS

JP H-09146555 A 6/1997
JP H-09312899 A 12/1997

OTHER PUBLICATIONS

Extended European Search Report dated Oct. 5, 2017, for EP Application No. 17183288.4, six pages.
(Continued)

*Primary Examiner* — Dwayne D Bost
*Assistant Examiner* — Stephen M Brinich
(74) *Attorney, Agent, or Firm* — Morrison & Foerster LLP

(57) ABSTRACT

A sample counter in each channel performs counting operation at a given rate. Independently for each channel, the rate and an initial value for the counter are set, and start and stop of the counting operation of the counter are controlled, so that a partial portion of an original waveform corresponding to a count range from the set initial value to a count stop point is reproduced in the channel. A control section sets the initial values in individual ones of a set of channels, selected from among the channels, such that sample values at different sample positions of the original waveform are simultaneously retrieved in individual ones of the set of channels, and controls an overlap adder to add up the retrieved sample values, so that sample values of an audio waveform signal with a plurality of partial portions of the original waveform, partially overlapping each other are output.

7 Claims, 28 Drawing Sheets

(51) Int. Cl.
*G10H 1/08* (2006.01)
*G10L 13/02* (2013.01)
*G10L 13/06* (2013.01)

(52) U.S. Cl.
CPC ..... *G10L 13/06* (2013.01); *G10L 2013/021* (2013.01)

(58) Field of Classification Search
USPC ..... 704/500, 200–201, 205, 211, 220; 701/66–67, 70–71; 370/329, 480, 343, 370/503
See application file for complete search history.

(56) References Cited

U.S. PATENT DOCUMENTS

2009/0063072 A1* 3/2009 Sullivan ..... G01R 31/3177 702/70
2009/0306917 A1* 12/2009 Kanoh ..... G01R 13/0272 702/66

OTHER PUBLICATIONS

Notification of the First Office Action dated Jan. 19, 2018, for CN Application No. 201510087373.1, with English translation, eleven pages.
Ableton. (Mar. 30, 2011). "Max for Live: The Monolake Granulator," XP054975912, Retrieved from the Internet: URL:https://www.youtube.com/watch?v=9pn_b7OUO6l, retrieved on Jun. 11, 2015, one page.
Applicant-Initiated Interview Summary dated Dec. 13, 2016, for U.S. Appl. No. 14/626,784, filed Feb. 19, 2015, three pages.
Applicant-Initiated Interview Summary dated Jun. 1, 2017, for U.S. Appl. No. 14/626,784, filed Feb. 19, 2015, three pages.
European Communication dated Feb. 27, 2017, for EP Application No. 15155304.7, five pages.
European Search Report dated Jun. 22, 2015, for EP Application No. 15155304.7, nine pages.
Final Office Action dated Jan. 25, 2017, for U.S. Appl. No. 14/626,784, filed Feb. 19, 2015, six pages.
Kuehnl, E. (Dec. 30, 1992). "Granular Synthesis (1995)," XP055195521, Retrieved from the Internet: URL:https://www.erickuehnl.com/granular-synthesis, retrieved on Jun. 12, 2015, six pages.
Miller, D. (Oct. 1, 2008). "Going with the Grain—Emusician," XP055195518, Retrieved from the Internet: URL:http://www.emusician.com/gear/1332/going-with-the-grain/40219, retrieved on Jun. 12, 2015, fifteen pages.
Non-Final Office Action dated Jul. 12, 2016, for U.S. Appl. No. 14/626,784, filed Feb. 19, 2015, sixteen pages.
Notice of Allowance dated Jun. 8, 2017, for U.S. Appl. No. 14/626,784, filed Feb. 19, 2015, seven pages.
Vercoe, B. (Jan. 31, 2005). "Syncgrain Orchestra Opcodes and Operators," The Canonical Csound Reference Manual, Retrieved from the Internet: URL:http://www.csounds.com/manual_/html/syncgrain.html, retrieved on Jun. 10, 2015, three pages.
Vercoe, B. (Jan. 31, 2005). "Syncgrain Orchestra Opcodes and Operators," The Canonical Csound Reference Manual, Retrieved from the Internet: URL:http://www.csounds.com/manual_/html/syncgrain.html, Preface, two pages.

* cited by examiner

MULTIFUNCTIONAL AUDIO SIGNAL GENERATION APPARATUS

CROSS REFERENCE TO RELATED APPLICATIONS

This application is a continuation of U.S. patent application Ser. No. 14/626,784, filed Feb. 19, 2015, which claims the benefit of priority from the prior Japanese Patent Application No. 2014-031724, filed on Feb. 21, 2014, the entire contents of which are all incorporated herein by reference.

BACKGROUND

The present invention relates to audio signal generation apparatus which generate an audio waveform signal by reading out waveform data from a waveform memory having stored therein waveform data representative of waveforms of tones (voices or musical tones). More particularly, the present invention relates to an audio signal generation apparatus which is capable of multifunctionally changing any one of factors, such as a length or duration (reproduction speed (time progression speed)), pitch and formant of a tone, in accordance with a variety of characteristics of any of original tone waveforms (such as a waveform from which a particular tone pitch is extractable, a waveform which is not suitable for extraction therefrom of a particular tone pitch because a plurality of tone pitches are mixed therein, and an indefinite waveform input in realtime) supplied from a variety of tone sources, without influencing the other factors.

There have heretofore been known electronic musical instruments which read out from a waveform memory, waveform data representative of a waveform of a tone and reproduce the tone represented by the read-out waveform data, as disclosed for example in Japanese Patent Application Laid-open Publication No. HEI-9-146555. In the electronic musical instrument disclosed in the No. HEI-9-146555 publication, a plurality of tone generating channels are provided for reproducing tones, and one waveform data (i.e., one set of waveform data) is allocated per predetermined pitch range. Individual sample values constituting the waveform data are compressed and stored in successive addresses of a waveform memory in the order the sample values were sampled. Further, in this electronic musical instrument, there is employed a compression scheme where each sample value is compressed on the basis of a variation from the immediately preceding (i.e., last) sample value, and thus, it is necessary to use the last sample value in order to decode each compressed data. Therefore, in reading out the compressed data, each of the tone generating channels increments a read address one by one.

Each of the tone generating channels calculates a sample value (audio waveform signal) by reading out compressed data from a waveform memory and decoding the read-out compressed data during each sampling time period (i.e., a time period when a D/A converter converts a digital value into an analogue value). If a pitch of a tone to be reproduced (hereinafter referred to as a "reproduction tone") is identical to a pitch of a sampled tone (hereinafter referred to as an "original tone"), the tone generating channel calculates a sample value of a current sampling time period by incrementing the read address by one to read out compressed data and then adding a value of the read-out compressed data to a sample value of the last sampling time period. If the pitch of the reproduction tone is different from the pitch of the original tone, on the other hand, a readout rate of the compressed data is set in accordance with a ratio of the reproduction tone to the pitch of the original tone. Namely, the tone generating channel reads out a plurality of compressed data stored at successive addresses and decodes the plurality of compressed data read out; that is, the tone generating channel sequentially restores a plurality of sample values. Then, a sample value corresponding to the pitch of the reproduction tone is calculated through linear interpolation operations using the restored sample values.

Further, there have heretofore been known a hearing aid equipped with a function for changing (stretching or compressing) a length or duration of a partial portion of voice (a predetermined number of vowels included in a beginning portion of the voice) without changing a pitch of the partial portion of the voice, as disclosed in Japanese Patent Application Laid-open Publication No. HEI-9-312899.

In the aforementioned conventionally-known electronic musical instrument, if the reproduction tone is set at a pitch different from the pitch of the original tone, it would have a different length from the original tone. For example, if the reproduction tone is set at a pitch higher than the pitch of the original tone, the reproduction tone would have a shorter length than the original tone. If the reproduction tone is set at a pitch lower than the pitch of the original tone, on the other hand, the reproduction tone would have a longer length than the original tone. Further, in the case where the reproduction tone is set at a pitch different from the pitch of the original tone in the aforementioned conventionally-known electronic musical instrument, the reproduction tone would have a formant different from that of the original tone. For example, if the reproduction tone is set at a pitch higher than the pitch of the original tone, the reproduction tone would have a higher formant than the original tone. If the reproduction tone is set at a pitch lower than the pitch of the original tone, on the other hand, the reproduction tone would have a lower formant than the original tone. Namely, in the case where the reproduction tone is set at a pitch different from the pitch of the original tone, the reproduction tone would have a difference tone color (timbre) from the original tone.

In the hearing aid disclosed in the No. HEI-9-312899 publication, the aforementioned function is performed using a dedicated circuit (e.g., DSP). In the case where such a dedicated circuit (e.g., DSP) is used, there is a need to store individual sample values constituting waveform data representative of a waveform of a predetermined length until the waveform data is formed. Thus, a memory having a relatively great storage capacity is required. Further, there would occur a time delay from a time when a tone generation start instruction is given (i.e., from a time of voice input) to a time when the waveform data is formed. Further, if a dedicated circuit (e.g., DSP) for performing the aforementioned function is provided, in addition to the aforementioned tone generating channels, in the aforementioned electronic musical instrument, the circuit would increase in size and cost. Particularly, if the number of tones to be generated is increased, the storage capacity of the memory has to be increased, and thus, the inconvenience would become prominent Besides, because all of the functions are not always used, a considerable waste would result.

SUMMARY OF THE INVENTION

In view of the foregoing prior art problems, it is an object of the present invention to provide an improved multifunctional audio signal generation apparatus which is suited for control of duration, pitch, etc. of a tone. For example, the present invention provides an audio signal generation apparatus which can change any one of factors, such as duration, pitch and formant, of a tone without influencing the other factors, and which is yet simple in construction.

In order to accomplish the abovementioned object, the present invention provides an improved audio signal generation apparatus, which comprises: a plurality of channels each including a sample counter adapted to perform counting operation at a given rate, each of the channels being configured to generate a waveform sample value based on retrieving, from a memory, of a sample value of an original waveform based on a count value of the sample counter; a control section configured to set, independently for each of the channels, the rate and an initial value for the sample counter of the channel and control start and stop of the counting operation of the sample counter, so that a partial portion of the original waveform corresponding to a count range from the set initial value to a count stop point is reproduced in the channel; and an overlap adder controlled by the control section. Further, in the audio signal generation apparatus, the control section is configured to set the initial values in individual ones of a set of channels, selected from among the plurality of channels, such that sample values at different sample positions of the original waveform are retrieved from the memory in individual ones of the set of channels, and control the overlap adder to add up a plurality of samples generated in the set of channels, whereby sample values of an audio waveform signal with a plurality of partial portions of the original waveform, which are to be reproduced in the set of channels, partially overlapping each other are output from the overlap adder.

According to the present invention, under control of the control section, the rate and the initial value for the sample counter of each of the channels can be set, and waveform sample values generated in a plurality of desired channels can be added up by the overlap adder. Thus, the present invention can reproduce an audio waveform signal of which a reproduction time length, tone pitch, formant and/or the like has been controlled in a variety of modes. Namely, the present invention can generate an audio waveform signal with a plurality of partial portions of the original waveform, which are to be reproduced in the set of channels, partially overlapping each other, by setting, under control of the control section, the initial values such that sample values at different sample positions of the original waveform are simultaneously retrieved from the memory in the individual ones of the set of channels, and adding up the waveform sample values reproduced in the set of channels, by means of the overlap adder. By such overlapping between the plurality of partial portions of the original waveform, a reproduction time length and/or tone pitch can be readily controlled.

Preferably, the control section is configured to determine, in accordance with information for performing stretch/compression control on a reproduction time length, first and second partial portions of the original waveform that are to be reproduced in first and second channels of the one set of channels, the control section causing reproduction of the first partial portion of the original waveform to be started in the first channel and then causing reproduction of the second partial portion of the original waveform to be started in the second channel. Thus, the present invention can perform stretch/compression control on the reproduction time length by compressing or stretching temporal positions of the first and second partial portions of the original waveform while maintaining temporal chronological (i.e., front-back) relationship between the first and second partial portions.

Preferably, the control section is configured to set a reproduction start time difference between the first and second partial portions in accordance with information for controlling a reproduction pitch. By the setting of such a reproduction start time difference between the first and second partial portions, periodicity can be provided, and the reproduction pitch can be controlled. Preferably, a basic value of the reproduction start time difference is determined based on tone pitches of the first and second partial portions of the original waveform, and the reproduction start time difference between the first and second partial portions is set by the basic value being increased or decreased in accordance with the information for controlling a reproduction pitch. Such pitch control is effective in cases where the original waveform is of a single tone (single tone pitch).

Preferably, the control section is configured to set the given rate for the sample counters of the first and second channels in accordance with information for controlling a formant. Such formant control is effective in cases where the pitch control is performed with the setting of the reproduction start time difference as noted above.

Preferably, the control section is configured to set the given rate for the sample counters of the first and second channels in accordance with information for controlling a reproduction pitch. Such pitch control is effective in cases where the original waveform comprises a plurality of tones (mixture of a plurality of pitches).

Preferably, the memory is a temporary-storage type memory, and waveform data of the original waveform input in realtime is temporarily stored in the memory. By temporarily storing, as the original waveform, a waveform signal input in realtime from a microphone or the like into the memory, the present invention permits reproduction time length control and/or tone pitch control.

The present invention may be constructed and implemented not only as the apparatus invention discussed above but also as a method invention. Also, the present invention may be arranged and implemented as a software program for execution by a processor, such as a computer or DSP, as well as a non-transitory computer-readable storage medium storing such a software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will hereinafter be described in detail, by way of example only, with reference to the accompanying drawings, in which.

DETAILED DESCRIPTION

Figure 1:
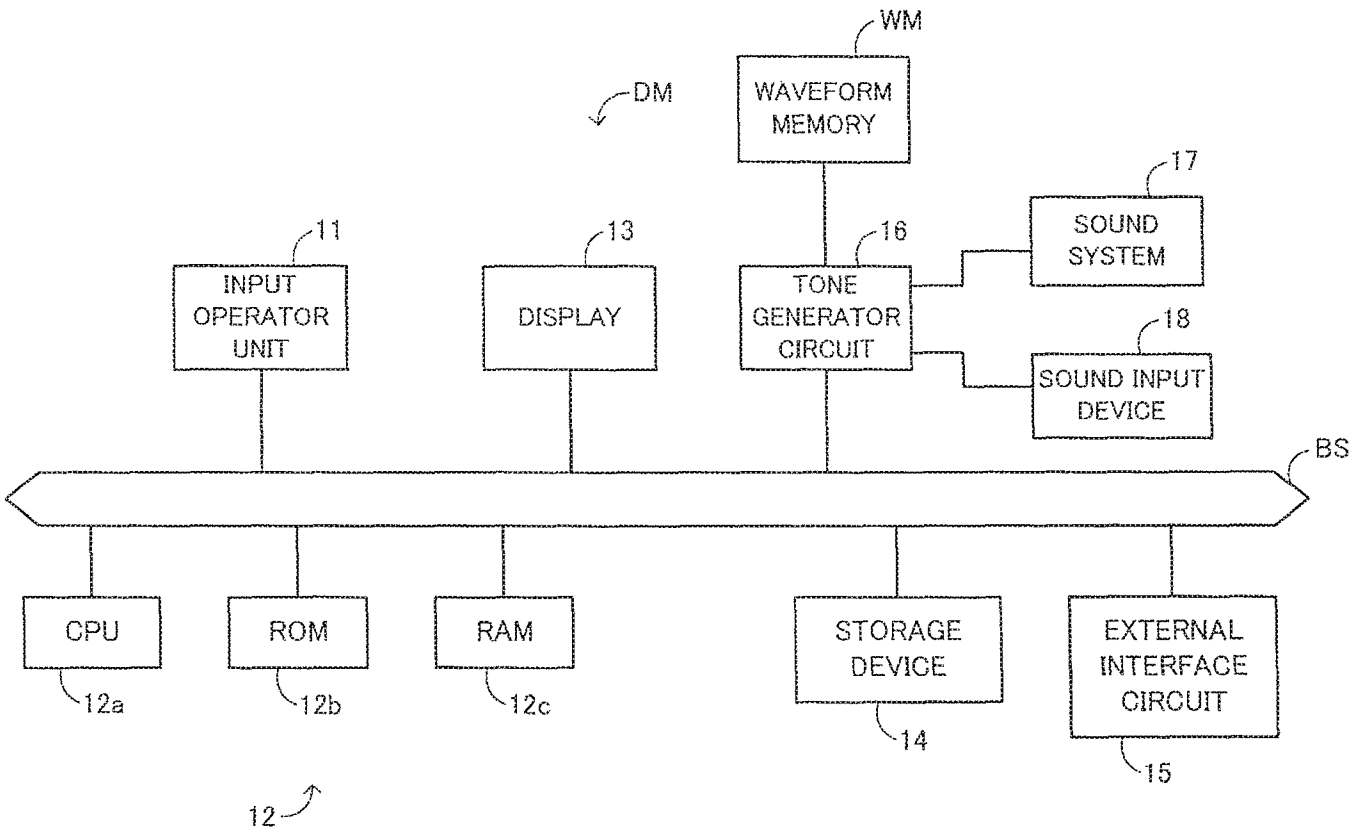
FIG. 1 is a block diagram showing an example setup of an electronic musical instrument to which is applied a tone generator circuit according to an embodiment of the present invention.

Now, a description will be given about an electronic musical instrument DM to which is applied an embodiment of an audio signal generation apparatus of the present invention. First, an outline of the electronic musical instrument DM will be described. As shown in FIG. 1, the electronic musical instrument DM includes a tone generator circuit 16 that reads out, from a waveform memory WM, waveform data representative of a waveform of a tone and then reproduces a tone represented by the read-out waveform data. The tone generator circuit 16 has a time stretch function, a pitch shift function and a formant shift function. With the time stretch function, it is possible to change duration of a tone while maintaining a pitch and formant of the tone. Namely, with the time stretch function, the tone can be stretched or compressed in a time-axial direction; in other words, only a reproduction speed (time progression speed) of the tone can be changed. Further, with the pitch shift function, it is possible to change a pitch of a tone while maintaining duration and formant of the tone. Furthermore, with the formant shift function, it is possible to change a formant of a tone while maintaining duration and pitch of the tone. Two or all of the time stretch function, pitch shift function and formant shift function can be used simultaneously. Namely, the tone generator circuit 16 can not only change only one of duration, pitch and formant of a tone but also simultaneously change two or all of duration, pitch and formant of a tone.

Further, the tone generator circuit 16 has four modes as its operation mode related to tone reproduction. In the first mode, the aforementioned time stretch function, pitch shift function and formant shift function are set invalid. Namely, if a tone is reproduced with its pitch changed from a pitch of an original tone, duration and formant of the tone too would change, as in the case of the aforementioned conventionally-known electronic musical instrument. In the second mode, the time stretch function, pitch shift function and formant shift function are set valid. Such a second mode is suited for reproduction of a performance (phrase) of a vocal solo or a single musical instrument, such as strings. Further, in the third mode, the time stretch function and the pitch shift function are set valid. The third mode is suited for reproduction of a phrase comprising a combination of performances of a vocal and a plurality of musical instruments, such as a guitar, drum and percussion. Further, in the fourth mode, the pitch shift function and the formant shift function are set valid. In the fourth mode, a harmony can be imparted to a vocal solo or a performed tone of a single musical instrument, such as strings, input in realtime. Note that a plurality of or all of the aforementioned four modes can be used simultaneously. As will be described later, the tone generator circuit 16 has 256 tone generating channels, and if there are any currently-unused tone generating channels at the time of start of reproduction, any of the operation modes may be allocated to such currently-unused tone generating channels. Note, however, that, because four tone generating channels are used for reproducing a tone in any one of the second to fourth modes, none of the second to fourth modes can be allocated to the currently-unused tone generating channels if the number of the currently-unused tone generating channels is three or less.

The following describe a detailed construction of the electronic musical instrument DM. As shown in FIG. 1, the electronic musical instrument DM includes an input operator unit 11, a computer section 12, a display 13, a storage device 14, an external interface circuit 15 and the tone generator circuit 16, which are interconnected via a bus BS. Further, a sound system 17, a sound input device 18 and the waveform memory WM are connected to the tone generator circuit 16.

The input operator unit 11 includes performance operators and setting operators. Examples of the performance operators and the setting operators include switches, such as a numerical-value inputting key pad, responsive to human operator's ON/OFF operations, a volume control or a rotary encoder responsive to a human operator's rotary operation, a volume control or a liner encoder responsive to a human operator's sliding operation, a mouse, and a touch panel. The performance operators are used to instruct start and stop of tone generation, etc. Further, the setting operators include: a tone duration setting operator to be used for changing duration (reproduction speed) of a tone; a pitch setting operator to be used for changing a pitch of a tone; and a formant setting operator to be used for changing a formant of a tone. Once the input operator unit 11 is operated by a human operator (or user), operation information indicative of content of the operation (i.e., value instructed by the operation of the operator) is supplied to the later-described computer section 12 via the bus SB.

The computer section 12 includes a CPU 12*a*, a ROM 12*b* and a RAM 12*c* connected to the bus BS. The CPU 12*a* executes a later-described tone generating program by reading out the tone generating program from the ROM 12*b* to execute the tone generating program and supplies the tone generator circuit 16 with performance operation information related to operations of the performance operators. The performance operation information includes pitch information indicative of a pitch of a reproduction tone and volume information indicative of a volume of the reproduction tone. Further, once any one of the setting operators is operated, the CPU 12*a* supplies the tone generator circuit 16 with setting information indicative of content of the operation of the setting operator. The setting information includes operation mode information indicative of an operation mode of the tone generator circuit 16, tone color information indicative of a color (timbre) of a reproduction tone (e.g., a cut-off frequency and resonance amount of a filter), etc. The setting information further includes values instructed or indicated by the tone duration setting operator, the pitch setting operator and the formant setting operator, etc.

In the ROM 12*b* are prestored, in addition to the above-mentioned tone generating program, initial setting parameters, waveform data information indicative of information related to waveform data allocated to note numbers NN of the individual performance operators, and various data, such as graphic and text data for creating display data indicative of images to be displayed on the display 13. In the RAM 12*c* are temporarily stored data necessary for execution of various programs.

The display 13 comprises a liquid crystal display (LCD). The computer section 12 creates display data indicative of content to be displayed by use of graphic data and text data and supplies the created display data to the display 13. The display 13 displays images on the basis of the display data supplied from the computer section 12.

Further, the storage device 14 comprises large-capacity, non-volatile storage media, such as an HDD, FDD, CD and DVD, and drive units corresponding to the storage media. The external interface circuit 15 includes a connecting terminal (e.g., MIDI input/output terminal) for allowing the electronic musical instrument DM to be connected to external equipment, such as another electronic music apparatus or a personal computer. The electronic musical instrument DM is connectable via the external interface circuit 15 to connection networks, such as a LAN (Local Area Network) and the Internet.

Figure 2:
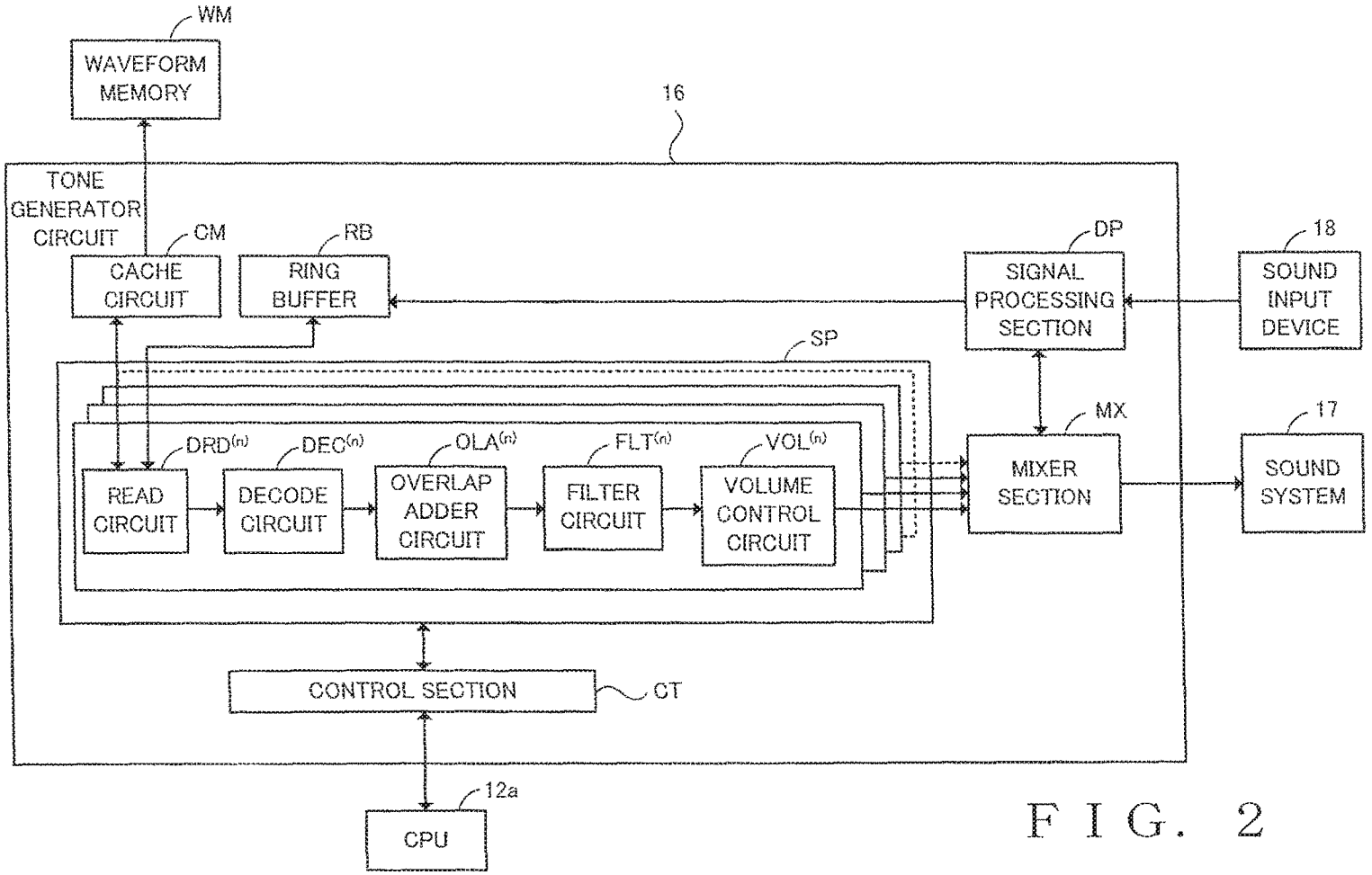
FIG. 2 is a block diagram showing a setup of the tone generator circuit of FIG. 1.

The tone generator circuit 16, as shown in FIG. 2, includes a control section CT, a tone generation section SP, a cache circuit CM, a signal processing section DP, a ring buffer RB and a mixer section MX.

The control section CT generates various parameters on the basis of performance operation information and setting operation supplied from the CPU 12*a* and supplies the thus-generated various parameters to individual tone generating channels $CH^{(n)}$ (here, n=0, 1, . . . , 255) constituting the tone generation section SP that will be described below. The control section CT includes an envelope generation circuit that generates various envelope signals, and a low-frequency oscillator that generates a low-frequency signal. The envelope signal and the low-frequency signal are used when a pitch, color and volume of a tone are to be changed in accordance with an elapsed time from a start time of tone generation. Examples of the above-mentioned various parameters include a pitch magnification β indicative of a ratio of a pitch of a reproduction tone to a pitch of an original tone, a filter parameter for setting a characteristic of a filter, a tone volume parameter for setting a tone volume. Further, the control section CT includes state flags $SF_n^{(CT)}$ indicative of respective operating states of the tone generating channels $CH^{(n)}$. The control section CT also includes a sample counter $C_s^{(CT)}$ (not shown) that counts the number of samples from the beginning or head of waveform data of an original tone. Further, the control section CT includes a reproduction time counter $C_{RT}^{(CT)}$ (not shown) that counts time until the tone generating channel $CH^{(n)}$ starts reproduction. Furthermore, the control section CT includes a sample buffer $SB^{(CT)}$ (not shown) that, per sampling time period, temporarily stores a sample value reproduced by a later-described decode circuit $DEC^{(n)}$. The control section CT includes a target value register $TR^{(CT)}$ (not shown) that temporarily stores a later-described target value $t_v$.

The tone generation section SP includes a plurality of (e.g., 256) tone generating channels $CH^{(n)}$. The tone generating channels $CH^{(n)}$ are identical to one another in construction. Each of the tone generating channels $CH^{(n)}$ includes a read circuit $DRD^{(n)}$, an overlap-add circuit (overlap adder) $OLA^{(n)}$, a filter circuit $FLT^{(n)}$ and a volume control circuit $VOL^{(n)}$.

The read circuit $DRD^{(n)}$ is connected to the waveform memory WM via the cache circuit CM. Sample values obtained by sampling original tones (including a single tone of a single musical instrument, a phrase comprising performed tones of a single musical instrument, a phrase including performed tones of a plurality of musical instruments, etc.) with a predetermined sampling period (e.g., 1/44100 sec) are prestored as compressed data in the waveform memory WM. Each compressed data indicates a difference between a sample value in the current sampling time period and a sample value in a sampling time period immediately preceding the current sampling time period (i.e., the last sampling time period). Thus, each set of waveform data comprises a top or head sample value and a plurality of compressed data. One compressed data is associated with one address. Thus, a difference between a read address for reading out compressed data and the head address corresponds to a time at which a sample value to be restored using the compressed data was sampled (i.e., elapsed time from the start of the sampling). Further, in the instant embodiment, the compressed data, not the sample values themselves, are prestored in the waveform memory, as noted above. However, because each compressed data corresponds to one sample value of the original tone, the read address of each compressed data matches the read address of a sample value in a case where sample values are prestored in a non-compressed form in association with individual addresses. Thus, in the following description, each address for reading out compressed data from the waveform memory WM will be referred to as a "read address of a sample value".

A head address in the waveform memory WM, at which a head sample value of an original tone is prestored, is supplied from the control section CT to the read circuit $DRD^{(n)}$. The read circuit DRD has a sample counter $C_s^{(n)}$ (not shown) that increments per sampling time period similarly to the sample counter $C_s^{(CT)}$ (not shown) of the control section CT. Each count value $t_s^{(n)}$ of the sample counter $C_s^{(n)}$ is indicative of an offset address from the head address (i.e., the number of addresses from the head address to the current sampling time period). The read circuit $DRD^{(n)}$ supplies the cache circuit CD with a read address obtained by adding the count value $t_s^{(n)}$ to the head address. Note, however, that the read address generally includes a fractional portion. As noted later, a sample value corresponding to the read address is calculated by the decode circuit $DEC^{(n)}$. The cache circuit CM reads out, from the waveform memory WM, compressed data necessary for the decode circuit $DEC^{(n)}$ to calculate a sample value corresponding to the read address and supplies the read-out compressed data to the read circuit $DRD^{(n)}$. The cache circuit CM includes a cache memory that temporarily stores compressed data. In a case where compressed data to be supplied to the read circuit $DRD^{(n)}$ is stored in the cache memory, the cache circuit CM reads out the compressed data from the cache memory and supplies the read-out compressed data to the read circuit $DRD^{(n)}$.

The decode circuit $DEC^{(n)}$ calculates a sample value of the current sampling time period by use of the supplied compressed data. The decode circuit $DEC^{(n)}$ supplies the thus-calculated sample value of the current sampling time period to the overlap-add circuit (overlap adder) $OLA^{(n)}$.

Figure 3:
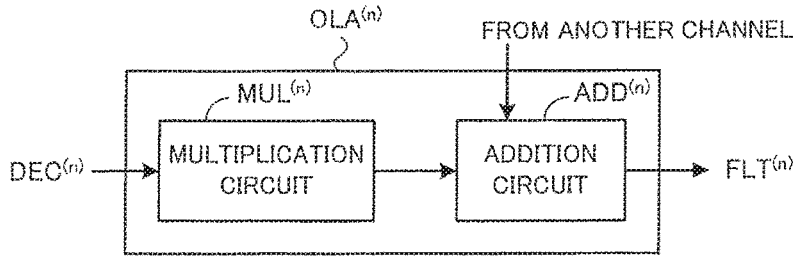
FIG. 3 is a block diagram showing an overlap-add circuit (or overlap adder) of FIG. 2.
Figure 4A:
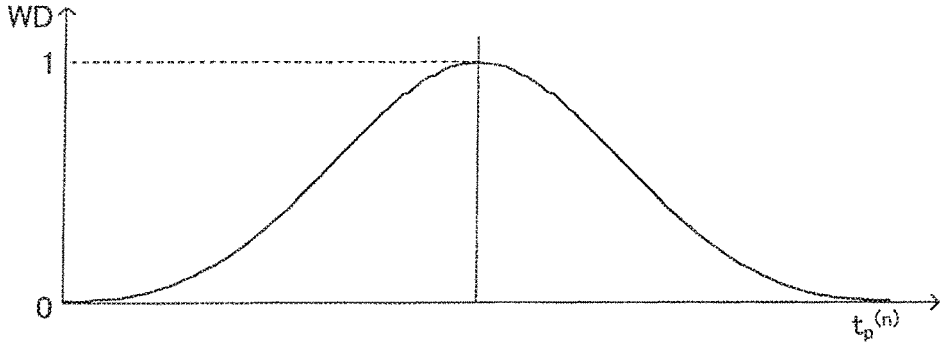
FIG. 4A is a graph showing an example window function for application to segments.
Figure 4B:
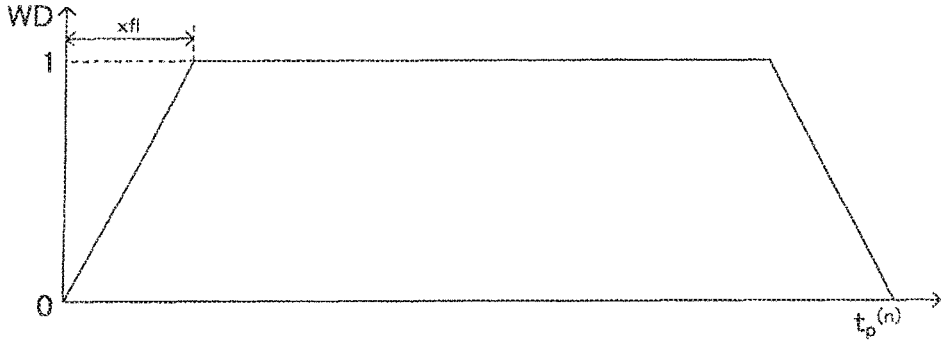
FIG. 4B is a graph showing another example window function for application to segments.

The overlap-add circuit (overlap adder) $OLA^{(n)}$, as shown in FIG. 3, includes a multiplication circuit $MUL^{(n)}$ and an addition circuit $ADD^{(n)}$. The multiplication circuit $MUL^{(n)}$ is a circuit for applying a window function to an input signal. The multiplication circuit $MUL^{(n)}$ also includes a phase counter $C_P^{(n)}$ (not shown) that is used to calculate a phase of the input signal. The multiplication circuit $MUL^{(n)}$ calculates a coefficient $WD^{(n)}$ by use of a count value $t_P^{(n)}$ of the phase counter $C_P^{(n)}$. The coefficient $WD^{(n)}$ is a function of the count value $t_P^{(n)}$, as shown in FIG. 4A or 4B. By such a window function being applied to the input signal, an output signal is caused to fade out after fading in.

Figure 6:
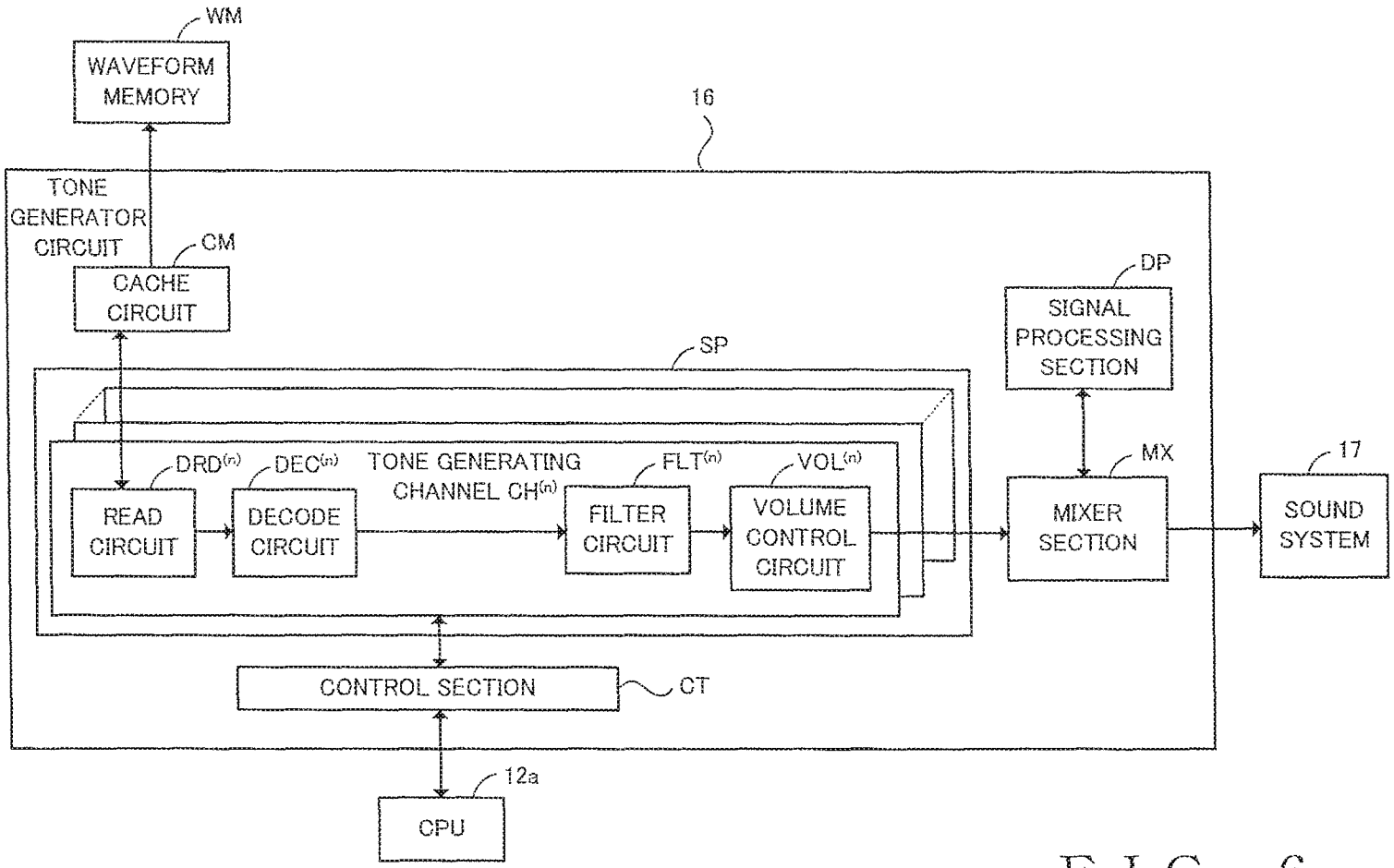
FIG. 6 is a block diagram showing a construction of the tone generator circuit in a first mode.

The addition circuits $ADD^{(0)}, ADD^{(1)}, \ldots, ADD^{(255)}$ are interconnected to permit overlap addition among the channels. Namely, the nth (e.g., n=a) addition circuit $ADD^{(n)}$ can add a sample value supplied from the same nth (e.g., n=a) multiplication circuit $MUL^{(n)}$ and a sample value supplied from another addition circuit $ADD^{(n)}$ (e.g., n=b) and supply the result of the addition (i.e., sum) not only to still another addition circuit $ADD^{(n)}$ (e.g., n=c) but also to the filter circuit $FLT^{(n=a)}$. However, in the first mode, the multiplication circuit $MUL^{(n)}$ and the addition circuit $ADD^{(n)}$ are not used, so that the supplied sample value is supplied directly to the filter circuit $FLT^{(n)}$ (see FIG. 6).

The filter circuit $FLT^{(n)}$ performs filter processing, corresponding to a filter parameter, on a series of sample values supplied from the overlap-add circuit $OLA^{(n)}$ to thereby change a frequency characteristic (amplitude characteristic) of a tone represented by the series of sample values and then supplies the characteristic-changed result to the volume control circuit $VOL^{(n)}$.

The volume control circuit $VOL^{(n)}$ amplifies each sample value, supplied from the filter circuit $FLT^{(n)}$ in accordance with a volume parameter and outputs the amplified result to the mixer section MX.

The signal processing section DP imparts an effect, such as a reverberation or delay effect, to a tone represented by input waveform data and outputs the effect-imparted result. Also, the signal processing section DP detects in realtime a pitch of the input signal.

The ring buffer RB is a memory that temporarily stores waveform data that is input from the later-described sound input device 18 to the signal processing section DP and that is representative of effect-imparted sound.

Per sampling time period, the mixer section MX accumulates sample values input from the individual tone generating channels $CH^{(0)}, CH^{(1)}, \ldots, CH^{(255)}$ and the signal processing section DP, and then it supplies the accumulated result to the sound system 17.

The sound system 17 includes a D/A converter that converts a digital tone signal, supplied from the mixer section MX, into an analog tone signal, an amplifier that amplifies the converted analog tone signal, and a pair of left and right speakers that convert the amplified analog audio waveform signal and audibly outputs the converted audio waveform signal.

The sound input device 18 includes a microphone as a sound pickup device, and an A/D converter that converts an analog sound signal into a digital sound signal.

Figure 5:
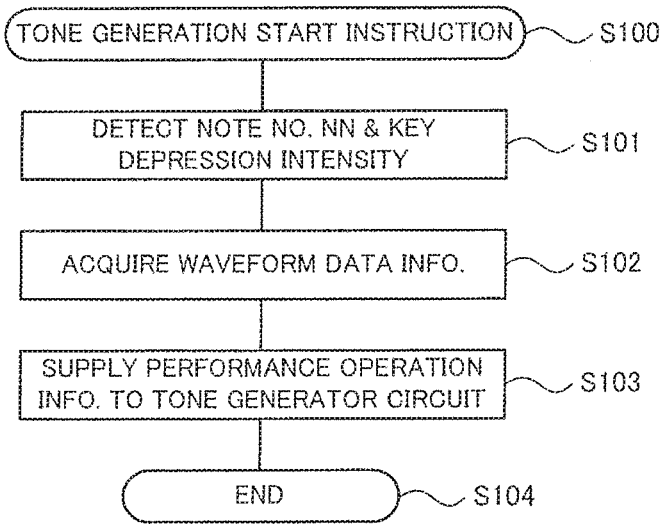
FIG. 5 is a flow chart of a tone generation start instruction program.

Next, a description will be given about operation of the electronic musical instrument DM constructed in the aforementioned manner. First, operation of the CPU 12*a* will be described. Once a note-on event is generated by the human player operating any one of the performance operators (e.g., depressing any one of keys of a keyboard apparatus), the CPU 12*a* of the computer section 12 starts tone generation processing by executing the tone generating program at step S100 as shown in FIG. 5. Then, the CPU 12*a* detects, at step S101, a note number (note No.) NN indicative of the depressed key and a key depression intensity VL of the depressed key.

Then, at step S102, the CPU 12*a* identifies waveform data allocated to the note No. NN and the key depression intensity VL and reads out, from the ROM 12*b*, the head and end addresses of the waveform data and waveform data information including a pitch OP and operation mode of the original tone. Then, at step S103, the CPU 12*a* supplies, as performance operation information, the acquired note No. NN, pitch OP of the original tone, key depression intensity VL, parameters defiling various envelope signals and parameters defining various low-frequency signals, operation mode information indicative of the operation mode, etc. to the tone generator circuit 16. Then, at step S104, the CPU 12*a* terminates the tone generation processing.

The following describe the tone generation processing performed by the tone generator circuit 16 when the operation mode is the first mode. In the first mode, the sound input device 18 and the ring buffer RB are not used as seen from FIG. 6. The tone generating channels $CH^{(0)}, CH^{(1)}, \ldots, CH^{(255)}$ operate independently of one another so that each of the tone generating channels $CH^{(0)}, CH^{(1)}, \ldots, CH^{(255)}$ reproduces a tone independently of the other tone generating channels Namely, in the first mode, the tone generating channels $CH^{(0)}, CH^{(1)}, \ldots, CH^{(255)}$ are capable of simultaneously reproducing 256 tones in total.

Figure 7:
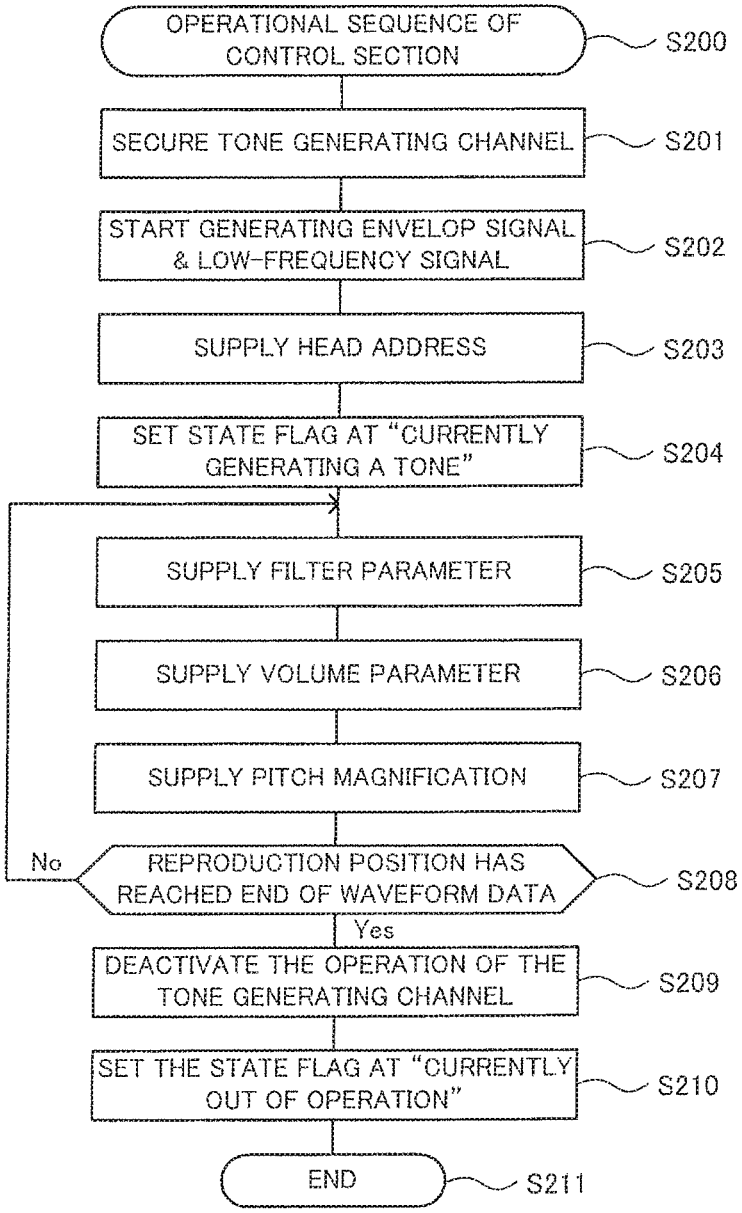
FIG. 7 is a diagram showing a control operational sequence of a control section in the first mode.

In response to input of the performance operation information from the CPU 12*a* of the computer section 12, the control section CT starts operating in accordance with a control operational sequence shown in FIG. 7. The control section CT starts its operation at step S200 and secures one tone generating channel at step S201. In an alternative, however, the CPU 12*a* may secure one tone generating channel and supply an index n of the secured tone generating channel to the tone generator circuit 16. In the following description, the secured tone generating channel will be referred to as a "tone generating channel $CH^{(n)}$". Then, at step S202, the control section CT activates the operation of the envelope generation circuit and the low-frequency oscillator, so that the envelope generation circuit and the low-frequency oscillator start generating an envelop signal and a low-frequency signal in accordance with parameters, defiling various envelope signals and various low-frequency signals, included in the input performance operation information and setting information input before the performance operation information (hereinafter referred to simply as "performance operation information" and "setting information").

Then, at step S203, the control section CT supplies a head address to the read circuit $DRD^{(n)}$. At next step S204, the control section CT sets the state flag $SF_n^{(CT)}$ corresponding to the tone generating channel $CH^{(n)}$ at "currently generating a tone".

Then, at step S205, the control section CT generates a filter parameter, indicative of a setting of the filter circuit $FLT^{(n)}$, on the basis of tone-color-related parameters included in the performance operation information and setting information and the envelope signal and low-frequency signal for changing the tone color during generation of a tone, and the control section CT supplies the thus-generated filter parameter to the filter circuit $FLT^{(n)}$. Then, at step S206, the control section CT generates a volume parameter, indicative of a setting of the volume control circuit $VOL^{(n)}$, on the basis of volume-related parameters included in the performance operation information and setting information and an envelope signal and low-frequency signal for changing a volume, and the control section CT supplies the thus-generated volume parameter to the volume control circuit $VOL^{(n)}$. Note that the setting information is changeable even during tone generation.

Then, at step S207, the control section CT determines a pitch of the reproduction tone on the basis of pitch-related parameters (e.g., the note No. NN and pitch information obtained by synthesizing an envelope signal and low-frequency signal for changing a pitch) included in the performance operation information and setting information. Then, the control section CT calculates a pitch magnification β indicative of a ratio of the determined pitch of the reproduction tone to the pitch OP of the original tone, and then the control section CT supplies the thus-calculated pitch magnification β to the read circuit $DRD^{(n)}$ of the tone generating channel $CH^{(n)}$. Note, however, that the pitch magnification β is set at "0" in the first sampling time period.

At next step S208, the control section CT determines whether a reproduction position of the tone generating channel $CH^{(n)}$ has reached the end of the waveform data in question. More specifically, the control section CT determines whether a value calculated by adding the head address to the count value $t_s^{(n)}$ of the sample counter $C_s^{(n)}$ of the read circuit $DRD^{(n)}$ has reached the end address of the waveform data. If the reproduction position of the tone generating channel $CH^{(n)}$ has reached the end of the waveform data as determined at step S208, then the control section CT makes a "YES" determination, so that the control section CT deactivates the operation of the tone generating channel $CH^{(n)}$ at step S209 and sets the state flag $SF_n^{(CT)}$ corresponding to the tone generating channel $CH^{(n)}$ at "currently out of operation". After that, the control section CT terminates the control on the tone generating channel $CH^{(n)}$ at step S211. If the reproduction position of the tone generating channel $CH^{(n)}$ has not yet reached the end of the waveform data, on the other hand, the control section CT determines makes a "NO" determination, so that it performs the aforementioned operations of steps S205 to S208 in the next sampling time period.

Figure 8:
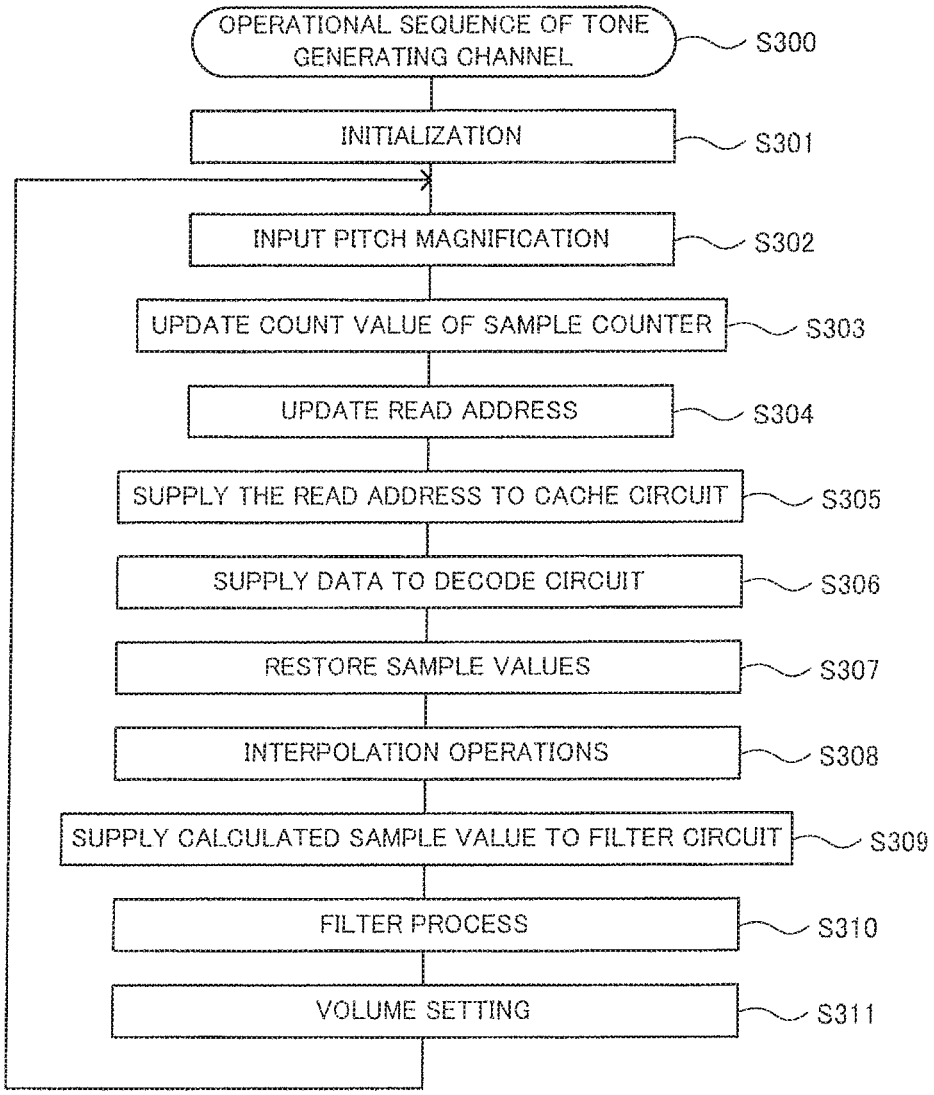
FIG. 8 is a diagram showing an operational sequence of a tone generating channel in the first mode.

The following describe a control sequence of the tone generating channel $CH^{(n)}$. The tone generating channel $CH^{(n)}$ calculates a sample value per sampling time period in accordance with a control sequence shown in FIG. 8 and then supplies the calculated sample value to the mixer section MX. The tone generating channel $CH^{(n)}$ starts its operation at step S300. The tone generating channel $CH^{(n)}$ performs an initialization process at step S301. More specifically, in the initialization process, the tone generating channel $CH^{(n)}$ sets the count value $t_s^{(n)}$ of the sample counter $C_s^{(n)}$ of the read circuit $DRD^{(n)}$ at "0". Further, the read circuit $DRD^{(n)}$ reads out, from the waveform memory WM via the cache circuit CM, the head sample value and compressed data of an address (second address) calculated by adding a value "1" to the head address and then supplies the read-out head sample value and compressed data to the decode circuit $DEC^{(n)}$. Then, the decode circuit $DEC^{(n)}$ restores a sample value corresponding to the second address by adding a value of the supplied compressed data to the head sample value. Then, the decode circuit $DEC^{(n)}$ stores the head sample value and the restored sample value.

Then, at step S302, the read circuit $DRD^{(n)}$ receives or inputs the pitch magnification β from the control section CT. At next step S303, the read circuit $DRD^{(n)}$ updates the count value $t_s^{(n)}$ of the sample counter $C_s^{(n)}$; that is, the read circuit $DRD^{(n)}$ adds a value of the pitch magnification β to the count value $t_s^{(n)}$. In the first sampling time period, the pitch magnification β is "0" as noted above, and thus, the count value $t_s^{(n)}$ is "0". Then, at step S304, the read circuit $DRD^{(n)}$ adds the count value $t_s^{(n)}$ to the head address. In this way, the read address is updated. In the first sampling time period, the count value $t_s^{(n)}$ is "0", and thus, the read address is set at the head address. Then, at step S305, the read circuit $DRD^{(n)}$ supplies the read address to the cache circuit CM. The cache circuit CM reads out, from the waveform memory WM, compressed data necessary for reproducing a sample value corresponding to the read address and supplies the read-out compressed data to the read circuit $DRD^{(n)}$.

Using, as a "readout start address", an address calculated by adding "2" to a value of an integer portion of a read address in the immediately preceding or last sampling time period and using, as a "readout end address", an address calculated by adding "1" to an integer portion of a read address in the current sampling time period, the cache circuit CM sequentially reads out the compressed data while incrementing the address one by one from the "readout start address" to the "readout end address" and then supplies the read-out compressed data to the read circuit $DRD^{(n)}$. However, if the "readout start address" is greater in value than the "readout end address", the cache circuit CM does not read out any data. In the first sampling time period, the integer portion of the read address is "0", and thus, the readout start address is greater in value than the readout end address. Therefore, in the first sampling time period, the cache circuit CM does not read out any data.

Figure 9A:
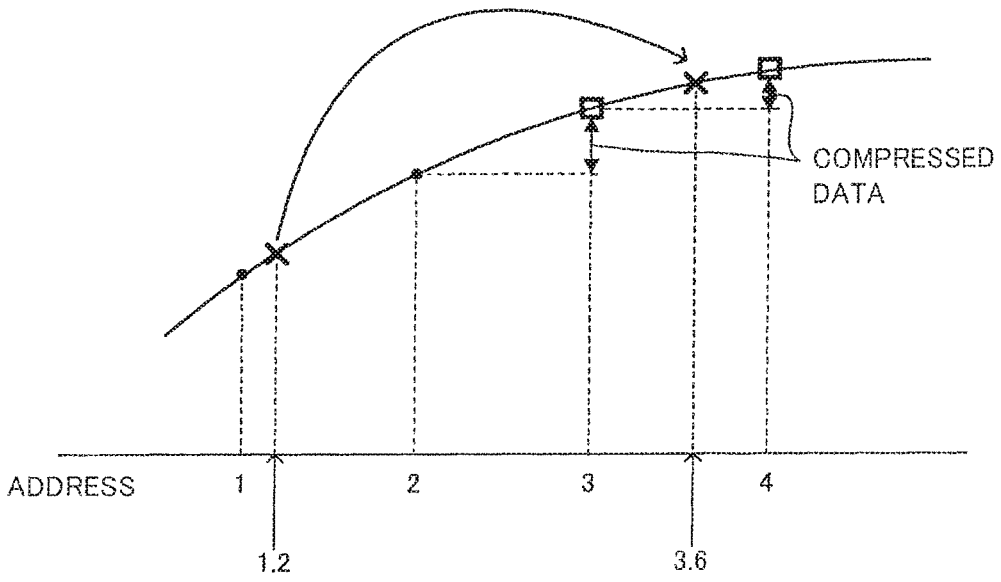
FIG. 9A is a conceptual diagram showing an operational sequence for restoring a sample value when a pitch magnification is "2.5"
Figure 9B:
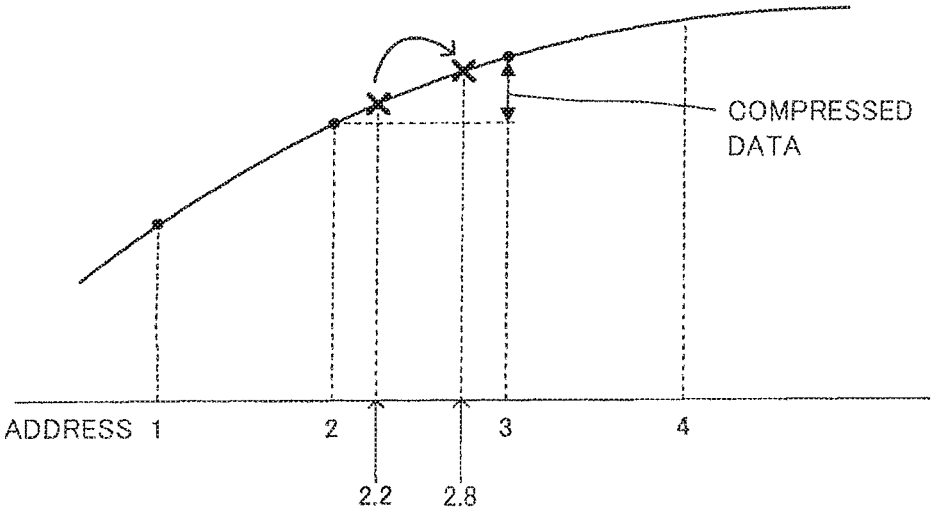
FIG. 9B is a conceptual diagram showing an operational sequence for restoring a sample value when a pitch magnification is "0.5"

As a consequence, compressed data corresponding in number to an increment in the value of the integer portion of the read address are read out. For example, if the read address has changed from "1.2" to "3.6" as shown in FIG. 9A, two compressed data from address "3" to address "4" are read out. If the read address has changed from "2.2" to "2.8" as shown in FIG. 9B, no compressed data is read out because the readout start address "4" is greater than the readout end address "3".

Then, at step S306, the read circuit $DRD^{(n)}$ supplies a value of a fractional portion of the read address and the compressed data, supplied from the cache circuit CM, to the decode circuit $DEC^{(n)}$. The decode circuit $DEC^{(n)}$ has stored therein a sample value restored in the last sampling time period. At step S307, the decode circuit $DEC^{(n)}$ restores one or more sample values, necessary for calculating a sample value corresponding to the read address, by use of the stored sample value and the compressed data supplied from the decode circuit $DEC^{(n)}$. Note, however, that, if a value of the pitch magnification β is smaller than "1" and if a value of the integer portion of the read address in the last sampling time period and a value of the integer portion of the read address in the current sampling time period are identical to each other, the decode circuit $DEC^{(n)}$ does not restore any sample value. Then, at step S308, the decode circuit $DEC^{(n)}$ calculates a sample value corresponding to the read address in the current sampling time period through linear interpolation operations using 1) a pair of sample values chosen from among the restored sample values and corresponding to an address corresponding to a value of the integer portion of the read address in the current sampling time period and an address calculated by adding "1" to the value of the integer portion and 2) a value of the fractional portion of the read address in the current sampling time period. At next step S309, the decode circuit $DEC^{(n)}$ supplies the calculated sample value, corresponding to the read address in the current sampling time period, to the filter circuit $FLT^{(n)}$.

Then, at step S310, the filter circuit $FLT^{(n)}$ applies, to the supplied sample value, filtering corresponding to the filter parameter supplied from the control section CT, and it supplies the thus-filtered sample value to the volume control circuit $VOL^{(n)}$. Also, at step S311, the volume control circuit $VOL^{(n)}$ multiplies the supplied filtered sample value by a coefficient corresponding to the volume parameter supplied from the control section CT, and the volume control circuit $VOL^{(n)}$ supplies the result of the multiplication to the mixer section MX.

In each of the second and subsequent sampling time periods, the tone generating channel $CH^{(n)}$ performs the aforementioned operations of steps S302 to S311.

Second Mode

Figure 10:
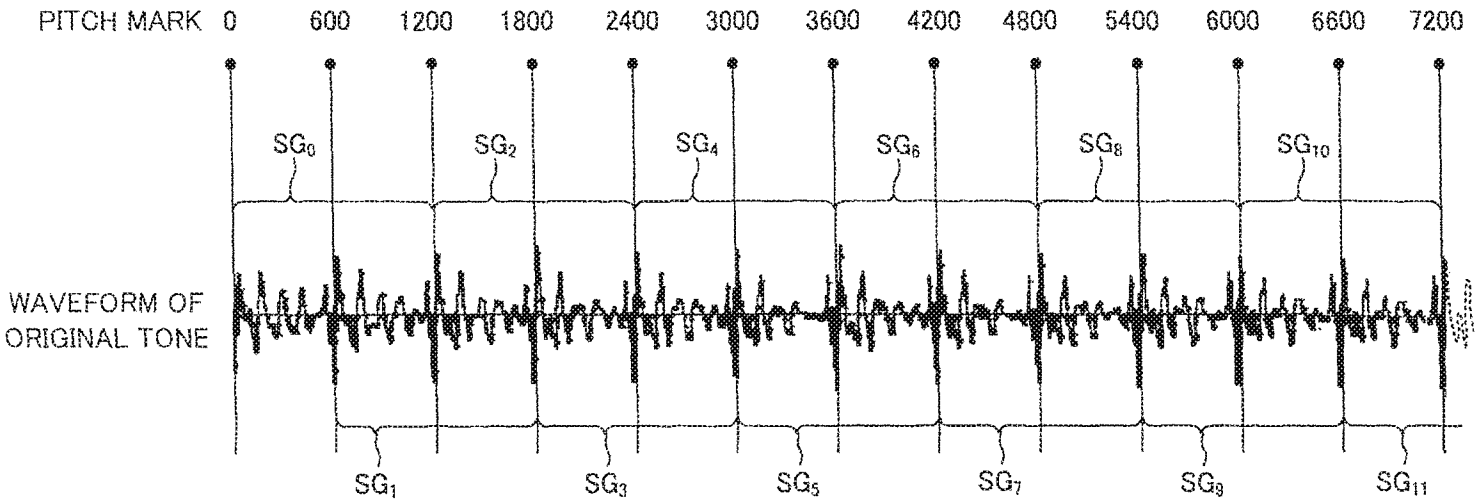
FIG. 10 is a conceptual diagram of pitch marks and segments.

Next, a description will be given about operation of the electronic musical instrument DM when the operation mode is the second mode. In the second mode, original tone waveform sections presenting periodicity corresponding to a tone pitch (hereinafter referred to as "fundamental pitch portions") are analyzed in advance, by an analyzation device separate from the electronic musical instrument DM, along the time axis of the original tone waveform, and waveform data where the number of samples contained in each of the analyzed fundamental pitch portions has been calculated in advance is used. Numbers calculated by accumulating, from the head of the waveform, the numbers of samples contained in the individual fundamental pitch portions are referred to as "pitch mark values". Namely, the pitch mark values are addresses associated with a storage region in which are stored individual sample values constituting the waveform data of the original tone, and the pitch mark values represent addresses corresponding to joints of the individual fundamental pitch portions in the original tone waveform. Because each compressed data corresponds to one sample value as noted above, each of the pitch mark values corresponds to an offset address from the head address in the original tone waveform data (i.e., the number of addresses from the head address to the pitch mark position). For example, if a pitch of the original tone is constant from the head address to the end address in the original tone waveform data and the number of samples corresponding to the pitch is 600 (i.e., a fundamental frequency is 73.5 Hz), then the individual pitch mark values are "0", "600", "1200", . . . , as shown in FIG. 10. These pitch mark values are stored in the waveform memory WM. Whereas each of the pitch mark values is shown as an integer in the illustrated example of FIG. 10, it may include a fractional portion. Further, the pitch may vary in an intermediate portion of the original tone waveform. As apparent from the foregoing, the pitch mark is a mark separating between cycle-by-cycle waveform portions of the tone pitch in the original tone waveform.

Figure 11:
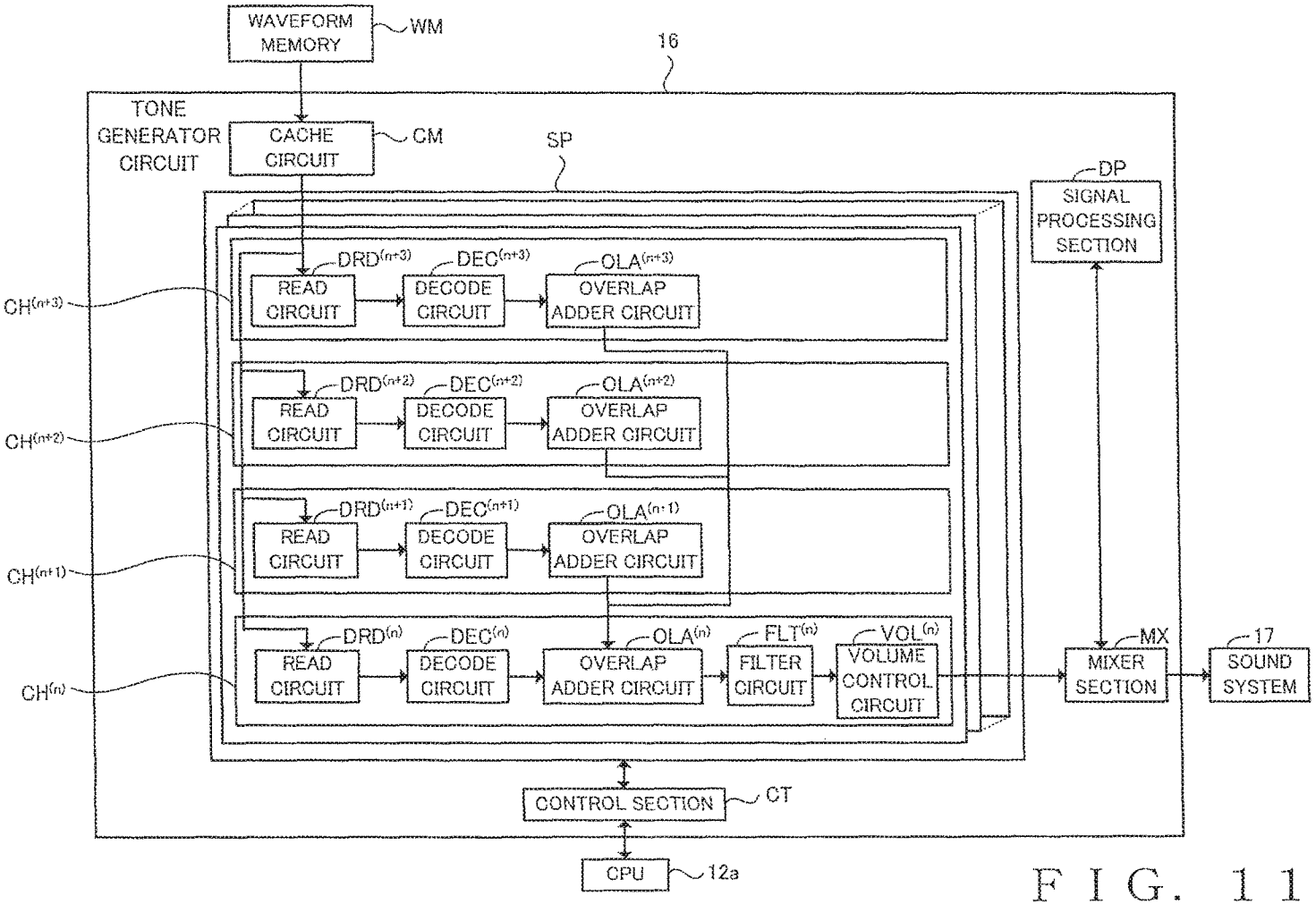
FIG. 11 is a block diagram showing a construction of the tone generator circuit in a second mode.

Because operation of the CPU 12*a* in the second mode is the same as the operation of the CPU 12*a* in the first mode, it will not be described here to avoid unnecessary duplication. The following describe tone generation processing of the tone generator circuit 16 in the second mode. In the second mode, the sound input device 18 and the ring buffer RB are not used as seen from FIG. 11. Further, in the second mode, one reproduction tone is generated using a set of tone generating channels $CH^{(n)}$, $CH^{(n+1)}$, $CH^{(n+2)}$ and $CH^{(n+3)}$. More specifically, of the set of tone generating channels $CH^{(n)}$, $CH^{(n+1)}$, $CH^{(n+2)}$ and $CH^{(n+3)}$ the tone generating channels $CH^{(n+1)}$, $CH^{(n+2)}$ and $CH^{(n+3)}$ respectively generate partial waveforms (hereinafter referred to as "grains $GR_i$") of the reproduction tone, and the remaining tone generating channel $CH^{(n)}$ adds up the grains, generated by the tone generating channels $CH^{(n+1)}$, $CH^{(n+2)}$ and $CH^{(n+3)}$ to generate one reproduction tone, and the tone generating channel $CH^{(n)}$ supplies the generated one reproduction tone to the mixer section MX via the filter circuit $FLT^{(n)}$ and the volume control circuit $VOL^{(n)}$. Thus, in the second mode, the filter circuits $FLT^{(n+1)}$, $FLT^{(n+2)}$ and $FLT^{(n+3)}$ and the volume control circuits $VO^{(n+1)}$, $VOL^{(n+2)}$ and $VOL^{(n+3)}$ of the tone generating channels $CH^{(n+1)}$, $CH^{(n+2)}$ and $CH^{(n+3)}$ are not used. If all of the tone generating channels are caused to operate in the second mode, 64 tones can be reproduced simultaneously. In the following description, the aforementioned set of tone generating channels $CH^{(n)}$, $CH^{(n+1)}$, $CH^{(n+2)}$ and $CH^{(n+3)}$ will be referred to as a "track TK".

The following describe an outline of operation of the tone generator circuit 16 in the second mode. Each of the grains $GR_i$ (here, i=0, 1, 2, . . . ) is waveform data formed by applying a window function as shown in FIG. 4A to a waveform portion or above-mentioned segment (hereinafter referred to as a "segment $SG_i$") corresponding to two cycles of the fundamental pitch portion of the original tone waveform. As shown in FIG. 10, the head and end addresses of each of the segments $SG_i$ (here, i=0, 1, 2, . . . ) match any two of the pitch mark values. Thus, a middle address of a segment $SG_i$ too matches any one of the pitch mark values. In the following description, a pitch mark located in the middle of a segment $SG_i$ will be referred to as a "middle pitch mark". Further, individual segments $SG_i$ are sequentially cut out from the waveform data of the original tone in such a manner that a former half portion of one segment $SG_i$ matches a rear half portion of another segment $SG_{i-1}$.

Figure 12:
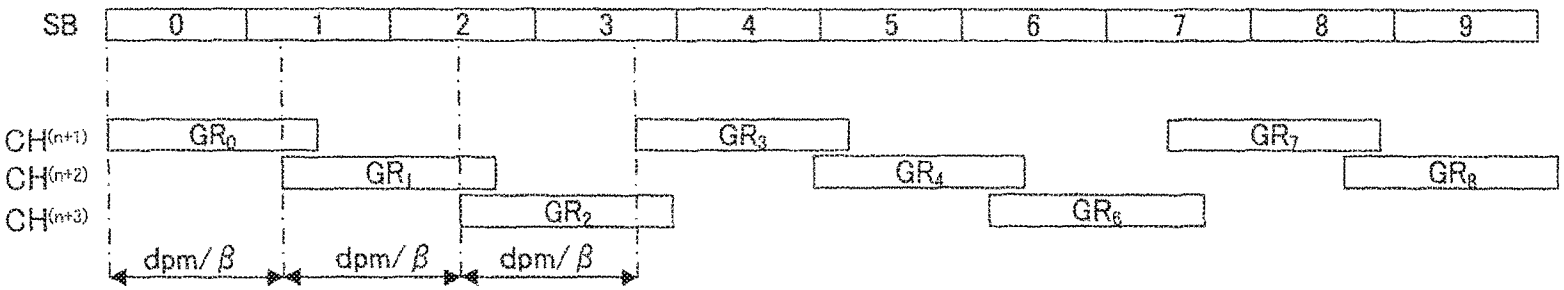
FIG. 12 is a conceptual diagram showing an outline of operation of the tone generator circuit in the second mode.

Further, as shown in FIG. 12, the tone generating channels $CH^{(n+1)}$, $CH^{(n+2)}$ and $CH^{(n+3)}$ operate cyclically to generate the individual grains $GR_i$. The head of each of the grains $GR_i$ except for the grain $GR_0$ corresponds to an intermediate portion (i.e., portion other than the head) of the original tone waveform, as noted above. Because all sample values other than the head sample value are in compressed form in the instant embodiment, it is necessary to calculate the head sample value of the grain when the tone generating channels $CH^{(n+1)}$, $CH^{(n+2)}$ and $CH^{(n+3)}$ are about to reproduce respective grains. Thus, the tone generating channel $CH^{(n)}$ advances the read address per sampling time period in accordance with a stretch ratio $\alpha$ indicative of duration or length of a reproduction tone to a length of the original tone. Then, the tone generating channel $CH^{(n)}$ restores sample values necessary for calculating a sample value corresponding to the read address. In a sampling time period when the read address of the tone generating channel $CH^{(n)}$ has exceeded an address calculated by adding a pitch mark value to the head address, the control section CT not only stores, into the sample buffer $SB^{(CT)}$, a sample value corresponding to an address calculated by adding the head address to a value of the integer portion of the pitch mark value, but also stores the pitch mark value into the target value register $TR^{(CT)}$. Thus, the target value register $TR^{(CT)}$ stores the pitch mark value in the last sampling time period immediately preceding the current sampling time period. Note that numerical values in a sample buffer SB section in FIG. 12 indicate, for reference purposes, indices $_i$ of grains $GR_i$ to which sample values stored in the sample buffer $SB^{(CT)}$ correspond. Namely, sample values stored in a portion "i" of the sample buffer $SB^{(CT)}$ are used when generation of the grain $GR_i$ is started. Then, when causing one of the tone generating channels $CH^{(n+1)}$, $CH^{(n+2)}$ and $CH^{(n+3)}$ (e.g., tone generating channel $CH^{(n+1)}$ to start generating a grain, the control section CT supplies the tone generating channel $CH^{(n+1)}$ with the sample values stored in the sample buffer $SB^{(CT)}$ and the pitch mark value stored in the target value register $TR^{(CT)}$. The tone generating channel $CH^{(n+1)}$ calculates a sample value corresponding to the supplied pitch mark through linear interpolation operations using the sample values and pitch mark value supplied from the control section CT. In this manner, a segment to be used by the tone generating channel $CH^{(n+1)}$ to generate the grain is designated by the control section CT. As described in greater detail later, any one of the tone generating channels $CH^{(n+1)}$, $CH^{(n+2)}$ and $CH^{(n+3)}$ that should start reproducing a grain is selected by the control section CT. Further, reproduction start timing of the grain is controlled by the control section CT in accordance with the pitch magnification $\beta$. More specifically, a time length from a time when generation of one grain is started to a time when generation of the next grain is started is determined in accordance with the pitch magnification $\beta$ and a difference value dpm (the number of samples between the pitch marks). Further, a length, in the time axial direction, of each grain is determined in accordance with an inverse number of a formant magnification $\gamma$, indicative of a magnification of formant frequencies of a reproduction tone to formant frequencies of the original tone, calculated on the basis of a value indicated by the formant setting operator, an envelope signal, a low-frequency signal, etc., and the difference value dpm.

Figure 13A:
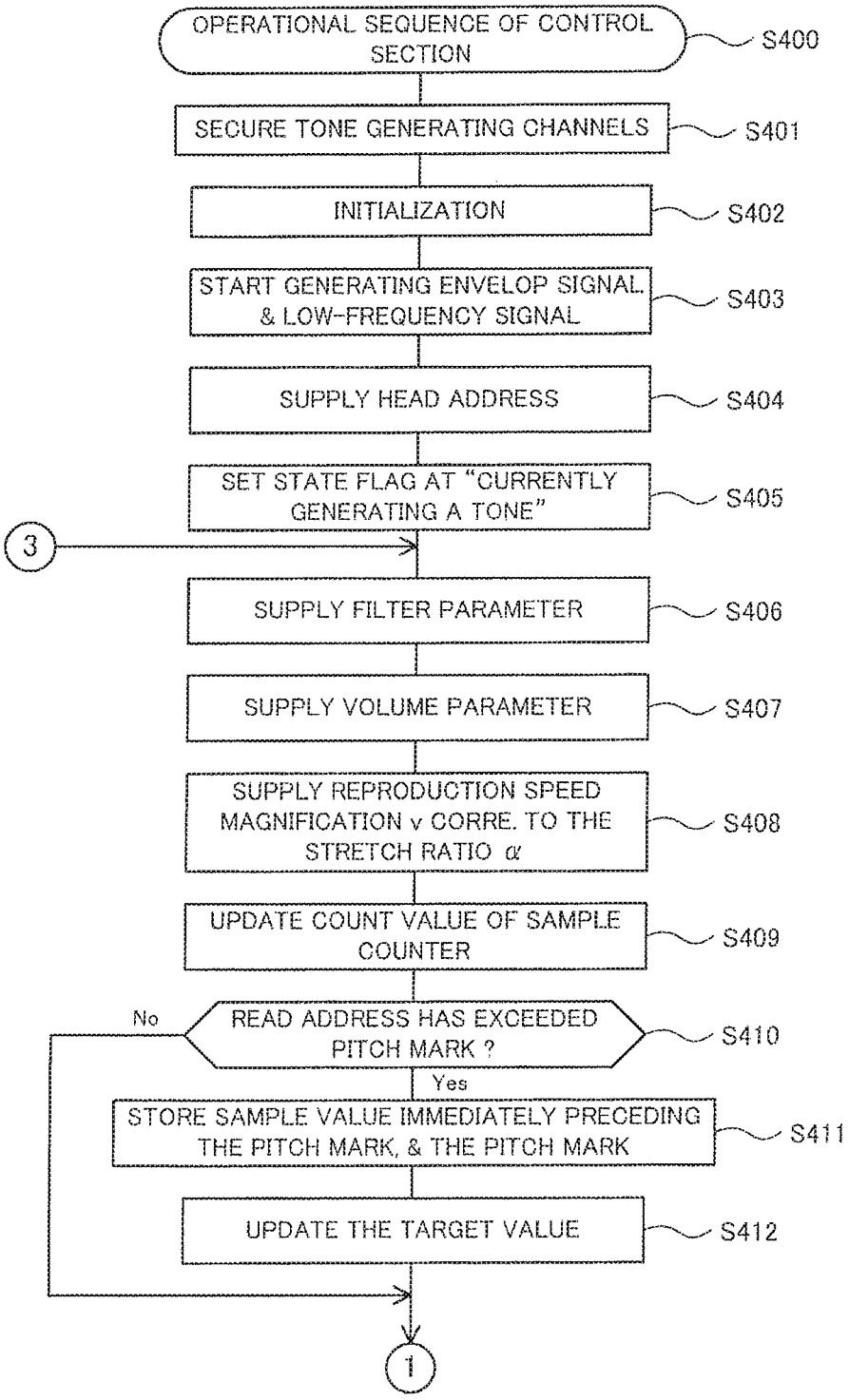
FIG. 13A is a diagram showing a former part of a control operational sequence of the control section in the second mode.
Figure 13B:
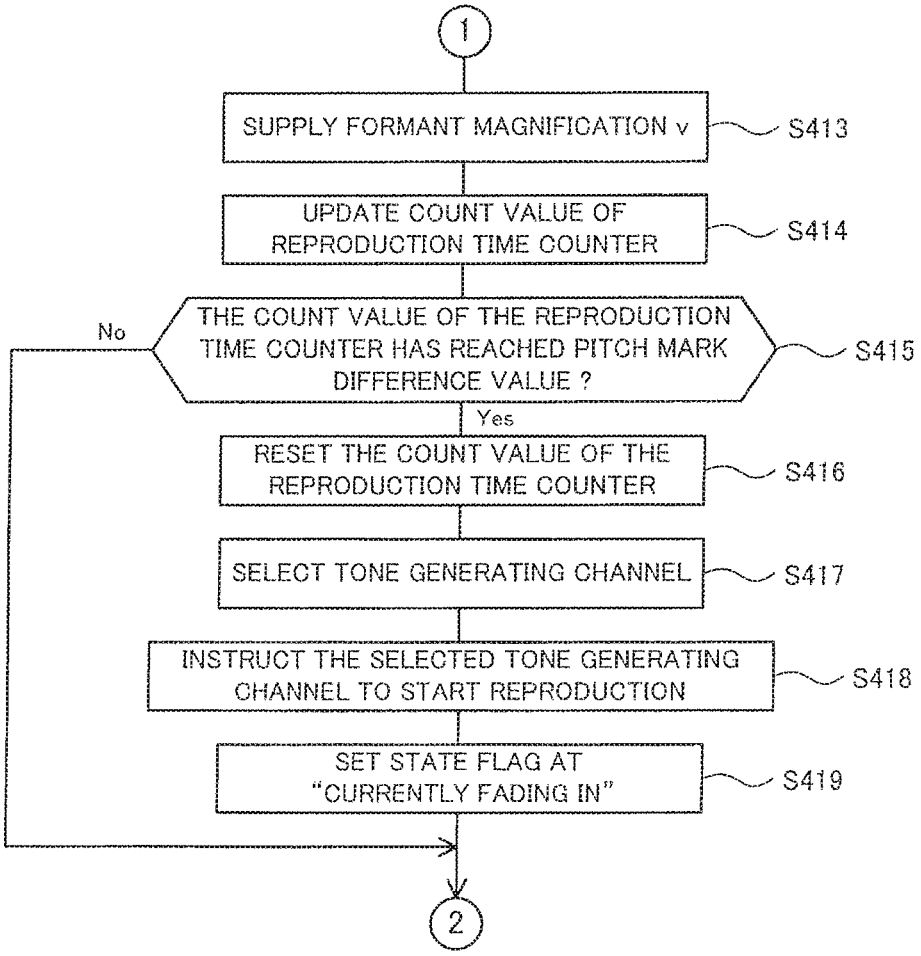
FIG. 13B is a diagram showing a middle part of the control operational sequence of the control section in the second mode.

The following explains in detail a control sequence of the control section CT in the second mode. In the second mode, upon receipt, from the CPU 12*a*, of performance operation information including tone generation start information (e.g., note-on information), the control section CT operates in accordance with the control sequence shown in FIGS. 13A, 13B and 13C. The control section CT starts its operation at step S400 and secures four tone generating channels at step S401. In the following description, the thus-secured tone generating channels are represented as tone generating channels $CH^{(n)}$, $CH^{(n+1)}$, $CH^{(n+2)}$ and $CH^{(n+3)}$. Then, at step S402, the control section CT performs an initialization process at step S402. More specifically, the control section CT sets, at an initial value "0", a target value $t_v$ that is to be used for determining whether the read address in the tone generating channels $CH^{(n)}$ has exceeded an address calculated by adding a pitch mark value to the head address. Further, the control section CT stores the initial value "0" into the target value register $TR^{(CT)}$. Also, the control section CT reads a head sample value via the tone generating channel $CH^{(n)}$ and stores the thus-read head sample value into the sample buffer $SB^{(CT)}$. Furthermore, the control section CT sets the count value $t_s^{(CT)}$ of the sample counter $C_s^{(CT)}$ at "0". Furthermore, the control section CT sets the state flags $SF_{n+1}^{(CT)}$, $SF_{n+2}^{(CT)}$ and $SF_{n+3}^{(CT)}$ corresponding to the tone generating channels $CH^{(n+1)}$, $CH^{(n+2)}$ and $CH^{(n+3)}$ at "currently out of operation".

Then, at step S403, the control section CT activates the operation of the envelope generation circuit and the low-frequency oscillator so that the envelope generation circuit and the low-frequency oscillator generate an envelope signal and a low-frequency signal in accordance with parameters defining various envelope signals and parameters defining various low-frequency signals that are included in the input performance operation information and the setting information input before the input of the performance operation information (hereinafter referred to simply as "performance operation information" and "setting information").

Then, at step S404, the control section CT supplies the head address to the tone generating channel $CH^{(n)}$ to cause the tone generating channel $CH^{(n)}$ to start its operation and sets the state flag $SF_n^{(CT)}$ at "currently generating a tone" at step S405.

Then, at step S406, the control section CT generates a filter parameter and supplies the generated filter parameter to the filter circuit $FLT^{(n)}$, as in the first mode. At next step S407, the control section CT generates a volume parameter and supplies the thus-generated volume parameter to the volume control circuit VOL, as in the first mode. Note that, in the second mode too, the setting information is changeable even during tone generation. Further, the control section CT can change the envelope signal and the low-frequency signal in accordance with respective values indicated by the tone duration setting operator, the pitch setting operator and the formant setting operator.

Next, at step S408, the control section CT calculates a stretch ratio $\alpha$ on the basis of the value indicated by the tone duration setting operator and then supplies a reproduction speed magnification v, which is an inverse number of the stretch ratio $\alpha$ (i.e., $v=1/\alpha$), to the tone generating channel $CH^{(n)}$. Then, at step S409, the control section CT updates the count value $t_s^{(CT)}$. Namely, the control section CT adds the reproduction speed magnification v to the count value $t_s^{(CT)}$ of the sample counter $C_s^{(CT)}$. Note, however, that the reproduction speed magnification v is set at a value "0" in the first sampling time period and then set at the reproduction speed magnification v corresponding to the stretch ratio $\alpha$ in the next and subsequent sampling time period. Note that the count value $t_s^{(n)}$ of the sample counter $C_s^{(n)}$ and the count value $t_s^{(CT)}$ of the sample counter $C_s^{CT)}$ are identical to each other in each of the sampling time periods. The count value $t_s^{(CT)}$ and the count value $t_s^{(n)}$ are "0" in the first sampling time period.

Then, at step S410, the control section CT determines whether the read address has exceeded an address calculated by adding a pitch mark value to the head address. More specifically, the control section CT determines whether the count value $t_s^{(CT)}$ of the sample counter $C_s^{(CT)}$ has exceeded the target value $t_v$. If the count value $t_s^{(CT)}$ of the sample counter $C_s^{(CT)}$ has not yet exceeded the target value $t_v$, the control section CT makes a NO determination at step S410 and then jumps to step S412. If the count value $t_s^{(CT)}$ of the sample counter $C_s^{(CT)}$ has exceeded the target value $t_v$, on the other hand, the control section CT makes a YES determination at step S410 and then goes to step S411, where it acquires, from the decode circuit $DEC^{(n)}$ of the tone generating channel $CH^{(n)}$, a sample value corresponding to a value of the integer portion of the target value $t_v$ and not only writes and stores the acquired sample value into the sample buffer $SB^{(CT)}$ but also writes and stores the target value $t_v$ into the target value register $TR^{(CT)}$. The target value $t_v$ to be written into the target value register $TR^{(CT)}$ at this time point is the last (immediately-preceding) pitch mark value which is "0" in an initial state. The sample value corresponding to the value of the integer portion of the target value $t_v$ is a sample value immediately preceding a pitch mark corresponding to the current read address (sample value at the head address in the initial state). Then, step S412, the control section CT updates the target value $t_v$. Namely, the control section CT reads out the next pitch mark value (i.e., pitch mark value immediately following the current pitch mark value in the time-axial direction) from the waveform memory WM. Then, the control section CT stores the thus-read-out pitch mark value as a new target value $t_v$. In this manner, the target value $t_v$ is updated to the next pitch mark value.

Note that the sample counter $C_s^{(CT)}$ of the control section CT functions to perform stretch/compression control on a total length of a to-be-generated waveform along the time axis in accordance with the stretch ratio $\alpha$. In a case where the time length is not stretched or compressed, $\alpha=v=1$, and the count value $t_s^{(CT)}$ is incremented one by one in synchronism with a time progression in the sampling time period. As a consequence, the target value $t_v$ is updated at the same time position as each pitch mark position of the original tone waveform. For this feature, see the case of $\alpha=1$.

In a case where the time length is stretched, $\alpha>1$, i.e. $v<1$, and the count value $t_s^{(CT)}$ is incremented by a fractional value smaller than "1" in synchronism with a time progression in the sampling time period. As a consequence, the target value $t_v$ is updated at a time position later than each pitch mark of the original tone waveform, so that the overall time length of a waveform to be generated will increase. For this feature, refer, for example, to the case of $\alpha=2$ or $\alpha=1.5$ in FIG. 16.

In a case where the time length is compressed, $\alpha<1$, i.e. $v>1$, and the count value $t_s^{(CT)}$ is incremented by a fractional value greater than "1" in synchronism with a time progression in the sampling time period. As a consequence, the target value $t_v$ is updated at a time position earlier than each pitch mark of the original tone waveform, so that the overall time length of a waveform to be generated will decrease. For this feature, refer, for example, to the case of $\alpha=0.5$ or $\alpha=0.7$ in FIG. 16.

As described later, the sample counter $C_s^{(n)}$ of the tone generating channel $CH^{(n)}$, performs its counting operation in synchronism with the sample counter $C_s^{(CT)}$ of the control section CT, is used to generate a sample value corresponding to the count value $t_s^{(n)}$. However, the sample value generated in response to the count value $t_s^{(n)}$ of the sample counter $C_s^{(n)}$ of the tone generating channel $CH^{(n)}$ is used only to acquire sample values (i.e., the head sample value of each grain) corresponding to individual pitch mark positions that are subjected to stretch/compression control on the time axis as noted above, and such a sample value generated in response to the count value $t_s^{(n)}$ never becomes a sample value constituting a grain waveform. With such arrangements, time-axial stretch/compression control according to the stretch ratio $\alpha$ can be performed independently of other control, such as pitch control according to the pitch magnification $\beta$ and/or formant control according to the formant magnification $\gamma$.

Then, at step S413, the control section CT supplies the formant magnification $\gamma$ (readout rate) to all tone generating channels currently generating tones (currently fading-in or fading-out) of the tone generating channels $CH^{(n+1)}$, $CH^{(n+2)}$ and $CH^{(n+3)}$. In the second mode (and in the third and fourth mode as well), there are resources (more specifically, the envelope generation circuit and low-frequency oscillator that generates a pitch-related envelope and low-frequency signal) which are provided for tone generating channels $CH^{(n+1)}$, $CH^{(n+2)}$ and $CH^{(n+3)}$ but are not actually used. Thus, as an example, these envelope generation circuit and low-frequency oscillator are appropriated to generate an envelope signal and/or low-frequency signal as a control signal to vary over time formant frequencies of a reproduction tone.

Then, at step S414, the control section CT updates the count value $t_{RT}^{(CT)}$ of the reproduction time counter $C_{RT}^{(CT)}$. Namely, the control section CT determines a pitch of the reproduction tone on the basis of pitch information obtained by synthesizing pitch-related parameters (e.g., note NO. NN, and a value indicated by the pitch setting operator), a pitch-varying envelope signal and a low-frequency signal included in the performance operation information and setting information. Then, the control section CT calculates a pitch magnification $\beta$ indicative of the determined pitch of the reproduction tone to the pitch OP of the original tone and then adds the calculated pitch magnification $\beta$ to the count value $t_{RT}^{(CT)}$ of the reproduction time counter $C_{RT}^{(CT)}$. Note, however, the count value $t_{RT}^{(CT)}$ is set at "0" in the first sampling time period.

Then, at step S415, the control section CT determines whether the count value $t_{RT}^{(CT)}$ of the reproduction time counter $C_{RT}^{(CT)}$ has exceeded the difference value dpm between the value of the target value register $TR^{(CT)}$ (immediately preceding or last pitch mark value) and the current target value $t_v$ (next pitch mark value). If the count value $t_{RT}^{(CT)}$ has not yet exceeded the difference value dpm as determined at step S415, the control section CT jumps to step S419. If the count value $t_{RT}^{(CT)}$ has exceeded the difference value dpm as determined at step S415, on the other hand, the control section CT goes to step S416, where it resets the count value $t_{RT}^{(CT)}$ (subtracts the difference value dpm from the count value $t_{RT}^{(CT)}$ and leaves the remainder). Then, at step S417, the control section CT selects one of the tone generating channels which are currently out of operation (i.e., currently available), with reference to the state flags $SF_{n+1}^{(CT)}$, $SF_{n+2}^{(CT)}$ and $SF_{n+3}^{(CT)}$. In the first sampling time period, the control section CT determines, at step S415, that the count value $t_{RT}^{(CT)}$ has exceeded the difference value dpm, and, then, at step S417, the control section CT selects one of the tone generating channels currently out of operation. For example, of the tone generating channels currently out of operation, the control section CT selects the tone generating channel of the smallest index No. In the first sampling time period, the control section CT selects the tone generating channel $CH^{(n+1)}$ because the count value $t_{RT}^{(CT)}$ is "0" and the tone generating channels $CH^{(n+1)}$, $CH^{(n+2)}$ and $CH^{(n+3)}$ are all currently out of operation.

Then, at step S418, the control section CT supplies the sample value and the last pitch mark value stored in the sample buffer $SB^{(CT)}$ and the target value register $TR^{(CT)}$, respectively, the formant magnification γ and the difference value dpm to the selected tone generating channel to thereby cause the selected tone generating channel to start generating a tone. Behavior or operation of the tone generating channels $CH^{(n+1)}$, $CH^{(n+2)}$ and $CH^{(n+3)}$ will be described later. Then, at step S419, the control section CT sets at "currently fading in" the state flag corresponding to the tone generating channel having been caused to start generating a tone.

Note that the reproduction time counter $C_{RT}^{(CT)}$ performs a function for variably controlling, in accordance with the pitch magnification β, a pitch per segment (grain) of a waveform to be generated. In a case where the pitch is not to be changed, the pitch magnification β=1, and the count value $t_{RT}^{(CT)}$ of the reproduction time counter $C_{RT}^{(CT)}$ is incremented by one in synchronism with a progression of the sampling time period. As a consequence, the time point when the count value $t_{RT}^{(CT)}$ exceeds the difference value dpm between the value of the target value register $TR^{(CT)}$ (immediately preceding or last pitch mark value) and the current target value $t_v$ (next pitch mark value) matches a time position of a pitch mark in the instant segment of the original tone waveform. Also, a time difference from a time when a given tone generating channel (e.g., $CH^{(n+1)}$ has been instructed to start tone generation to a time when another tone generating channel (e.g., $CH^{(n+2)}$) is instructed to start tone generation becomes equivalent to a time length of one cycle in the instant segment of the original tone waveform, so that a pitch of a waveform obtained by cross-fade synthesizing grain waveforms generated by the two tone generating channels (e.g., $CH^{(n+1)}$ and $^{(n+2)}$) becomes equivalent to a tone pitch in the instant segment of the original tone waveform. For this feature, refer, for example, to a later-described case of "β=1" of FIG. 17.

If the pitch is to be relatively lowered, β<1, and the count value $t_{RT}^{(CT)}$ of the reproduction time counter $C_{RT}^{(CT)}$ is incremented by a fractional value smaller than "1" in synchronism with a progression of the sampling time period. As a consequence, the time point when the count value $t_{RT}^{(CT)}$ exceeds the difference value dpm between the value of the target value register $TR^{(CT)}$ (immediately preceding or last pitch mark value) and the current target value $t_v$ (next pitch mark value) will be later than a time position of the middle pitch mark in the instant segment of the original tone waveform. Thus, a time difference from a time when a given tone generating channel (e.g., $CH^{(n+1)}$) has been instructed to start tone generation to a time when another tone generating channel (e.g., $CH^{(n+2)}$) is instructed to start tone generation will be longer than the time length of one cycle in the instant segment of the original tone waveform, so that a pitch of a waveform obtained by cross-fade synthesizing grain waveforms generated by the two tone generating channels (e.g., $CH^{(n+1)}$ and $CH^{(n+2)}$) will be lower than the tone pitch in the instant segment of the original tone waveform. For this feature, refer, for example, to a later-described case of "β=0.6" in FIG. 17.

If the pitch is to be relatively raised, β>1, and the count value $t_{RT}^{(CT)}$ of the reproduction time counter $C_{RT}^{(CT)}$ is incremented by a fractional value greater than "1" in synchronism with a progression of the sampling time period. As a consequence, the time point when the count value $t_{RT}^{(CT)}$ exceeds the difference value dpm between the value of the target value register $TR^{(CT)}$ (last pitch mark value) and the current target value $t_v$ (next pitch mark value) will be earlier than a time position of the middle pitch mark in the instant segment of the original tone waveform. Thus, a time difference from a time when a given tone generating channel (e.g., $CH^{(n+1)}$) has been instructed to start tone generation to a time when another tone generating channel (e.g., $CH^{(n+2)}$) is instructed to start tone generation will be shorter than the time length of one cycle in the instant segment of the original tone waveform, so that a pitch of a waveform obtained by cross-fade synthesizing grain waveforms generated by the two tone generating channels (e.g., $CH^{(n+1)}$ and $CH^{(n+2)}$) will be higher than the tone pitch in the instant segment of the original tone waveform. For this feature, refer, for example, to a later-described case of "β=1.2" in FIG. 17.

In the aforementioned manner, pitch control according to the pitch magnification β can be performed independently of other control, such as time-axial stretch/compression control according to the stretch ratio α and/or formant control according to the formant magnification γ.

Figure 13C:
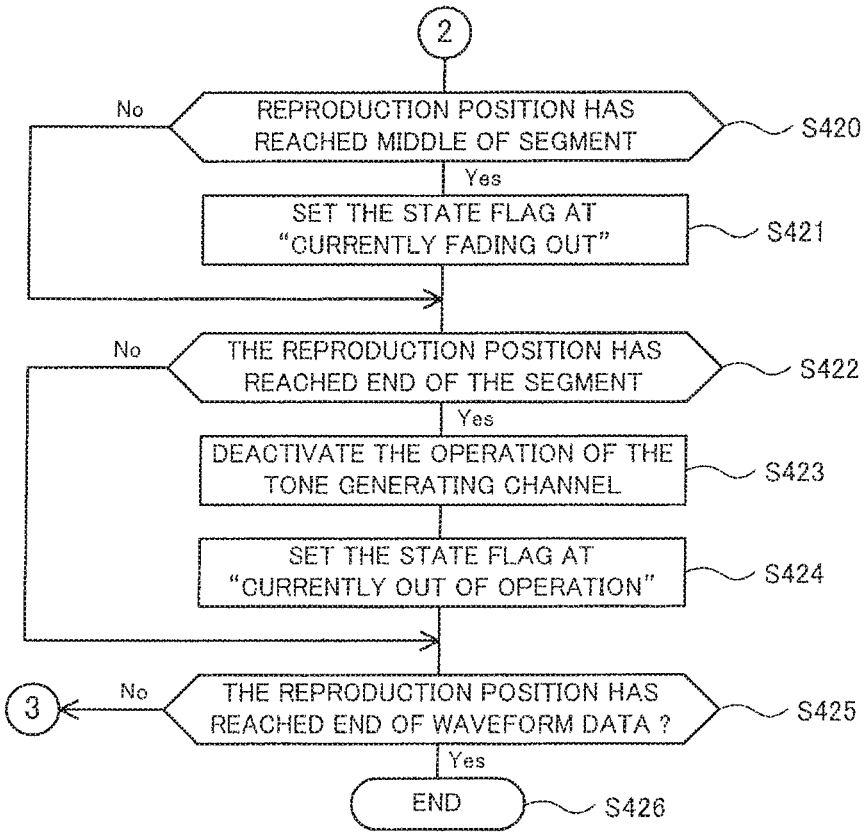
FIG. 13C is a diagram showing a rear part of the control operational sequence of the control section in the second mode.

Referring next to FIG. 13C, the control section CT selects, at step S420, one of the tone generating channels $CH^{(n+1)}$, $CH^{(n+2)}$ and $CH^{(n+3)}$ which is currently generating a tone and then determines whether the read address (reproduction position) in the selected tone generating channel has reached the middle pitch mark in the instant segment. If the read address is located in front of the middle pitch mark, the control section CT makes a "NO" determination and jumps steps S422. If the read address has reached the middle pitch mark, on the other hand, the control section CT makes a "YES" determination and then proceeds to step S421 to set the state flag indicative of an operating state of the selected tone generating channel at "currently fading out".

At step S422, the control section CT selects one of the tone generating channels $CH^{(n+1)}$, $CH^{(n+2)}$ and $CH^{(n+3)}$ which is currently fading out and then determines whether the read address in the selected tone generating channel has reached the end of the segment. If the read address is still located in an intermediate portion of the segment, the control section CT makes a "NO" determination and jumps steps S422 and then jumps to step S425. If the read address in the selected tone generating channel has reached the end of the segment, the control section CT makes a "YES" determination at step S422, then deactivates the operation of the selected tone generating channel at step S423 and then proceeds to step S424 to set the state flag, indicative of an operating state of the selected tone generating channel, at "currently out of operation" (currently available).

Then, at step S425, the control section CT determines whether the read address in the selected tone generating channel $CH^{(n)}$ has reached the end of the original tone waveform data (i.e., the end of the last segment of the original tone waveform). If the read address has reached the end of the original tone waveform data (i.e., the end of the last segment), the control section CT proceeds to step S426, where it deactivates the operation of the selected tone generating channel $CH^{(n)}$ and sets the state flag $SF_n^{(CT)}$ of the selected tone generating channel at "currently out of operation". Further, the control section CT constantly monitors the respective read addresses of the tone generating channels $CH^{(n+1)}$, $CH^{(n+2)}$ and $CH^{(n+3)}$ and deactivates the operation of any of the tone generating channels $CH^{(n+1)}$, $CH^{(n+2)}$ and $CH^{(n+3)}$ where the read address of the tone generating channel has reached the end address of the segment forming the basis of the grain currently being generated (i.e., the last segment), but also sets the state flag of that tone generating channel at "currently out of operation". When the read addresses of all of the tone generating channels $CH^{(n+1)}$, $CH^{(n+2)}$ and $CH^{(n+3)}$ have reached the last addresses of the respective last segments, the control section CT terminates the control on the track TK. If a NO determination has been made at step S425, the control section CT reverts to step S406 of FIG. 13A in the next sampling time period so that the operations of steps S406 to S425 are performed again.

Figure 14:
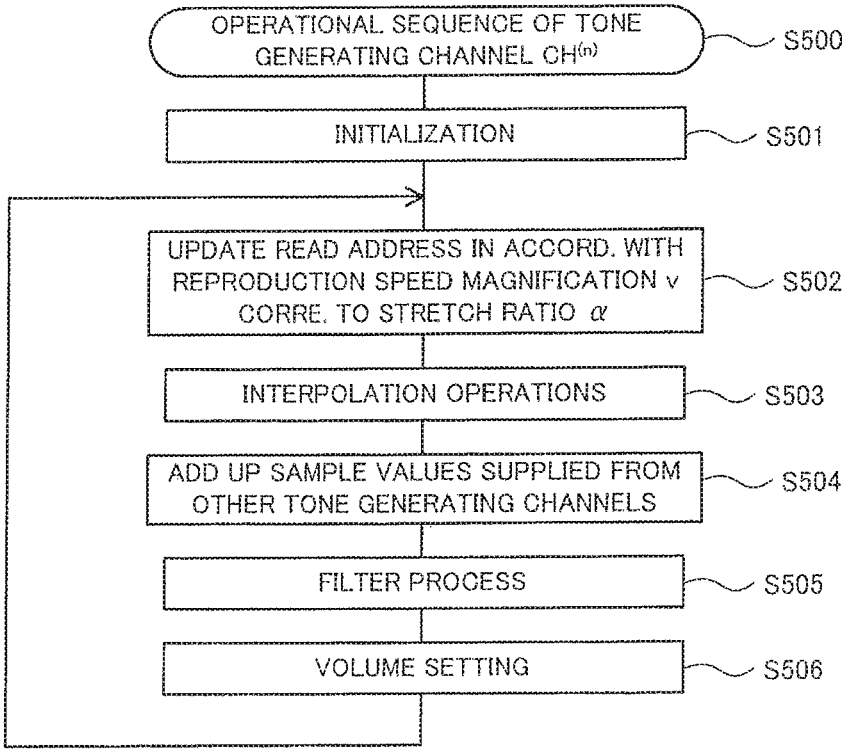
FIG. 14 is a diagram showing an operational sequence of a head tone generating channel of a plurality of tone generating channels constituting a track in the second mode.

Next, a detailed description will be given about a control operational sequence of the tone generating channel $CH^{(n)}$. Once the control section CT instructs the tone generating channel $CH^{(n)}$ to start operation, the tone generating channel $CH^{(n)}$ starts operating in accordance with the control sequence of FIG. 14 at step S500. Then, at step S501, the read circuit $DRD^{(n)}$ performs an initialization process that is similar to the initialization process performed in the first mode except that the head sample value stored in the decode circuit $DEC^{(n)}$ is supplied to the control section CT.

Then, at step S502, the read circuit $DRD^{(n)}$ adds a reproduction speed magnification v to the count value $t_s$ of the sample counter $C_s^{(CT)}$ and adds the result of the addition to the head address to thereby update the read address.

Then, at step S503, the read circuit $DRD^{(n)}$ and the decode circuit $DEC^{(n)}$ cooperate to obtain a sample value corresponding to the read address as in the first mode. Further, as noted above, in the sampling time period when the count value $t_s^{(CT)}$ has exceeded the target value $t_v$, the decode circuit $DEC^{(n)}$ supplies the control section CT with a sample value corresponding to an integer portion of the target value $t_v$. Then, at step S504, the addition circuit $ADD^{(n)}$ of the overlap-add circuit (overlap adder) $OLA^{(n)}$ adds up sample values supplied from the addition circuits $ADD^{(n+1)}$, $ADD^{(n+2)}$ and $ADD^{(n+3)}$ of the other tone generating channels $CH^{(n+1)}$, $CH^{(n+2)}$ and $CH^{(n+3)}$ and supplies the result of the addition (or sum) to the filter circuit $FLT^{(n)}$.

Note that, in the instant embodiment, the addition circuit $ADD^{(n)}$ of the overlap-add circuit $OLA^{(n)}$ of the channel $CH^{(n)}$ adds up the sample values supplied from the addition circuits $ADD^{(n+1)}$, $ADD^{(n+2)}$, $ADD^{(n+3)}$ of the other tone generating channels $CH^{(n+1)}$, $CH^{(n+2)}$ and $CH^{(n+3)}$ of the same track TK without adding, to the sample values supplied from the addition circuits $ADD^{(n+1)}$, $ADD^{(n+2)}$, $ADD^{(n+3)}$, the output of the decode circuit $DEC^{(n)}$ of that channel $CH^{(n)}$. Because, in the instant embodiment, the tone generating channel $CH^{(n)}$ does not generate a grain GR. However, in a case where the tone generating channel $CH^{(n)}$ too is constructed to generate a grain GR as in a later-described modification, the addition circuit $ADD^{(n)}$ adds up the sample values supplied from the addition circuits $ADD^{(n+1)}$, $ADD^{(n+2)}$, $ADD^{(n+3)}$ of the tone generating channels $CH^{(n+1)}$, $CH^{(n+2)}$ and $CH^{(n+3)}$ and the output of the decode circuit $DEC^{(n)}$ of the channel $CH^{(n)}$.

Then, at steps S505 and S506, the filter circuit $FLT^{(n)}$ and the volume control circuit $VOL^{(n)}$ perform operations similar to those performed in the first mode. In each of the second and subsequent sampling time periods, the tone generating channel $CH^{(n)}$ performs the aforementioned operations of steps S502 to S506 above.

The following describe a control sequence of the tone generating channel $CH^{(n+1)}$. Operation of the other tone generating channels $CH^{(n+2)}$ and $CH^{(n+3)}$ is similar to that of the tone generating channel $CH^{(n+1)}$ and thus will not be described here to avoid unnecessary duplication.

Figure 15:
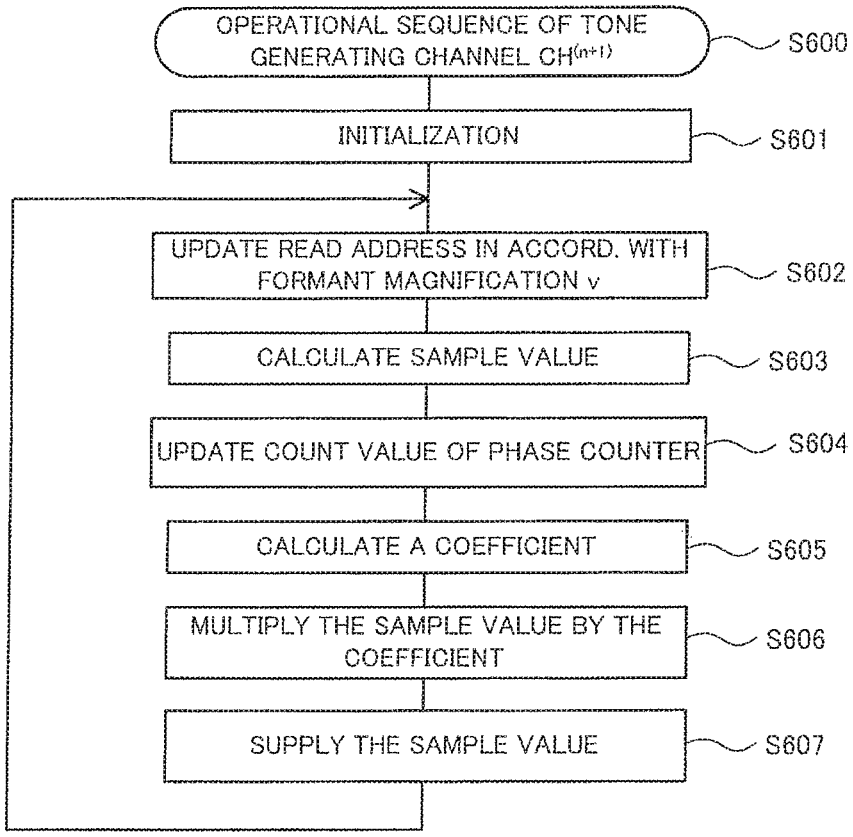
FIG. 15 is a diagram showing an operational sequence of another generating channel than the head tone generating channel in the second mode.

Once the tone generating channel $CH^{(n+1)}$ is instructed by the control section CT to start its operation, the tone generating channel $CH^{(n+1)}$ starts operating in accordance with the control sequence shown in FIG. 15, at step S600. Then, the read circuit $DRD^{(n+1)}$ performs an initialization process that is similar to the initialization process performed in the first mode. In the initialization process performed in this case, however, the read circuit $DRD^{(n+1)}$ and the decode circuit $DEC^{(n+1)}$ calculate a head sample value of a segment to be used for generating a grain in the following manner. First, the read circuit $DRD^{(n+1)}$ reads a pitch mark value and a sample value corresponding to an address of a value of an integer portion of the pitch mark value supplied from the control section CT and supplies the pitch mark value and sample value to the decode circuit $DEC^{(n+1)}$. Then, the read circuit $DRD^{(n+1)}$ reads out, from the waveform memory WM via the cache circuit CM, compressed data of an address corresponding to a value calculated by adding "1" to the value of the integer portion of the pitch mark value and then supplies the read-out waveform data to the decode circuit $DEC^{(n+1)}$ together with the aforementioned pitch mark value and the sample value input from the control section CT. Then, the decode circuit $DEC^{(n+1)}$ calculates an accurate sample value corresponding to the supplied pitch value through the linear interpolation operations using the data input from the read circuit $DRD^{(n+1)}$. The thus-calculated sample value corresponds to the head address of the segment to be used for generating the grain. Further, in the initialization process, the multiplication circuit $MUL^{(n+1)}$ of the overlap-add circuit $OLA^{(n+1)}$ resets the count value $t_P^{(n+1)}$ of the phase counter $C_P^{(n+1)}$.

Then, at step S602, the read circuit $DRD^{(n+1)}$ adds the formant magnification γ (readout rate) to the count value $t_s^{(n+1)}$ of the sample counter $C_s^{(n+1)}$ and adds the result of the addition to the pitch mark value input from the control section CT to thereby update the read address.

Then, at step S603, the read circuit $DRD^{(n+1)}$ and the decode circuit $DEC^{(n+1)}$ cooperate to obtain or calculate a sample value corresponding to the calculated read address as in the first mode and supply the obtained sample value to the multiplication circuit $MUL^{(n+1)}$.

The sample value thus read out in accordance with the count value $t_s^{(n+1)}$ of the sample counter $C_s^{(n+1)}$ constitutes waveform data of the segment that forms the basis of the grain to be generated in the tone generating channel $CH^{(n+1)}$. The sample counter $C_s^{(n+1)}$ of such a grain-generating tone generating channel $CH^{(n+1)}$ performs a function for controlling a formant (tone color) per segment (grain) of a waveform to be generated. Namely, a waveform of one segment controlled with a time function is compressed or stretched in accordance with the formant magnification γ so that the formant varies. For example, in a case where no formant control is to be performed, the formant magnification γ is "1", and the sample counter $C_s^{(n+1)}$ is incremented by one in synchronism with a progression of the sampling time period. As a consequence, the formant (tone color) per segment (grain) of the waveform to be generated does not change from a formant characteristic of the original tone waveform. If the formant magnification γ is other than "1", the sample counter $C_s^{(n+1)}$ is incremented by a fractional value smaller or greater than "1" in synchronism with a progression of the sampling time period. As a consequence, the formant per segment (grain) of the waveform to be generated changes from the formant characteristic of the original tone waveform.

In the aforementioned manner, the formant control according to the formant magnification $\gamma$ can be performed independently of other control, such as the time-axial stretch/compression control according to the stretch ratio $\alpha$ and/or the pitch control according to the pitch magnification $\beta$.

Referring back to FIG. 15, the multiplication circuit $MUL^{(n+1)}$ updates the count value $t_P^{(n+1)}$ of the phase counter $C_P^{(n+1)}$, at step S604. Namely, when the state flag $SF_{n+1}^{(CT)}$ is set at "currently fading in", a value calculated by dividing the formant magnification $\gamma$ by the difference value dpm (i.e., $\gamma$/dpm) is added to the count value $t_P^{(n+1)}$ of the phase counter $C_P^{(n+1)}$. When the state flag $SF_{n+1}^{(CT)}$ is set at "currently fading out", on the other hand, the value calculated by dividing the formant magnification $\gamma$ by the difference value dpm (i.e., $\gamma$/dpm) is subtracted from the count value $t_P^{(n+1)}$ of the phase counter $C_P^{(n+1)}$, at step S604. Then, at step S605, the multiplication circuit $MUL^{(n+1)}$ calculates a coefficient $WD(t_P^{(n+1)})$ corresponding to the count value $t_P^{(n+1)}$. For example, the coefficient $WD(t_P^{(n+1)})$ is calculated using an arithmetic expression of "0.5-0.5 $\cos(\pi t_P^{(n+1)})$" (see FIG. 4A). Then, at step S606, the multiplication circuit $MUL^{(n+1)}$ multiplies the sample value input from the decode circuit $DEC^{(n+1)}$ by the calculated coefficient $WD(t_P^{(n+1)})$ and supplies the coefficient-multiplied sample value to the addition circuit $ADD^{(n+1)}$. In this way, a time width of the window function can be matched with the length of the segment stretched/compressed in accordance with the formant magnification $\gamma$. Then, at step S607, the addition circuit $ADD^{(n+1)}$ of the overlap-add circuit $OLA^{(n)}$ supplies the sample value to the overlap-add circuit $OLA^{(n)}$ of the tone generating channel $CH^{(n)}$.

In each of the second and subsequent sampling time periods, the tone generating channel $CH^{(n+1)}$ performs the aforementioned operations of steps S602 to S607.

With the aforementioned arrangements, the tone-generation-duration stretch/compression control according to the stretch ratio $\alpha$, variable tone pitch control according to the pitch magnification $\beta$ and formant control according to the formant magnification $\gamma$ can be performed independently of one another in the second mode, as will be described below in greater detail.

Figure 16:
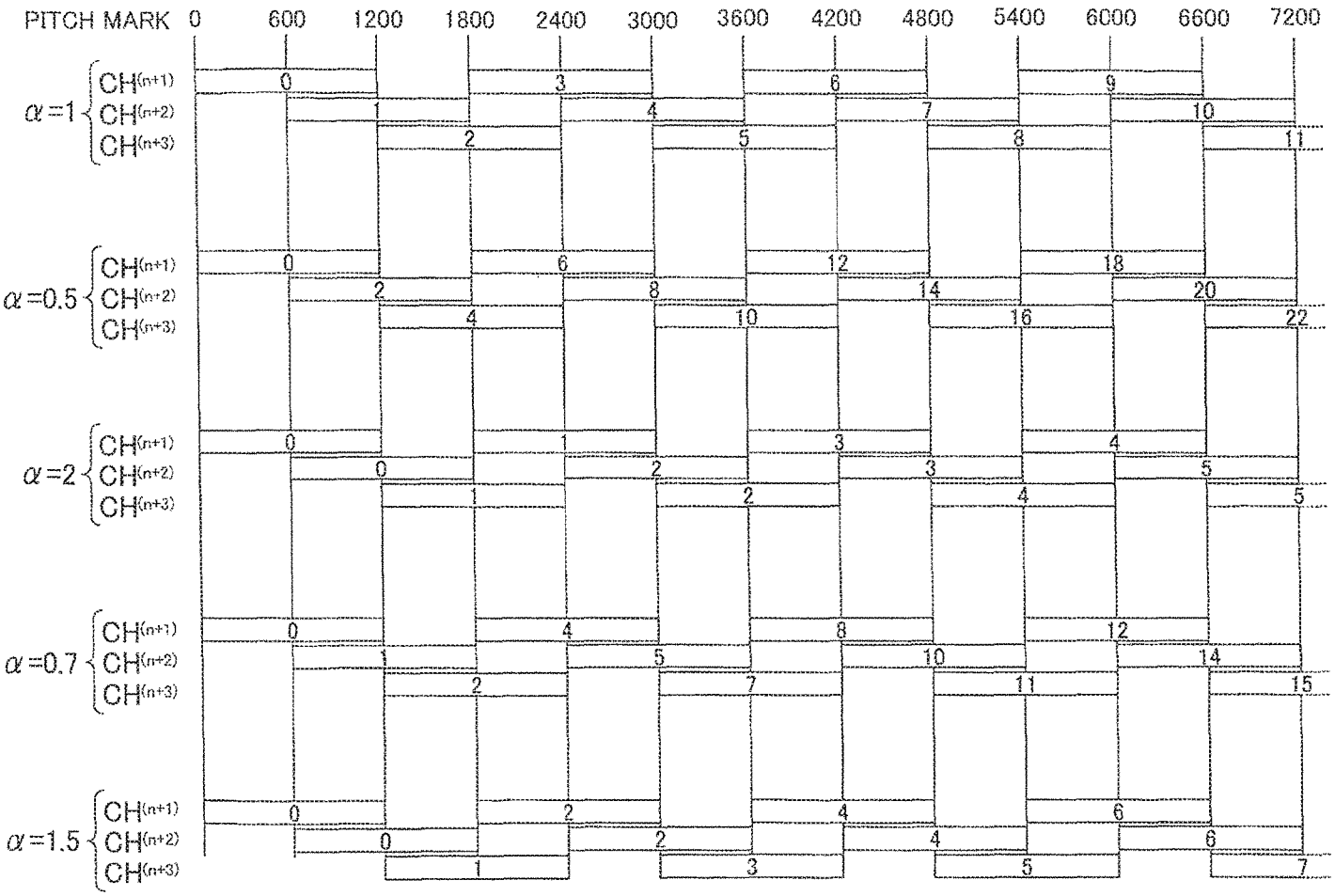
FIG. 16 is a conceptual diagram showing that different series of grains are reproduced in accordance with different values of a stretch ratio.

The following describe, with reference to FIG. 16, relationship among generation start timings of grains $_i$ to be generated by the tone generating channels $CH^{(n+1)}$, $CH^{(n+2)}$ and $CH^{(n+3)}$, the grains $_i$ and segments $SG_i$ in a case where duration or length of a reproduction tone is to be variably controlled in accordance with the stretch ratio $\alpha$ with a pitch and formant maintained the same as the pitch and formant of the original tone. Note that, in FIGS. 16 and 17, a numerical value written in each rectangular block indicative of a segment indicates an index No. $_i$ of the segment $SG_i$ forming the basis of a grain. Note that the index No. $_i$ is identical to an index No. $_i$ of the grain $GR_i$ generated on the basis of the segment $SG_i$. When the stretch ratio $\alpha$ is set at "1", first, the tone generating channel $CH^{(n+1)}$ starts reproducing a grain $GR_0$. Then, once the reproduction position of the tone generating channel $CH^{(n+1)}$ reaches the first pitch mark (e.g., pitch mark value "600") from the start of the reproduction, the tone generating channel $CH^{(n+2)}$ starts reproducing a grain $GR_1$. Once the reproduction position of the tone generating channel $CH^{(n+1)}$ reaches the second pitch mark (e.g., pitch mark value "1200"), the tone generating channel $CH^{(n+2)}$ starts reproducing a grain $GR_2$. At that time, the tone generating channel $CH^{(n+1)}$ having reached the second pitch mark terminates the reproduction of the grain $GR_0$ and stops its operation. Then, once the reproduction position of the tone generating channel $CH^{(n+2)}$ reaches the third pitch mark (e.g., pitch mark value "1800"), the tone generating channel $CH^{(n+3)}$ starts reproducing a grain $GR_3$. After that, the tone generating channels $CH^{(n+1)}$, $CH^{(n+2)}$ and $CH^{(n+3)}$ operate cyclically similarly to the above so that grains $GR_i$ of index No. 4 and greater index Nos. are sequentially reproduced. Note that pitch mark values "600", "1200", . . . written in a pitch mark section are merely illustrative similarly to those in FIG. 10.

The following describe operation of the tone generator circuit 16 when the stretch ratio $\alpha$ is set, for example, at "0.5". In this case, the tone generating channels $CH^{(n+1)}$, $CH^{(n+2)}$ and $CH^{(n+3)}$ operate cyclically so that the generating channels $CH^{(n+1)}$, $CH^{(n+2)}$ and $CH^{(n+3)}$ sequentially reproduce grains $GR_i$ of, for example, index Nos. 0, 2, 4, 6, 8, . . . while thinning out appropriate index Nos. 3, 5, 7, . . . in accordance with the 0.5 stretch ratio. Namely, every other grain $GR_i$ is reproduced in one channel.

The tone generator circuit 16 operates as follows when the stretch ratio $\alpha$ is set at "2". In this case, the tone generating channels $CH^{(n+1)}$, $CH^{(n+2)}$ and $CH^{(n+3)}$ operate cyclically so that the generating channels $CH^{(n+1)}$, $CH^{(n+2)}$ and $CH^{(n+3)}$ sequentially reproduce grains $GR_i$ of index Nos. 0, 1, 2, . . . while repeating reproduction of the grain of each index No. twice like "0, 0, 1, 1, 2, 2, . . . ". Namely, each grain $GR_i$ formed using the same segment $SG_i$ is reproduced twice in succession in accordance with the stretch ratio $\alpha$ of "2".

Further, the tone generator circuit 16 operates as follows when the stretch ratio $\alpha$ is set at "0.7". In this case, the tone generating channels $CH^{(n+1)}$, $CH^{(n+2)}$ and $CH^{(n+3)}$ operate cyclically to sequentially reproduce grains $GR_i$ of, for example, index Nos. 0, 1, 2, 4, 5, 7, . . . while thinning out appropriate index Nos. 3, 6, . . . in accordance with the 0.7 stretch ratio. Furthermore, the tone generator circuit 16 operates as follows when the stretch ratio $\alpha$ is set at "1.5". In this case, the tone generating channels $CH^{(n+1)}$, $CH^{(n+2)}$ and $CH^{(n+3)}$ operate cyclically to sequentially reproduce grains $GR_i$ while repeating appropriate index Nos. 0, 0, 1, 2, 2, 3, . . . in accordance with the 1.5 stretch ratio.

Figure 17:
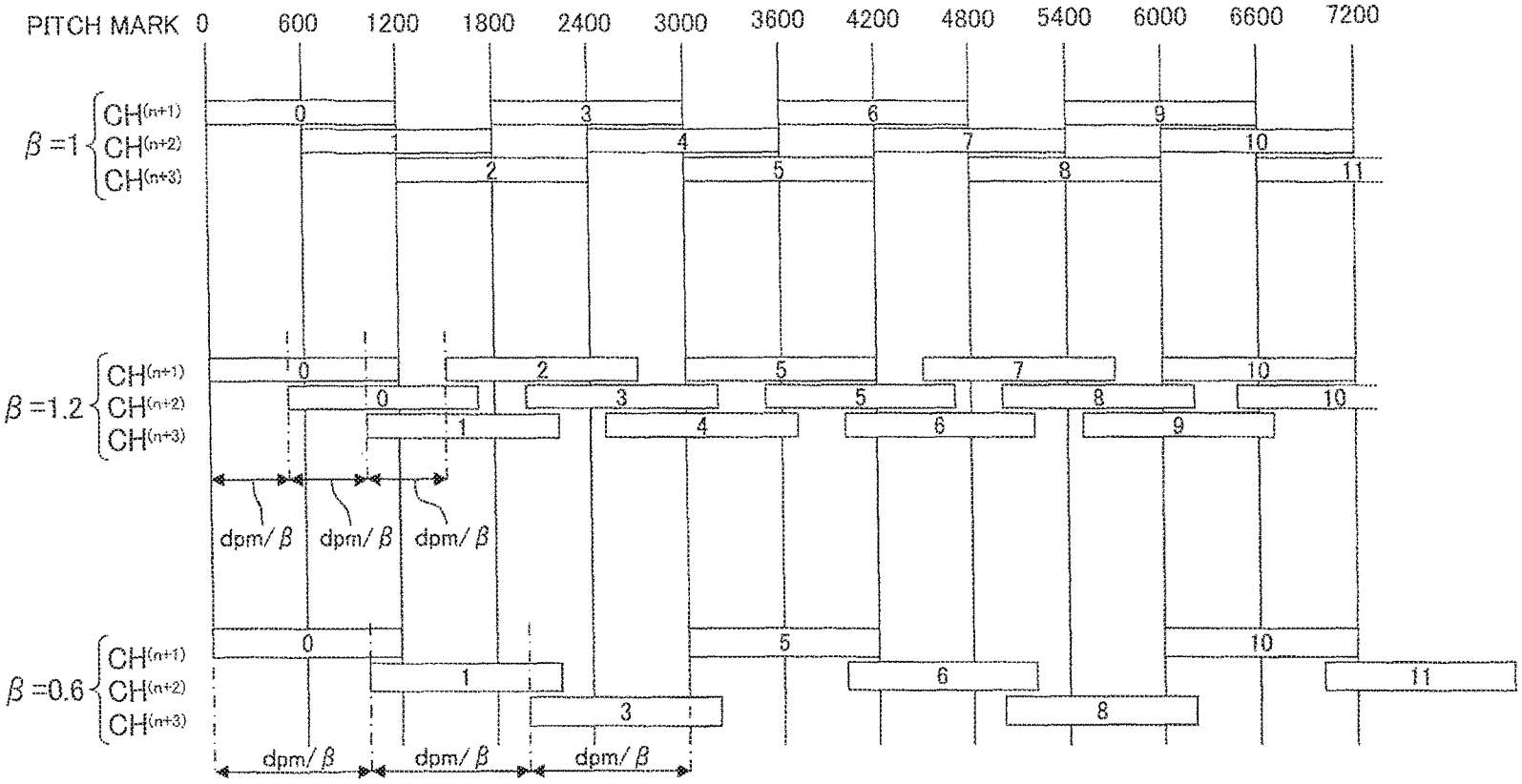
FIG. 17 is a conceptual diagram showing that different series of grains are reproduced in accordance with different values of a pitch magnification.

The following describe, with reference to FIG. 17, series of grains $_i$ to be reproduced by the tone generating channels $CH^{(n+1)}$, $CH^{(n+2)}$ and $CH^{(n+3)}$ and respective reproduction start timings of the grains $_i$ in a case where a reproduction tone is set at a different pitch from the pitch of the original tone with duration and formant of the reproduction tone maintained the same as those of the original tone. In this case too, the tone generating channels $CH^{(n+1)}$, $CH^{(n+2)}$ and $CH^{(n+3)}$ operate cyclically to generate individual grains $GR_i$. Each interval (the number of sampling time periods) between timings at which the tone generating channels $CH^{(n+1)}$, $CH^{(n+2)}$ and $CH^{(n+3)}$ start reproducing grains is determined by the time point when the count value $t_{RT}^{(CT)}$ of the reproduction time counter $C_{RT}^{(CT)}$ of the control section CT incremented in accordance with the pitch magnification $\beta$ exceeds the difference value dpm between the value of the target register $TR^{(CT)}$ (i.e., the last pitch mark value) and the current target value $t_v$ (the next pitch mark value). In FIG. 17, "dpm/$\beta$" represents a time (the number of sampling time periods) before the count value $t_{RT}^{(CT)}$ incremented in accordance with the pitch magnification $\beta$ reaches (exceeds) the difference value dpm, and specifies a time point when the count value $t_{RT}^{(CT)}$ exceeds the difference value dpm between the value of the target register $TR^{(CT)}$ (i.e., the last pitch mark value) and the current target value $t_v$ (the next pitch mark value). Thus, stated differently, the interval (the number of sampling time periods) between timings at which the tone generating channels $CH^{(n+1)}$, $CH^{(n+2)}$ and $CH^{(n+3)}$ respectively start reproducing grains is controlled to match a value (quotient) calculated by dividing the number of sampling time periods between pitch marks (i.e., difference value dpm) by the pitch magnification β. Note that whereas each such quotient is indicated by "dpm/β" in FIG. 17 for convenience, the quotient is a value that can, in effect, differ depending on differences in the number of samples among the individual segments $SG_i$.

When the pitch magnification β is set, for example, at "1.2" in the illustrated example of FIG. 17, the tone generating channel $CH^{(n+2)}$ starts reproducing a grain $GR_0$ once 500 (dpm/β=600/1.2) sampling time periods pass after the tone generating channel $CH^{(n+1)}$ starts reproducing the grain $GR_0$. Then, once 500 sampling time periods pass after the tone generating channel $CH^{(n+2)}$ starts reproducing the grain $GR_0$, the tone generating channel $CH^{(n+3)}$ starts reproducing a grain $GR_1$.

Further, when the pitch magnification β is set at "0.6" in FIG. 17, the tone generating channel $CH^{(n+2)}$ starts reproducing the grain $GR_1$ once 1,000 (dpm/β=600/0.6) sampling time periods pass after the tone generating channel $CH^{(n+1)}$ starts reproducing the grain $GR_0$. Then, once 1,000 sampling time periods pass after the tone generating channel $CH^{(n+2)}$ starts reproducing the grain $GR_1$, the tone generating channel $CH^{(n+3)}$ starts reproducing a grain $GR_3$.

Further, when the formant magnification γ has been changed to a value other than "1" in the illustrated examples of FIGS. 16 and 17, the size of the segment $SG_i$ to be used for generation of grains $GR_i$ is stretched/compressed in the time-axial direction as noted above, and then each grain $GR_i$ is stretched/compressed in the time-axial direction accordingly. If each grain $GR_i$ is compressed in the time-axial direction, formant frequencies of a reproduction tone become higher. If each grain $GR_i$ is stretched in the time-axial direction, formant frequencies of a reproduction tone become lower.

Now, summarizing the foregoing description about the second mode, each of the plurality of channels ($CH^{(n)}$, $CH^{(n+1)}$, $CH^{(n+2)}$ and $CH^{(n+3)}$) includes the sample counter ($C_s^{(n)}$) adapted to perform counting operation at a given rate (stretch ratio α, or formant magnification γ) and is configured to generate a waveform sample value based on retrieving, from a memory, a sample value of an original waveform based on a count value of the sample counter. The control section (CT) is configured to set, independently for each of the channels, the rate (formant magnification γ) and an initial value (target value $t_v$, i.e. "last pitch mark value") for the sample counter of the channel and control the start and stop of the counting operation of the sample counter. Thus, a partial portion (segment or grain) of the original waveform corresponding to a count range from the set initial value to the stop is reproduced in the channel. Further, the control section (CT) is configured to set respective initial values (target values $t_v$, i.e. "last pitch mark values") in a set of channels ($CH^{(n+1)}$, $CH^{(n+2)}$ and $CH^{(n+3)}$) selected from among the plurality of channels such that sample values at different sample positions of the original waveform are retrieved, and control the overlap adder (OLA) to add up waveform samples generated by the set of channels. In this manner, sample values of an audio waveform signal with a plurality of partial portions of the original waveform, which are reproduced by the set of channels ($CH^{(n+1)}$, $CH^{(n+2)}$ and $CH^{(n+3)}$), overlapping one another are output from the overlap adder (OLA).

Further, the control section (CT) is configured to determine, in accordance with information (stretch ratio α) for performing stretch/compression control on a reproduction time length, first and second partial portions of the original waveform that are to be reproduced by first and second channels (e.g., $CH^{(n+1)}$ and $CH^{(n+2)}$), cause reproduction of the first partial portion of the original waveform to be started in the first channel $CH^{(n+1)}$ and cause reproduction of the second partial portion of the original waveform to be started in the second channel $CH^{(n+2)}$.

Heads of the first and second partial portions of the original waveform are specified by first and second reference sample positions (pitch mark values), respectively, of the original waveform. The control section (CT) includes a first counter (sample counter $C_s^{(CT)}$ that performs counting operation in accordance with a first rate (stretch ratio α) designated by the information for performing stretch/compression control on the reproduction time length. Once a count value of the first counter exceeds a predetermined reference value (last pitch mark value) while the first partial portion of the original waveform is being reproduced in the first channel with the first reference sample position used as the initial position, the control section instructs the second channel to start reproducing the second partial portion of the original waveform with the second reference sample position (next pitch mark value) used as the initial position.

The sample counter ($C_s^{(n)}$) of a particular channel ($CH^{(n)}$) of the plurality of channels performs counting operation in accordance with the first rate (stretch ratio α) similarly to the first counter (sample counter $C_s^{(CT)}$). The particular channel generates a waveform sample value based on retrieving, from the memory, a sample value of the original waveform based on a count value of the sample counter ($C_s^{(n)}$). The particular channel supplies a waveform sample value, generated thereby in correspondence with the second reference sample position (next pitch mark value) (i.e., sample value corresponding to an integer portion of a target value $t_v$ supplied to the control section CT by the decode circuit $DEC^{(n)}$), to the second channel (e.g., $CH^{(n+2)}$) as an initial waveform sample value corresponding to the initial value for the second channel. Then, the second channel uses the initial waveform sample value when decoding the sample value of the original waveform retrieved from the memory.

Further, the control section (CT) is configured to set a reproduction start time difference (dpm/β) between the first and second partial portions in accordance with information (pitch magnification β) for controlling a reproduction pitch. The control section (CT) includes a second counter (reproduction time counter $C_{RT}^{(CT)}$) that performs counting operation in accordance with a second rate (pitch ratio β) designated by the information for controlling a reproduction pitch. Once a count value of the second counter exceeds a predetermined target value while the first partial portion of the original waveform is being reproduced in the first channel, the control section instructs the second channel to start reproducing the second partial portion of the original waveform.

A basic value (dpm) of the reproduction start time difference (dpm/β) is determined on the basis of tone pitches of the first and second partial portions of the original waveform, and the reproduction start time difference (dpm/β) is set by increasing or decreasing the basic value (dpm) in accordance with the information (pitch magnification β) for controlling a reproduction pitch. Further, lengths of the first and second partial portions (segments or grains) of the original waveform are determined on the basis of the tone pitches of the first and second partial portions of the original waveform.

Further, the control section (CT) is configured to set the given rate (γ) for the sample counters ($C_s^{(n+1)}$ and $C_s^{(n+2)}$) of the first and second channels ($CH^{(n+1)}$ and $CH^{(n+2)}$ in accordance with information for controlling a formant.

The overlap adder (OLA) is configured to add waveform sample values of the first partial portion reproduced by the first channel ($CH^{(n+1)}$) and waveform sample values of the second partial portion reproduced by the second channel ($CH^{(n+2)}$) after amplitude-controlling the two waveform sample values with a cross-fade characteristic (window function).

The overlap adder (OLA) includes adders (OLA) provided in corresponding relation to the channels, and the adder of each of the channels is configured to add up a waveform sample value generated by the channel and an output signal of the adder (OLA) of another channel in accordance with control by the control section (CT).

Third Mode

Figure 18:
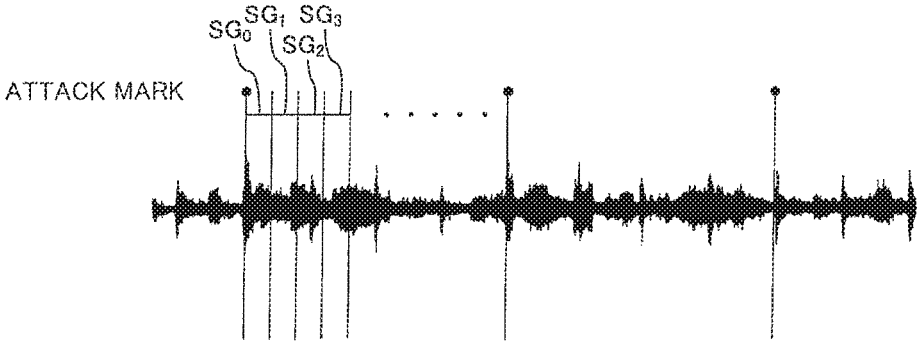
FIG. 18 is a conceptual diagram of attack marks and segments.

Next, a description will be given about operation of the electronic musical instrument DM when the operation mode is the third mode. In the third mode, it is not required to accurately detect a particular tone pitch from an original tone waveform as required in the above-described second embodiment, because the third mode permits mixed presence, in the original tone waveform, of waveforms of tones of a plurality of different pitches. Thus, original tone waveform data to be used in the third mode need not include pitch mark values as required in the second mode. Instead, in the third embodiment, an analyzation device separate from the electronic musical instrument DM detects in advance respective attack positions (tone generation start timings) of a plurality of tones constituting an original tone waveform and temporally deviated from each other, and waveform data is used in which the numbers of samples from the head of the original tone to the individual detected attack positions are calculated in advance (see FIG. 18). The attack mark values are prestored in the waveform memory WM. Because each compressed data corresponds to one sample value as noted above, each of the attack mark values corresponds to an offset address from the head address in the original tone waveform data (i.e., the number of addresses from the head address to the attack mark value).

Further, in the third mode, the formant control according to the formant magnification γ as performed in the second mode is not performed; namely, only the waveform time length stretch/compression control according to the stretch ration α and the pitch control according to the pitch magnification β is performed in the third mode. Further, in the third mode, the reproduction time counter $C_{RT}^{(CT)}$ of the control section CT used in the second mode is not used, and read address incrementing according to the pitch magnification β is effected using the sample counters $C_s^{(n+1)}$, $C_s^{(n+2)}$ and $C_s^{(n+3)}$ of the individual tone generating channels. Furthermore, in the third mode, where it is not required to accurately detect a particular tone pitch from the original tone waveform as noted above, a way of cutting out from the original waveform a segment forming the basis of generation of a grain is also different from that employed in the second mode. Namely, each segment forming the basis of generation of a grain in the third mode need not synchronize with a pitch of the original waveform as needed in the second mode.

Because operation of the CPU 12*a* in the third mode is the same as in the first embodiment, it will not be described here to avoid unnecessary duplication, and the following describe only the tone generating operation of the tone generator circuit 16, starting with an outline of the operation of the tone generator circuit 16 in the third mode. In the third mode, the sound input device 18 and the ring buffer RB are not used like in the second mode (see FIG. 11). Further, a reproduction tone is generated using a track TK comprising a set of the tone generating channels $CH^{(n)}$, $CH^{(n+1)}$, $CH^{(n+2)}$ and $CH^{(n+3)}$. Namely, the tone generating channels $CH^{(n+1)}$, $CH^{(n+2)}$ and $CH^{(n+3)}$ respectively generate grains. Like in the second mode, the three tone generating channels $CH^{(n+1)}$, $CH^{(n+2)}$ and $CH^{(n+3)}$ operate cyclically. Because individual grains are reproduced in a crossfading manner, two tone generating channels operate simultaneously in a crossfading time period. Further, the tone generating channel $CH^{(n)}$ generates one reproduction tone by adding up the grains generated by the tone generating channels $CH^{(n+1)}$, $CH^{(n+2)}$ and $CH^{(n+3)}$ (actually, any two of the tone generating channels $CH^{(n+1)}$, $CH^{(n+2)}$ and $CH^{(n+3)}$ and then supplies the thus-generated reproduction tone to the mixer section MX. Thus, in the third mode too, the filter circuits FLT $FLT^{(n+1)}$, $FLT^{(n+2)}$ and $FLT^{(n+3)}$ and the volume control circuits $VO^{(n+1)}$, $VOL^{(n+2)}$ and $VOL^{(n+3)}$ of the tone generating channels $CH^{(n+1)}$, $CH^{(n+2)}$ and $CH^{(n+3)}$ are not used. Further, if all of the tone generating channels are caused to operate in the third mode, 64 tones can be reproduced simultaneously.

Figure 19:
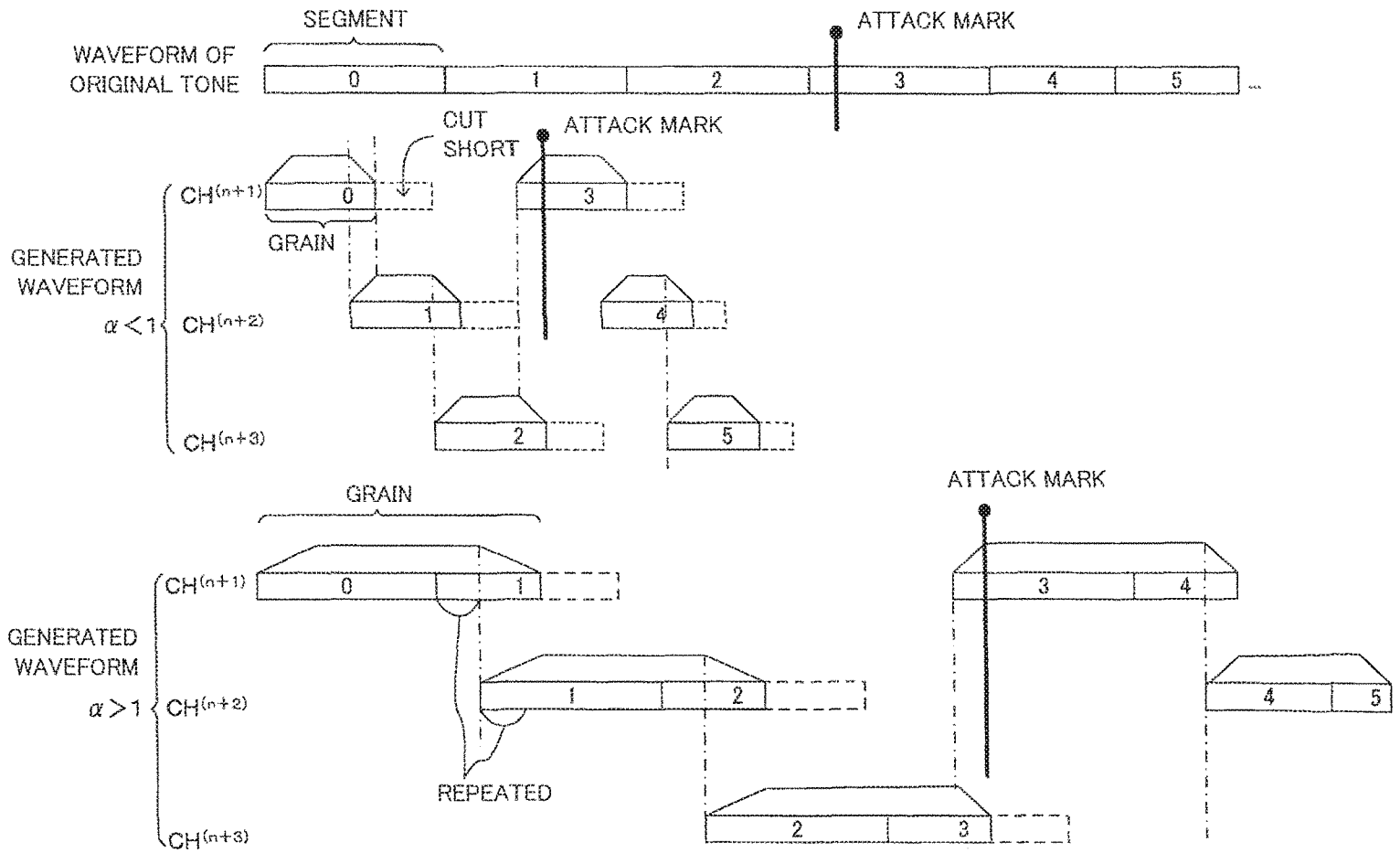
FIG. 19 is a conceptual diagram showing that different series of grains are reproduced in accordance with different values of a stretch ratio.

Each grain is formed in the following manner. In the third mode, first, a portion between two adjoining attack positions is divided into a plurality of segments $SG_i$ in accordance with predetermined criteria. As will be described in detail later, individual segments are cut out from the original tone waveform data in such a manner that each of the segments has a reference length designated by the CPU 12*a* or a length calculated on the basis of such a reference length. Further, a length of each grain is determined in accordance with the stretch ratio α and pitch ratio β. As shown in FIG. 19, for example, some grain may correspond to a range from the head to a middle portion of a segment. For example, in a case where the pitch ratio β is "1" and the stretch ratio α is smaller than "1", fadeout starts at a partway position of each segment, and thus, an end portion of each segment would be cut short. Further, as shown in FIG. 19, some grain may correspond to a range from the head to a middle portion of waveform data formed by connecting a plurality of adjoining segments. For example, in a case where the pitch ratio β is "1" and the stretch ratio α is greater than "1", the tone generating channel $CH^{(n)}$ starts reproducing a segment $SG_i$ and then starts fading out once it continues the reproduction up to a halfway position of a segment $_{i+1}$ across a segment boundary. Then, the tone generating channel $CH^{(n+1)}$ starts reproducing the segment $SG_{i+1}$ at the time point when the tone generating channel $CH^{(n)}$ starts the fading out. In this way, reproduction of a head portion of each segment is repeated. Note that a numerical value written in each rectangular block indicates an index No. $_i$ of the segment.

Further, like in the second mode, the tone generating channel $CH^{(n)}$ advances the read address in accordance with the stretch ratio α per sampling time period and restores sample values necessary to calculate a sample value corresponding to the read address. Then, in the sampling time period when the read address of the tone generating channel $CH^{(n)}$ has exceeded the boundary of a segment (i.e., when the count value $t_s^{(n)}$ has exceeded the target value $t_v$), the tone generating channel $CH^{(n)}$ stores the target value $t_v$ into the target value register $TR^{(CT)}$ but also stores a sample value corresponding to the boundary of the segment (the end address of the segment) into the sample buffer $SB^{(CT)}$ of the control section CT. The control section CT selects one of the tone generating channels which is currently out of operation, and then the control section CT supplies the selected tone generating channel with the two data stored in the sample buffer $SB^{(CT)}$ and in the target value register $TR^{(CT)}$ and thereby causes the selected tone generating channel to start reproducing a grain. Then, the target value $t_v$ is set at the boundary of the next segment.

Figure 20A:
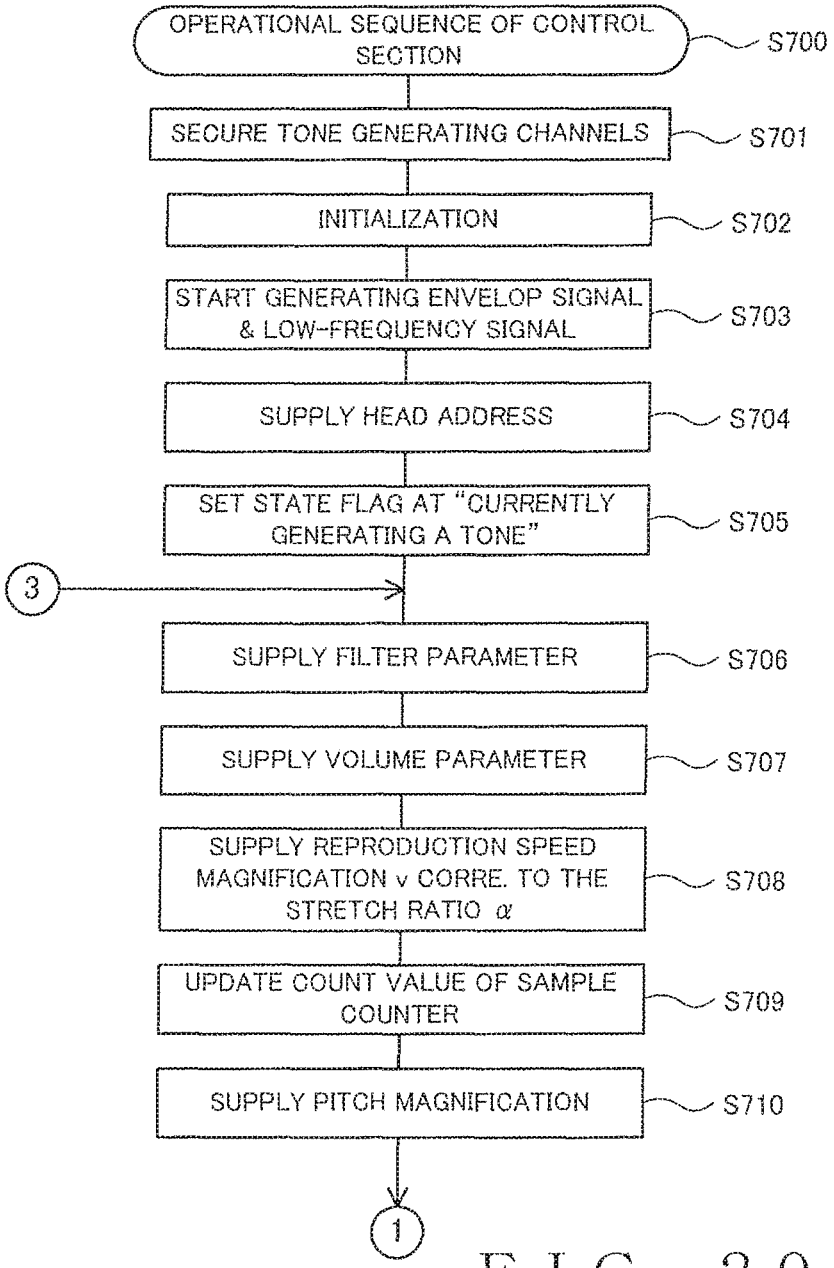
FIG. 20A is a diagram showing a former part of a control operational sequence of the control section in the third mode.
Figure 20B:
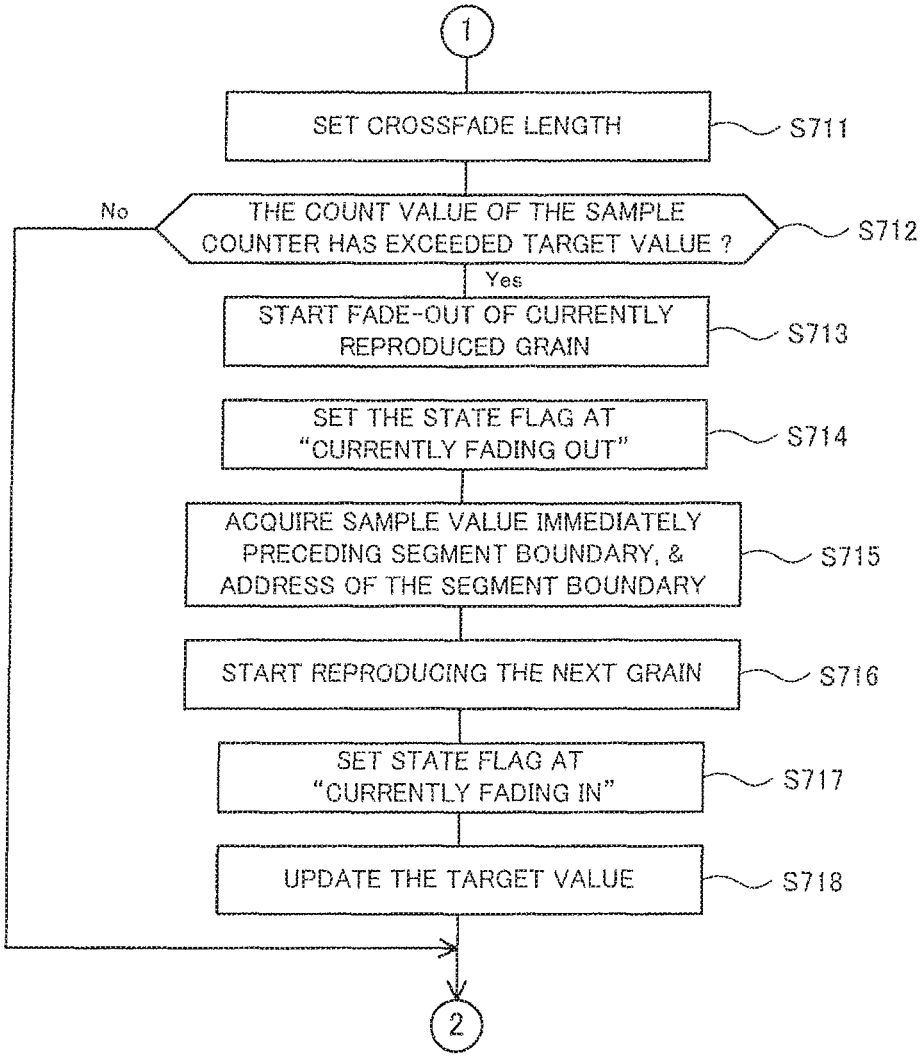
FIG. 20B is a diagram showing a middle part of the control operational sequence of the control section in the third mode.
Figure 20C:
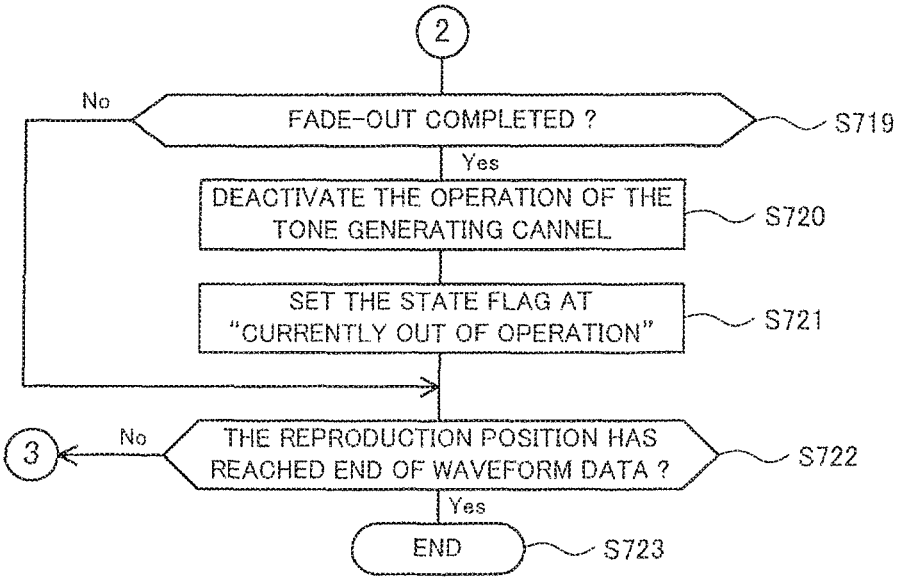
FIG. 20C is a diagram showing a rear part of the control operational sequence of the control section in the third mode.
Figure 23:
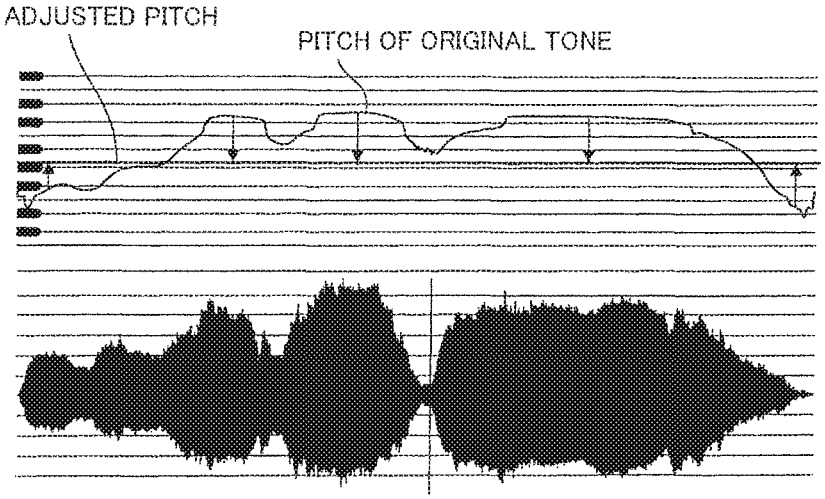
FIG. 23 is a conceptual diagram showing a concept of pitch adjustment.

The following explains in detail a control sequence of the control section CT in the third mode. In the third mode, upon receipt, from the CPU 12*a*, of performance operation information including tone generation start information (e.g., note-on information), the control section CT operates in accordance with the control sequence shown in FIGS. 20A, 20B and 23C. The control section CT starts its operation at step S700 and secures four tone generating channels at step S701. In the following description, the thus-secured tone generating channels are represented as "tone generating channels $CH^{(n)}$, $CH^{(n+1)}$, $CH^{(n+2)}$ and $CH^{(n+3)}$". Then, at step S702, the control section CT performs an initialization process at step S702. More specifically, the control section CT sets, at an initial value "0", the target value $t_v$ to be used for determining whether the read address has exceeded the segment boundary. Namely, a value "0" is written into the target value register $TR^{(CT)}$. Also, the control section CT reads the head sample value via the tone generating channel $CH^{(n)}$ and stores the thus-read head sample value into the sample buffer $SB^{(CT)}$. Furthermore, the control section CT sets the count value $t_s^{(CT)}$ of the sample counter $C_s^{(CT)}$ at "0". Furthermore, the control section CT sets the state flags $SF_{n+1}^{(CT)}$, $SF_{n+2}^{(CT)}$ and $SF_{n+3}^{(CT)}$ corresponding to the tone generating channels $CH^{(n+1)}$, $CH^{(n+2)}$ and $CH^{(n+3)}$ at "currently out of operation".

Then, at step S703, the control section CT activates the operation of the envelope generation circuit and the low-frequency oscillator so that the envelope generation circuit and the low-frequency oscillator generate an envelope signal and a low-frequency signal in accordance with parameters defining various envelope signals and parameters defining various low-frequency signals that are included in the input performance operation information and the setting information input before the input of the performance operation information (hereinafter referred to simply as "performance operation information" and "setting information").

Then, the control section CT supplies the head address to the tone generating channel $CH^{(n)}$ to cause the tone generating channel $CH^{(n)}$ to start its operation at step S704 and sets the state flag $SF_n^{(CT)}$ at "currently generating a tone" at step S705.

Then, at step S706, the control section CT generates a filter parameter and supplies the generated filter parameter to the filter circuit $FLT^{(n)}$, as in the first mode. At next step S707, the control section CT generates a volume parameter and supplies the thus-generated volume parameter to the volume control circuit $VOL^{(n)}$, as in the first mode. Note that, in the third mode too, the setting information is changeable even during tone generation. Further, the control section CT can change the envelope signal and the low-frequency signal in accordance with respective values indicated by the tone duration setting operator and the formant setting operator.

Next, at step S708, the control section CT calculates a stretch ratio $\alpha$ on the basis of the value indicated by the tone duration setting operator and then supplies a reproduction speed magnification v, which is an inverse number of the stretch ratio $\alpha$ (i.e., $v=1/\alpha$), to the tone generating channel $CH^{(n)}$. Then, at step S709, the control section CT updates the count value $t_s^{(CT)}$ of the sample counter $C_s^{(CT)}$. Namely, the control section CT adds the reproduction speed magnification v to the count value $t_s^{(CT)}$ of the sample counter $C_s^{(CT)}$. Note, however, that the reproduction speed magnification v is set at "0" in the first sampling time period. Also note that the count value $t_s^{(n)}$ of the sample counter $C_s^{(n)}$ and the count value $t_s^{(CT)}$ of the sample counter $C_s^{(CT)}$ are identical to each other in each of the sampling time periods. The count value $t_s^{(CT)}$ and the count value $t_s^{(n)}$ are "0" in the first sampling time period.

Then, at step S710, the control section CT supplies the pitch magnification $\beta$ (readout rate) to each of the tone generating channels $CH^{(n+1)}$, $CH^{(n+2)}$ and $CH^{(n+3)}$ which is currently generating a tone (currently fading in or fading out).

Then, at step S711, the control section CT updates a crossfade length xfl (in other words, a crossfade characteristic or a speed of transition) (see FIG. 4B). The crossfade length xfl is determined by adjusting the reference length, supplied from the CPU 12*a*, in accordance with a characteristic of the original tone, reproduction speed magnification v, pitch magnification $\beta$, etc.

Then, at step S712, the control section CT determines whether the count value $t_s^{(CT)}$ of the sample counter $C_s^{(CT)}$ has exceeded the target value $t_v$, i.e. whether the read address of the tone generating channel $CH^{(n)}$ has exceeded the boundary of the segment. If the count value $t_s^{(CT)}$ of the sample counter $C_s^{(CT)}$ has not yet exceeded the target value $t_v$, the control section CT makes a NO determination at step S712 and jumps to step S719. If the count value $t_s^{(CT)}$ of the sample counter $C_s^{(CT)}$ has exceeded the target value $t_v$, on the other hand, the control section CT makes a YES determination at step S712 and then goes to step S713, where the control section CT selects one of the tone generating channels which is currently reproducing a grain (i.e., whose state flag is "currently fading in") and causes the selected tone generating channel to fade out. At next step S714, the control section CT sets the state flag corresponding to the selected tone generating channel at "currently fading out".

Then, at step S715, the control section CT acquires, from the decide circuit $DEC^{(n)}$ of the tone generating channel $CH^{(n)}$, a sample value corresponding to an address calculated by adding the head address to a value of an integer portion of the target value $t_v$ (i.e., sample value immediately preceding the segment boundary) and the target value $t_v$ (i.e., address of the segment boundary). Then, at step S716, the control section CT selects, with reference to the state flags $SF_{n+1}^{(CT)}$, $SF_{n+2}^{(CT)}$ and $SF_{n+3}^{(CT)}$, any of the tone generating channels which is currently out of operation (i.e., whose state flag is at "currently out of operation"), and it supplies the determined crossfade xfl and the acquired sample value and target value $t_v$ to the selected tone generating channel to thereby cause the selected tone generating channel to start reproducing a grain. Then, at step S717, the control section CT sets, at "currently fading in", the state flag corresponding to the tone generating channel selected at step S716.

At next step S718, the control section CT updates the target value $t_v$. More specifically, the control section CT updates the target value $t_v$ by acquiring the reference length from the CPU 12*a* and adding the acquired reference length to the target value $t_v$. In this manner, a length of the next segment is determined. Note, however, that, if an offset address from the current read address to the next attack position (i.e., attack position immediately following the current read address in the time-axial direction) is smaller than a predetermined threshold value (e.g., 16 times of the reference length), the target value $t_v$ may be updated as follows. Namely, the next target value $t_v$ is set such that a length of each segment formed by dividing a portion from the current target value $t_v$ to the next attack mark becomes an integer value closest to the reference value. Stated differently, it is possible to prevent differences in length between adjoining segments from varying greatly. Further, arrangements may be made for preventing a crossfade portion from overlapping an attack position (see Japanese Patent Application Laid-open Publication No. 2002-006899). Further, boundaries of segments may be set in such a manner that any attack position is not cut or repeated. For example, an attack mark and the boundary of a segment may be intentionally deviated from each other as shown in FIG. 19.

Then, at step S719, the control section CT determines, with reference to the count values of the phase counters $C_P^{(n+1)}$, $C_P^{(n+2)}$ and $C_P^{(n+3)}$, whether there is any tone generating channel having completed fading out. If there is no tone generating channel having completed fading out, the control section CT makes a "NO" determination at step S719 and proceeds to step S722. If there is any tone generating channel having completed fading out, on the other hand, the control section CT makes a "YES" determination at step S719 and proceeds to step S720 to deactivate the operation of the tone generating channel having completed fading out and set, at next step S721, the state flag corresponding to that tone generating channel at "currently out of operation".

Then, at step S722, the control section CT determines whether the read address of the tone generating channel $CH^{(n)}$ has reached the end of the original tone waveform data (the end of the last segment of the original tone waveform). If the read address of the tone generating channel $CH^{(n)}$ has reached the end of the original tone waveform data, the control section CT goes to next step S723, where the tone generating channel $CH^{(n)}$ deactivates the operation of the tone generating channel $CH^{(n)}$ and sets the state flag $SF_n^{(CT)}$ corresponding to that tone generating channel at "currently out of operation". Further, the control section CT monitors the respective read addresses of the tone generating channels $CH^{(n+1)}$, $CH^{(N+2)}$ and $CH^{(n+3)}$ and deactivates the operation of each of the tone generating channels $CH^{(N+1)}$, $CH^{n+2)}$ and $CH^{(n+3)}$ where the read address has reached the end address of the segment forming the basis of a grain currently being generated (i.e., the last segment), but also sets the state flag corresponding to that tone generating channel at "currently out of operation". When the read addresses of all of the tone generating channels $CH^{(n+1)}$, $CH^{(n+2)}$ and $CH^{(n+3)}$ have reached the last addresses of the respective last segments, the control section CT terminates the control on the track TK. If a NO determination has been made at step S722, the control section CT returns to step S706 of FIG. 20A in the next sampling time period so that the operations of steps S706 to S722 are performed again.

A control sequence of the tone generating channel $CH^{(n)}$ is similar to that in the second mode. Note, however, that, once the read address exceeds the segment boundary, the tone generating channel $CH^{(n)}$ supplies the control section CT with a sample value immediately preceding the segment boundary and an address of the segment boundary.

The following describe a control sequence of the tone generating channel $CH^{(n+1)}$. Operation of the tone generating channels $CH^{(n+2)}$ and $H^{(n+3)}$ is similar to that of the tone generating channel $CH^{(n+1)}$ and thus will not be described here to avoid unnecessary duplication.

Figure 21:
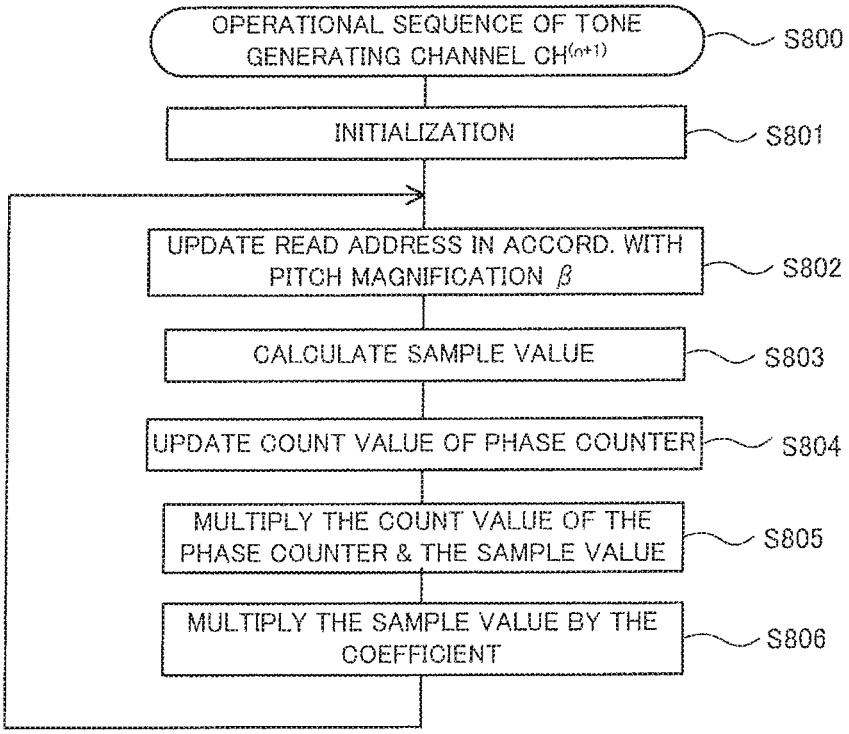
FIG. 21 is a diagram showing an operational sequence of a head tone generating channel of a plurality of tone generating channels constituting a track in the third mode.

Once the tone generating channel $CH^{(n+1)}$ is instructed by the control section CT to start its operation, the tone generating channel $CH^{(n+1)}$ starts operating in accordance with the control sequence as shown in FIG. 21, at step S800. Then, at step S801, the read circuit $DRD^{(n+1)}$ performs an initialization process that is similar to the initialization process performed in the first mode. In the initialization process performed in this case, however, the read circuit $DRD^{(n+1)}$ and the decode circuit $DEC^{(n+1)}$ calculate a sample value at the head (boundary) of a segment to be used for generating a grain. First, the read circuit $DRD^{(n+1)}$ reads an address of the segment boundary and a sample value immediately preceding the segment boundary supplied from the control section CT and supplies the thus-read address and sample value to the decode circuit $DEC^{(n+1)}$. Then, the read circuit $DRD^{(n+1)}$ reads out, from the waveform memory WM via the cache circuit CM, compressed data of an address corresponding to a value calculated by adding "1" to a value of the integer portion of the address of the segment boundary and then supplies the read-out waveform data to the decode circuit $DEC^{(n+1)}$. Then, the decode circuit $DEC^{(n+1)}$ calculates a sample value corresponding to the segment boundary through the linear interpolation operations using the data input from the read circuit $DRD^{(n+1)}$. The thus-calculated sample value corresponds to the head sample value of the segment used for generating the grain of which reproduction is to be started. Further, in the initialization process, the multiplication circuit $MUL^{(n+1)}$ of the overlap-add circuit $OLA^{(n+1)}$ resets the count value $t_P^{(n+1)}$ of the phase counter $C_P^{(n+1)}$.

Then, at step S802, the read circuit $DRD^{(n+1)}$ calculates a read address by adding the pitch magnification β (readout rate) to the count value $t_s^{(n+1)}$ of the sample counter $C_s^{(n+1)}$ and further adding the result of such addition to the address of the segment boundary input from the control section CT.

At next step S803, the read circuit $DRD^{(n+1)}$ and the decode circuit $DEC^{(n+1)}$ cooperate to obtain or restore a sample value corresponding to the calculated read address through linear interpolation operations as performed in the first mode. The decode circuit $DEC^{(n+1)}$ supplies the thus-restored sample value to the multiplication circuit $MUL^{(n+1)}$ of the overlap-add circuit $OLA^{(n+1)}$.

Then, at next step S804, the multiplication circuit $MUL^{(n+1)}$ updates the count value $t_P^{(n+1)}$ of the phase counter $C_P^{(n+10}$. Namely, when the state flag $SF_{n+1}^{(CT)}$ is set at "currently fading in", the multiplication circuit $MUL^{(n+1)}$ adds an inverse number of the crossfade length xf1 to the count value $t_P^{(n+1)}$ of the phase counter $C_P^{(n+1)}$. Note, however, that the upper limit of the count value $t_P^{(n+1)}$ is "1". When the state flag $SF_{n+1}^{(CT)}$ is set at "currently fading out", on the other hand, the multiplication circuit $MUL^{(n+1)}$ subtracts the inverse number of the crossfade length xfl from the count value $t_P^{(n+1)}$ of the phase counter $C_P^{(n+1)}$. Then, at next step S805, the multiplication circuit $MUL^{(n+1)}$ multiplies the sample value input from the overlap-add circuit $OLA^{(n+1)}$ by the count value $t_P^{(n+1)}$ and supplies the result of such multiplication to the adder circuit $ADD^{(n+1)}$. Then, at step S806, the multiplication circuit $MUL^{(n+1)}$ of the overlap-add circuit $OLA^{(n+1)}$ supplies the multiplication result to the multiplication circuit $MUL^{(n)}$ of the overlap-add circuit $OLA^{(n)}$.

In each of the second and subsequent sampling time periods, the tone generating channel $CH^{(n+1)}$ performs the aforementioned operations of steps S802 to S805. Note that, because the upper limit of the count value $t_P^{(n+1)}$ is "1", the window function has a trapezoidal shape as shown in FIG. 4B.

Summarizing the foregoing description about the third mode, the control section (CT) is configured to set the given rate β) for the sample counters (e.g., $C_s^{(n+1)}$ and $C_s^{(n+2)}$) of the first and second channels (e.g., $CH^{(n+1)}$ and $CH^{(n+2)}$) in accordance with information (pitch magnification β) for controlling a reproduction pitch.

Fourth Mode

Figure 22:
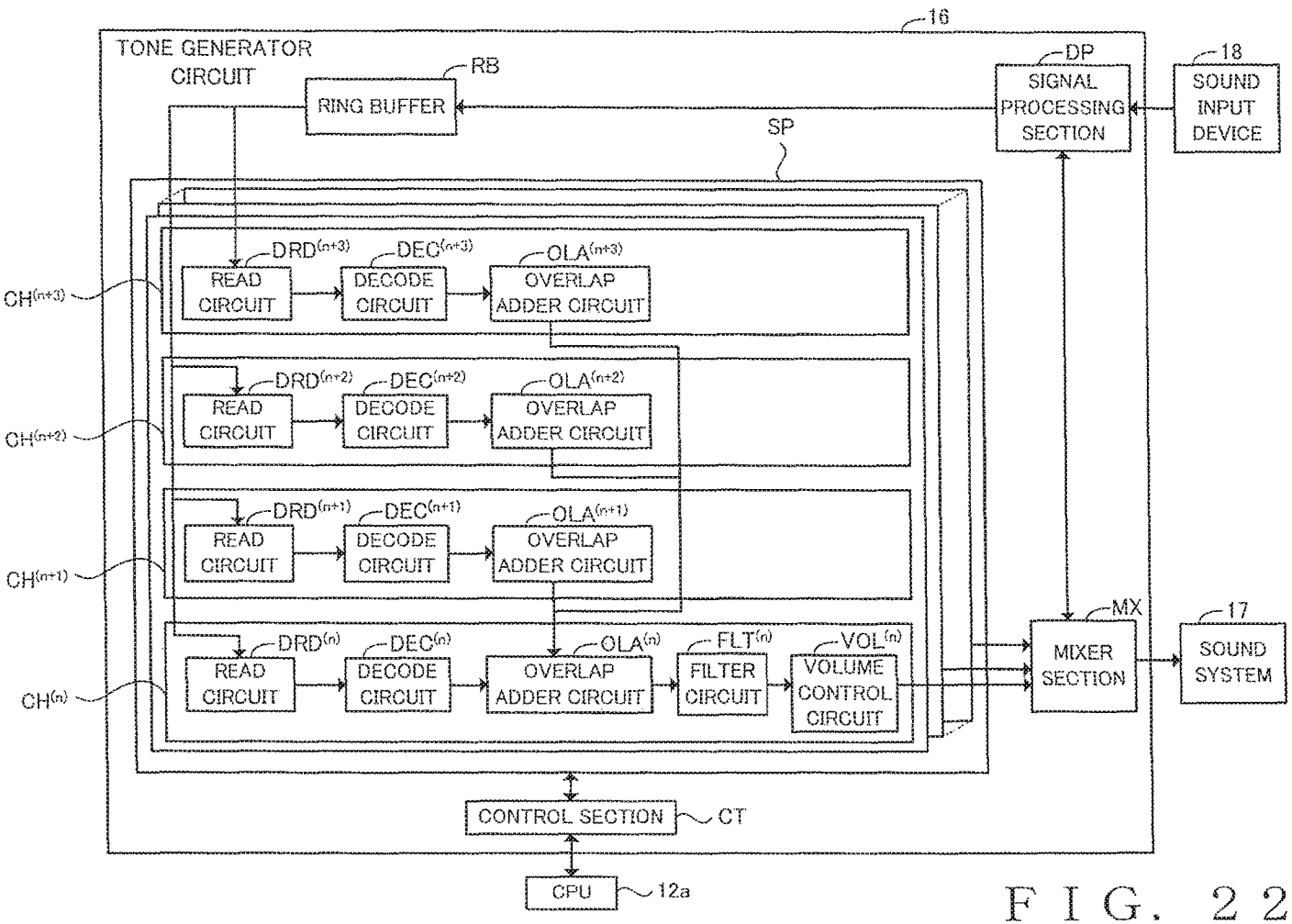
FIG. 22 is a block diagram showing a setup of the tone generator circuit in a fourth mode.

Next, a description will be given about operation of the electronic musical instrument DM when the operation mode is the fourth mode. In the fourth mode, the waveform memory WM and the cache circuit CM are not used as seen in FIG. 22. The signal processing section DP supplies waveform data, sequentially supplied from the sound input device 18, to the ring buffer RB. The signal processing section DP detects in realtime a pitch of sound represented by the waveform data, sequentially supplied from the sound input device 18, and supplies the detected pitch to the CPU 12*a*. On the basis of the pitch data supplied from (i.e., detected in realtime by) the signal processing section DP, the CPU 12*a* calculates pitch mark values as in the second mode. Namely, each of the pitch mark values represents an address which is associated with the storage region of the ring buffer RB where are stored individual sample values constituting the waveform data, and which is indicative of a joint between fundamental pitch portions in the sound (original tone waveform) input in realtime. Such pitch mark values are supplied to the control section CT. The track TK generates a tone using the waveform data stored in the ring buffer RB and the pitch mark values supplied from the control section CT, as in the second mode. More specifically, the track TK generates a tone (harmony) by changing a pitch and/or formant of sound input to the sound input device 18. In this case, unlike in the second mode, the data stored in the ring buffer RB are sample values themselves rather than compressed data. Therefore, unlike in the second mode, there is no need to restore sample values using the compressed data. Thus, the tone generating channel $CH^{(n)}$ constituting the track TK may be used as a tone generating channel for reproducing a grain in a similar manner to the tone generating channels $CH^{(n+1)}$, $CH^{(n+2)}$ and $CH^{(n+3)}$. In this case, once the count value $t_s^{(CT)}$ of the sample counter $C_s^{(CT)}$ of the control section CT has exceeded a pitch mark value, the control section CT may store that pitch mark value. Then, when one tone generating channel selected from among the tone generating channels $CH^{(n)}$, $CH^{(n+1)}$, $CH^{(n+2)}$ and $CH^{(n+3)}$ is about to start reproducing a grain, the control section CT may supply the stored pitch to the selected tone generating channel When the selected tone generating channel is about to start reproducing a grain, the selected tone generating channel reads out a sample value stored at an address corresponding to an integer portion of the pitch mark value supplied from the control section and a sample value stored at an address corresponding to a value calculated by adding "1" to the value of the integer portion. Then, the tone generating channel may only have to obtain a sample value corresponding to the pitch mark value through linear interpolation operations using the two read-out sample values and a fractional portion of the pitch mark value. Note that, although time stretch operation can be executed using the waveform data of a short time period stored in the ring buffer RB in the fourth mode, this approach has no effective use. Thus, in the fourth mode, the stretch ratio α is semi-fixedly set at "1".

Therefore, in the fourth mode, no waveform-time-length control according to the stretch ratio α is performed although the pitch control according to the pitch magnification β and using the reproduction time counter $C_{RT}^{(CT)}$ of the control section CT and the formant control according to the formant magnification γ in each of the tone generating channels is performed.

Now summarizing the foregoing description about the fourth mode, the memory is a temporary-storage type memory (ring buffer RB), and realtime input waveform data of the original waveform is temporarily stored.

In the second to fourth modes of the electronic musical instrument DM constructed in the aforementioned manner, the tone generating channels $CH^{(n+1)}$, $CH^{(n+2)}$ and $CH^{(n+3)}$ sequentially reproduce partial portions of an original tone, during which time count values of various counters provided in the tone generator circuit 16 increase/decrease in accordance with the stretch ratio α, pitch magnification β and formant magnification γ. Then, the portions (segments) to be reproduced by the tone generating channels $CH^{(n+1)}$, $CH^{(n+2)}$ and $CH^{(n+3)}$, reproduction start timings of the portions (segments), readout rates of sample values constituting the portions, etc. are determined in accordance with the count values of the various counters. Because the CPU 12*a* only has to supply the tone generator circuit 16 with settings related to the stretch ratio α, pitch magnification β and formant magnification γ (i.e., note No. NN and values indicated or instructed by the duration setting operator, pitch setting operator and formant setting operator), loads on the CPU 12*a* can be kept small. Further, the necessary circuit construction merely comprises the overlap-add circuit $OLA^{(n)}$ added to the tone generating channels of the conventional tone generator circuit, and thus, it is not necessary to add large-scale circuitry for implementing the time stretch function, pitch function and formant shift function. Namely, according to the above-described embodiment of the invention, it is possible to provide the tone generator circuit 16 which has the time stretch function, pitch function and formant shift function and yet is simple in construction. Further, because one sample value is output per sampling time period, there would occur no problem of a delay as presented by the above-discussed conventionally-known audio signal generation apparatus. Further, according to the above-described embodiment of the invention, a plurality of operation modes can be simultaneously used, and thus, the 256 tone generating channels can be used efficiently. Further, in the above-described embodiment, the overlap-add circuit OLA is provided at a stage preceding the filter circuit $FLT^{(n)}$ and the volume control circuit $VOL^{(n)}$. Namely, the addition circuit $ADD^{(n)}$ of the tone generating channel $CH^{(n)}$ constituting the track TK adds up sample values generated by the other tone generating channels $CH^{(n+1)}$, $CH^{(n+2)}$ and $CH^{(n+3)}$, and the result of such addition (i.e., sum) is supplied to the filter circuit $FLT^{(n)}$ and the volume control circuit $VOL^{(n)}$. Thus, the filter circuit $FLT^{(n)}$ and the volume control circuit $VOL^{(n)}$ can be used efficiently.

Further, when generation of a tone is to be started, one or more tone generating channels are secured in accordance with an operation mode allocated to waveform data of an original tone. Namely, where the operation mode allocated to the waveform data of the original tone is the first mode, one tone generating channel is secured. Where the operation mode allocated to the waveform data of the original tone is the second or third mode, four tone generating channels are secured. Where the operation mode allocated to the waveform data of the original tone is the fourth mode too, four tone generating channels are secured. In the aforementioned manner, different operation modes can be allocated to each of the tone generating tones, and thus, the tone generating channels can be used efficiently.

Further, the pitch marks and the attack marks are calculated and stored in the waveform memory WM in advance. Thus, it is possible to reduce loads on the CPU 12*a*, control section CT, signal processing section DP, etc. as compared to the case where the CPU 12*a*, control section CT, signal processing section DP, etc. analyze a pitch of an original tone while reading out compressed data.

Further, in the second to fourth modes, formant frequencies are varied over time by use of resources (e.g., the envelope generation circuit and the low-frequency oscillator) that are actually not used for their original purposes, as noted above. Therefore, there is no need to separately provide an envelope generation circuit and a low-frequency oscillator for varying the formant frequencies.

Further, it should be appreciated that the present invention is not limited to the above-described embodiment and may be modified variously without departing from the purpose of the present invention.

For example, whereas a pitch of a reproduction tone is determined by the control section CT in the above-described embodiment, the present invention is not so limited, and a pitch of a reproduction tone may be determined by the CPU 12*a* of the computer section 12. Further, in the second to fourth modes, whether the reproduction should be terminated or not may be determined by making a determination as to whether an address calculated by adding the count value $t_s^{(CT)}$ of the sample counter $C_s^{(CT)}$ to the head address matches the end address.

For example, in the first to third modes, arrangements may be made such that a partial portion of an original tone is reproduced in a looped fashion (i.e., loop-reproduced). In such a case, a loop start position (address) and a loop end position (address) may be set, and, when the decode circuit $DEC^{(n)}$ of the tone generating channel $CH^{(n)}$ has first calculated a sample value corresponding to the loop start position, the control section CT may store the calculated sample value, so that the control section CT can use the stored sample value when reproduction is to be restarted returning from the loop end position back to the loop start position. Furthermore, in such a case, a determination may be made, using a level of a volume-related envelope, as to whether a reproduction position has reached the end of waveform data.

Further, the tone generating channels $CN^{(n+1)}$, $CH^{(n+2)}$ and $CH^{(n+3)}$ are arranged to reproduce grains in the second and third modes of the above-described embodiment. Alternatively, in the case where sample values themselves rather than compressed data are stored in the waveform memory WM, the tone generating channel $CH^{(n)}$ too can be used as a grain-reproducing tone generating channel as in the fourth mode.

In the second to fourth modes of the above-described embodiment, one track comprises four tone generating channels. Alternatively, one track may comprise at least two tone generating channels; for example, one track may comprise as many as eight tone generating channels. As the number of tone generating channels constituting one track increases, an upper limit of the pitch magnification may be raised, and a lower limit of the formant magnification may be lowered.

Furthermore, in the above-described embodiment, the compressed data is representative of a difference between a sample value in the last sampling time period and a sample value in the current sampling time period. However, the sample value compression method for use in the present invention is not limited to that employed in the above-described embodiment; for example, a sample value compression method using the linear prediction may be employed in the present invention.

Furthermore, the window function applied to segments in the second to fourth modes is not limited to the shape employed in the above-described embodiment. For example, a table having stored therein coefficients corresponding to count values $t_P^{(n)}$ may be used so that the window function can be set at a desired shape.

Further, the CPU 12*a* of the computer section 12 may calculate a ratio between a pitch corresponding to a note No. NN and a pitch of an original tone and supply the calculated ratio so that the control section CT can determine a pitch magnification of a reproduction tone in accordance with the supplied ratio with a pitch-varying envelope signal, low-frequency signal, etc. taken into account.

Moreover, pitch marks and attack marks may be prestored in the ROM 12*b* of the computer section 12 so that the CPU 12*a* can read out such pitch marks and attack marks from the ROM 12*b* and supply the read-out pitch marks and attack marks to the control section CT. Further, instead of calculating and storing pitch marks and attack marks in advance, the CPU 12*a*, control section CT, signal processing section DT, etc. may analyze a pitch while reading waveform data.

Furthermore, whereas the embodiment has been described above in relation to the case where the envelope generation circuit and the low-frequency oscillator actually not used for their original purposes are applied in the second to fourth modes, any other resources that are actually not used may be applied to desired purposes. For example, the filter circuits FLT $FLT^{(n+1)}$, $FLT^{(n+2)}$ and $FLT^{(n+3)}$ of the tone generating channels $CH^{(n+1)}$, $CH^{(n+2)}$ and $CH^{(n+3)}$ are not used in the second to fourth modes of the above-described embodiment. Thus, these filter circuits FLT $FLT^{(n+1)}$, $FLT^{(n+2)}$ and $FLT^{(n+3)}$ may be connected to the tone generating channel $CH^{(n)}$ to form a multistage circuit so that frequency characteristics of a reproduction tone can be controlled via the multistage circuit.

Furthermore, whereas the control section CT has been described as calculating a pitch magnification β on the basis of a pitch-related parameter, control signal, etc. in the second mode of the above-described embodiment, a modification may be made for achieving a more musically interesting acoustic effect by performing various arithmetic operations to calculate a pitch magnification β. For example, a pitch of a tone to be reproduced by one track TK may be adjusted into a pitch (or cyclic period) input from the CPU 12*a*. Namely, in the track TK, the pitch magnification β may be varied from moment to moment, by use of a ratio between the pitch (or cyclic period) input from the CPU 12*a* and the difference value dpm, in such a manner as to offset a pitch of an original tone varying over time. Alternatively, the difference value dpm may be calculated on the basis of the pitch (or cyclic period) input from the CPU 12*a*, and the thus-calculated difference value dpm may be used in the comparison operation at step S415. In this way, it is possible to obtain a tone flattened (i.e., having no pitch variation) by being adjusted into the pitch input from the CPU 12*a*, while still maintaining variation over time of a tone color and volume of an original tone allocated to the track TK. For example, a more musically interesting acoustic effect can be achieved by adjusting, in accordance with a key depressed by a user or human operator, a pitch of an original tone into a pitch corresponding to the depressed key and then reproducing the thus-adjusted pitch.

Further, a pitch of a tone to be reproduced by one track $TK^{(m)}$ may be adjusted into a pitch of another track $TK^{(m+1)}$.

Namely, a pitch magnification β may be varied in accordance with difference values dpm sequentially obtained in the track $TK^{(m+1)}$. Further, pitch magnification β in the track $TK^{(m)}$ may be varied in accordance with difference values dpm sequentially obtained in the track $TK^{(m+1)}$. Further, such a difference value dpm may be used in the comparison operation at step S415. In this way, it is possible to achieve a more musically interesting acoustic effect by generating a tone following a pitch of an original tone allocated to the track $TK^{(m+1)}$ and/or generating a harmony tone in predetermined frequency relationship to a pitch of the original tone allocated to the track $TK^{(m+1)}$ while still maintaining variation over time of a tone color and volume of the original tone allocated to the track $TK^{(m)}$.

Figure 24:
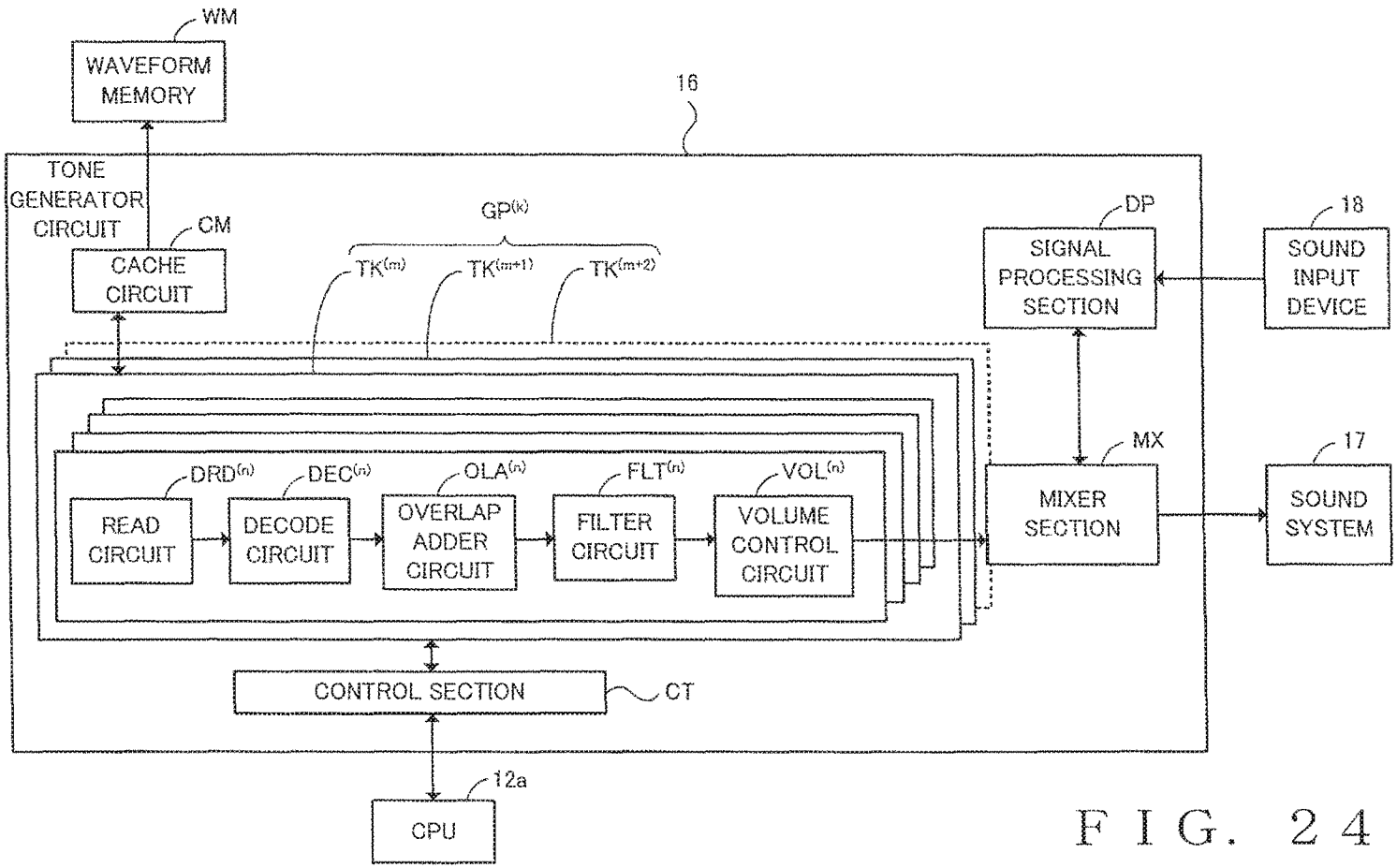
FIG. 24 is a block diagram showing a construction of the tone generator circuit when a plurality of tracks are synchronized with one another.

Furthermore, performances (phrases) of individual parts executed for a same portion (e.g., from the head of the third measure to the end of the fourth measure of each of the parts) of a score of a music piece may be sampled to generate waveform data, and then the individual waveform data may be allocated to a set of tracks $TK^{(m)}$, $TK^{(m+1)}$, . . . . Such a set of tracks $TK^{(m)}$, $TK^{(m+1)}$, . . . will hereinafter be referred to as a "group $GP^{(k)}$" (see FIG. 24). In this case, one may demand that the phrases to be reproduced in the individual tracks $TK^{(m)}$, $TK^{(m+1)}$, . . . be synchronized with one another (i.e., that beat points be synchronized among the tracks $TK^{(m)}$, $TK^{(m+1)}$, . . . ) However, although the individual waveform data represent performances of a same position of the score of the music piece, it is likely that respective performance tempos of the waveform data differ from one other, i.e. that respective lengths of the waveform data differ from one other. In such a case, for synchronization among the phrases to be reproduced, the time stretch function may be used to make uniform (uniformize) the performance tempos (phrase lengths) of the individual tracks. However, this approach would present the following problems.

First, when starting reproduction of the phrases allocated to the individual tracks $TK^{(m)}$, $TK^{(m+1)}$, . . . , the tracks $TK^{(m)}$, $TK^{(m+1)}$ calculate stretch ratios α such that respective lengths of the phrases can be uniformized. The stretch ratio α normally includes a fractional portion, but the number of settable digits of the fractional portion is, in effect, finite. Therefore, it is difficult to completely uniformize the lengths of the phrases. Thus, even if the individual phrases are synchronized with one another at the start of the reproduction, deviation in beat point among the phrases would undesirably become greater.

Further, there may arise a demand to change a tempo of any of the phrases while maintaining synchronization among the phrases. For example, a user may want to change a tempo in synchronism with a clock of a MIDI sequencer, or a user may operate the duration setting operator in realtime in order to cause the tempo to follow a value indicated by the operated duration setting operator. In such a case, it is necessary for the CPU 12*a* to calculate stretch ratios α of the individual tracks $TK^{(m)}$, $TK^{(m+1)}$, . . . by detecting the clock, the indicated values, etc. and then write the individual values into a register of the control section CT. However, it is not possible to simultaneously perform operations for writing the stretch ratios α of the individual tracks $TK^{(m)}$, $TK^{(m+1)}$, . . . into the register. Namely, there would occur deviation in write timing among the respective stretch ratios α. Thus, there would occur deviation in beat point among the phrases due to the a deviation in write timing among the respective stretch ratios α.

If the phrases allocated to the tracks $TK^{(m)}$, $TK^{(m+1)}$, . . . are short in length, there may arise a demand to loop-reproduce partial or entire portions of the phrases while still maintaining synchronization among the phrases. However, because the time stretch function, the pitch shift function and the formant shift function are implemented by use of the pitch marks or the attack marks, a loop start position and a loop end position cannot be set as desired. Namely, the loop start position and the loop end position must each be set at a position where a pitch mark or an attack mark is written. Therefore, it is difficult to not only cause the respective loop start positions of the tracks $TK^{(m)}$, $TK^{(m+1)}$, . . . to completely match one another but also cause the respective loop end positions of the tracks $TK^{(m)}$, $TK^{(m+1)}$, . . . to completely match one another. Further, it is difficult for the CPU 12*a* to detect and correct deviations in the loop start position and loop end position among the tracks $TK^{(m)}$, $TK^{(m+1)}$, . . . .

To avoid the above inconvenience, the following arrangements may be employed. First, a master sample counter $C_{ms}^{(CT)}$ is used for managing a tempo of the group $GP^{(k)}$. Such a master sample counter $C_{ms}^{(CT)}$ is provided within the control section CT. A count value $t_{ms}^{(CT)}$ of the master sample counter $C_{ms}^{(CT)}$ is updated per sampling time period by a master tempo magnification θ being added to the count value $t_{ms}^{(CT)}$. The master tempo magnification θ is a ratio, to a predetermined reference tempo (e.g., 60 bpm), of a tempo of the phrases to be reproduced in synchronism with one another (such a tempo will hereinafter be referred to as a "reproduction tempo"). For example, when the reproduction tempo is 120 bpm, the master tempo magnification θ is "2".

Operation of the individual tracks $TK^{(m)}$, $TK^{(m+1)}$, . . . is substantially similar to the operation described in relation to the second mode, but the sample counter $C_s^{(CT)}$ employed in the second mode is provided separately for each of the tracks. In the following description, such sample counters provided for the individual tracks $TK^{(m)}$, $TK^{(m+1)}$, . . . will be referred to as sample counters "$C_m^{(CT)}$, $C_{m+1}^{(CT)}$, . . . ". Phrases of known tempos are allocated to the tracks $TK^{(m)}$, $TK^{(m+1)}$, . . . , and slave tempo magnifications $\varphi_m$, $\varphi_{m+1}$, . . . indicative of ratios of tempos of the phrases to the master reference tempo are set. The slave tempo magnifications $\varphi_m$, $\varphi_{m+1}$, . . . are added to the count values $t_m^{(CT)}$, $t_{m+1}^{(CT)}$, . . . of the sample counters $C_m^{(CT)}$, $C_{m+1}^{(CT)}$, respectively, per sampling time period.

For example, whereas the reference tempo is 60 bpm, the phrase of a 120 bpm tempo is allocated to the track $TK^{(m)}$, and the phrase of a 30 bpm tempo is allocated to the track $TK^{(m+1)}$. In such a case, "0.5" is set as the slave tempo magnification $\varphi_m$ for the track $TK^{(m)}$, and "2.0" is set as the slave tempo magnification $\varphi_{m+1}$ for the track $TK^{(m+1)}$.

If it is assumed that the master sample counter performs counting at a 60 bpm tempo identical to the reference tempo, the master tempo magnification θ is "1.0". Namely, the count value $t_{ms}^{(CT)}$ of the sample counter $C_m^{(CT)}$ is updated per sampling time period by being incremented by "1.0" per sampling time period. Because the slave tempo magnification $\varphi_m$ for the track $TK^{(m)}$ is set at "0.5", the sample counter $C_m^{(CT)}$ of the track $TK^{(m)}$ is updated per sampling time period by being incremented by "0.5" calculated by multiplying the master tempo magnification θ of "1.0" and the slave tempo magnification $\varphi_m$ of "0.5". Further, because the slave tempo magnification $\varphi_{m+1}$ for the track $TK^{(m+1)}$ is set at "2.0", the sample counter $C_{m+1}^{(CT+1)}$ of the track $TK^{(m+1)}$ is updated per sampling time period by being incremented by "2.0" calculated by multiplying the master tempo magnification θ of "1.0" and the slave tempo magnification $\varphi_m$ of "2.0".

If it is assumed that the master sample counter performs counting at a 30 bpm tempo that is 0.5 times the reference tempo, the master tempo magnification θ is "0.5". Namely, the count value $t_m^{(CT)}$ of the sample counter $C_m^{(CT)}$ is updated per sampling time period by being incremented by "0.5" per sampling time period. Because the slave tempo magnification $\varphi_m$ for the track $TK^{(m)}$ is set at "0.5", the sample counter $C_m^{(CT)}$ of the track $TK^{(m)}$ is updated per sampling time period by being incremented by "0.25" calculated by multiplying the master tempo magnification θ of "0.5" and the slave tempo magnification $\varphi_m$ of "0.5". Further, because the slave tempo magnification $\varphi_{m+1}$ for the track $TK^{(m+1)}$ is set at "2.0", the sample counter $C_{m+1}^{(CT+1)}$ of the track $TK^{(m+1)}$ is updated per sampling time period by being incremented by "1.0" calculated by multiplying the master tempo magnification θ of "0.5" and the slave tempo magnification $\varphi_m$ of "2.0".

Namely, ratios of the count values $t_m^{(CT)}$, $t_{m+1}^{(CT)}$, . . . of the sample counters $C_m^{(CT)}$, $C_{m+1}^{(CT)}$, . . . to the count value $t_m$ of the master sample counters $C_m^{(CT)}$ are the slave tempo magnifications $\varphi_m$, $\varphi_{m+1}$, . . . that are kept constant. Further, such relationship is maintained even when the master tempo magnification θ changes during the course of reproduction.

Figure 25:
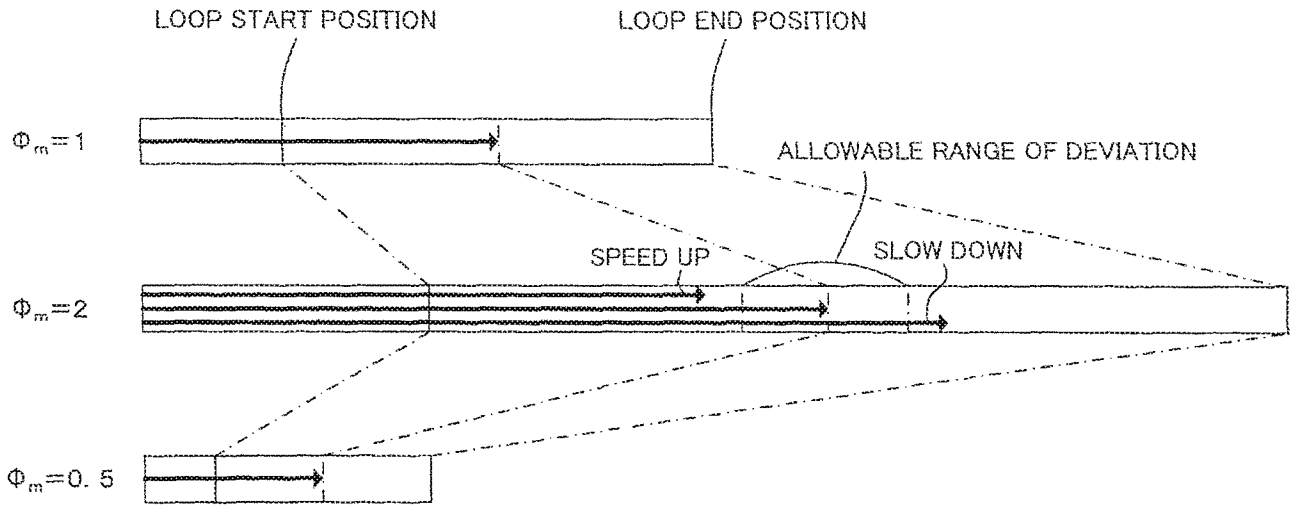
FIG. 25 is a conceptual diagram showing reproduction positions of the tracks.

If the ratio between the count value $t_{ms}^{(CT)}$ of the master sample counter $C_m^{(CT)}$ and any one of the count values $t_m^{(CT)}$, $t_{m+1}^{(CT)}$, . . . of the sample counters $C_m^{(CT)}$, $C_{m+1}^{(CT)}$, . . . has deviated from an ideal value due to some factor (e.g., due to the fact that the number of settable digits of the fractional portion is finite, or due to the fact that positions where the loop start position and the loop end position can be set are limited), the tempo of the track is corrected in the following manner in such a manner that such a deviation can fall within a predetermined allowable range. The CPU 12*a* monitors for such a deviation per sampling time period. Let it be assumed here that the count value $t_{ms}^{(CT))}$ and the count value $t_m^{(CT)}$ have deviated from an ideal value and that the deviation is outside the predetermined allowable range. In this case, the control section CT adds, to the count value $t_m^{(CT)}$, a value calculated by multiplying the master tempo magnification θ and the slave tempo magnification $\varphi_m$ and further multiplying the result of the multiplication by a predetermined correction magnification φ (see FIG. 25). The predetermined correction magnification φ, which is set for example at "1.19" and "1/1.19", has been supplied from the CPU 12*a* to the control section CT. When a reproduction position of the track $TK^{(m)}$ is delayed behind a reproduction position of another phrase, the control section CT adds, to the count value $t_m^{(CT)}$, a value calculated by multiplying the master tempo magnification θ and the slave tempo magnification $\varphi_m$ and further multiplying the result of the multiplication by the predetermined correction magnification φ of 1.19; namely, the control section CT speeds up the tempo of the track $TK^{(m)}$. When a reproduction position of the track $TK^{(m)}$ is too advanced from (ahead of) a reproduction position of another phrase, on the other hand, the control section CT adds to the count value $t_m^{(CT)}$ a value calculated by multiplying the master tempo magnification θ and the slave tempo magnification $\varphi_m$ and further multiplying the result of the multiplication by the predetermined correction magnification φ of 1/1.19; namely, the control section CT slows down the tempo of the track $TK^{(m)}$.

When the count value $t_m^{(CT)}$ has exceeded a pitch mark or an attack mark, it is likely that the count value $t_m^{(CT)}$ has exceeded a loop end position. In such a case, the count value $t_m^{(CT)}$ is reset to a loop start position. Note that the loop start position and the loop end position are set at the master sample counter $C_{ms}^{(CT)}$ as well. Namely, the loop start position and the loop end position are set at the master sample counter $C_{ms}^{(CT)}$ such that a ratio between the loop start position and the loop end position substantially matches a ratio between the loop start position and the loop end position of the sample counter $C_m^{(CT)}$ of the track $TK^{(m)}$. Alternatively, the count value $t_{ms}^{(CT)}$ of the master sample counter $C_{ms}^{(CT)}$ may be rewritten directly. In such a case, the ratio between the count value $t_{ms}^{(CT)}$ and the count value $t_m^{(CT)}$ may undesirably greatly deviate from the ideal value, and thus, the tempos of the individual tracks are corrected in such a manner that the deviation can fall within an allowable range.

Note that the sample counter $C_m^{(CT)}$ corresponding to any one of the tracks $TK^{(m)}$, $TK^{(m+1)}$, . . . constituting the group $GP^{(k)}$ may be used as the master sample counter. Namely, one of the tracks $TK^{(m)}$, $TK^{(m+1)}$, . . . may be set as a master track, and the other of the tracks $TK^{(m)}$, $TK^{(m+1)}$, . . . may be set as slave tracks. Further, a plurality of such groups may be formed, in which case master sample counters may be provided in corresponding relation to the individual groups. Alternatively, one of the tracks in each of the groups may be set as the master track with no master sample counter provided.

Various parameters for use in the present invention may be not only set (and changed) by use of the input operator unit but also sequentially set (and changed) via an automatic performance device (so-called sequencer) implemented by the computer section 12. Further, various parameters may be set (and changed) in response to control signals supplied from external equipment via the external interface 15.

Further, the overlap-add circuits OLA need not necessarily be provided in one-to-one corresponding relation to individual ones of all of the tone generating channels Namely, a smaller number of the overlap-add circuits OLA than the total number of the tone generating channels may be provided and shared among the generating channels by being allocated to and used by one or more desired tone generating channels operating in any one of the second to fourth modes.

This application is based on, and claims priority to, JP PA 2014-031724 filed on 21 Feb. 2014. The disclosure of the priority application, in its entirety, including the drawings, claims, and the specification thereof, are incorporated herein by reference.

What is claimed is:

1. An audio signal generation apparatus for generating an output audio waveform signal comprising:

memory interface circuitry adapted to communicate with a memory storing original waveform data;

a plurality of channels, each channel including;

a sample counter adapted to perform counting operation at a given rate per sampling time period, and a read circuit adapted to retrieve a sample value of an original waveform from the memory through the memory interface circuitry based on a count value of the sample counter, each of the channels being configured to generate a waveform sample value based on the sample value of the original waveform retrieved via the read circuit of the channel so that the waveform sample value for one sample is output from the channel per sampling time period, wherein the sampling time period is a sampling time period for digital/analog conversion of the output waveform sample value;

control circuitry configured to set, independently for each of the channels, the rate and an initial value for the sample counter of the channel and control start and stop of the counting operation of the sample counter, so that a partial portion of the original waveform corresponding to a count range from the set initial value to a count stop point is reproduced in the channel;

an overlap adder controlled by said control circuitry and configured to output a result of addition for one sample per sampling time period; and a sound system for outputting the output audio waveform signal based on said result of addition for one sample per sampling time period output from said overlap adder, wherein said control circuitry is configured to set the initial values in individual ones of a set of channels, selected from among the plurality of channels, such that sample values at different sample positions of the original waveform are retrieved from the memory in individual ones of the set of channels, and control said overlap adder to add up a plurality of waveform sample values generated in the set of channels in the same sampling time period, whereby sample values of an audio waveform signal with a plurality of partial portions of the original waveform, which are to be reproduced in the set of channels, partially overlapping each other are output from said overlap adder as results of addition over a plurality of the sampling time periods output from said overlap adder, wherein the given rate, the initial values, and the plurality of partial portions of the original waveform are determined on the basis of at least one of a first rate for performing stretch/compression control on a reproduction time length, a second rate for controlling a reproduction pitch of an audio waveform signal to be reproduced in the set of channels, and a third rate for controlling a formant, and wherein the control circuitry is configured to set a reproduction start time difference between two adjacent partial portions of the plurality of partial portions of the original waveform so that a pitch of the output audio waveform signal is adjusted from an original pitch of the original waveform into the reproduction pitch based on the second rate.

2. The audio signal generation apparatus as claimed in claim 1, wherein the reproduction pitch based on the second rate is a pitch corresponding to a key depressed from among a plurality of keys of a keyboard apparatus.

3. The audio signal generation apparatus as claimed in claim 1, wherein, when a first audio waveform signal, with a first reproduction pitch as the original pitch of the original waveform, is reproduced through a first set of channels and a second audio waveform signal, with a second reproduction pitch as the reproduction pitch based on the second rate, is reproduced through a second set of channels, the control circuitry adjusts the first reproduction pitch into the second reproduction pitch or the control circuitry simultaneously generates the first reproduction pitch and the second reproduction pitch in a predetermined frequency relationship to each other.

4. An audio signal generation apparatus for generating an output audio waveform signal comprising:

memory interface circuitry adapted to communicate with a memory storing original waveform data;

a plurality of channels, each channel including;

a sample counter adapted to perform counting operation at a given rate per sampling time period, and a read circuit adapted to retrieve a sample value of an original waveform from the memory through the memory interface circuitry based on a count value of the sample counter, each of the channels being configured to generate a waveform sample value based on the sample value of the original waveform retrieved via the read circuit of the channel so that the waveform sample value for one sample is output from the channel per sampling time period, wherein the sampling time period is a sampling time period for digital/analog conversion of the output waveform sample value;

control circuitry configured to set, independently for each of the channels, the rate and an initial value for the sample counter of the channel and control start and stop of the counting operation of the sample counter, so that a partial portion of the original waveform corresponding to a count range from the set initial value to a count stop point is reproduced in the channel;

an overlap adder controlled by said control circuitry and configured to output a result of addition for one sample per sampling time period; and a sound system for outputting the output audio waveform signal based on said result of addition for one sample per sampling time period output from said overlap adder, wherein said control circuitry is configured to set the initial values in individual ones of a set of channels, selected from among the plurality of channels, such that sample values at different sample positions of the original waveform are retrieved from the memory in individual ones of the set of channels, and control said overlap adder to add up a plurality of waveform sample values generated in the set of channels in the same sampling time period, whereby sample values of an audio waveform signal with a plurality of partial portions of the original waveform, which are to be reproduced in the set of channels, partially overlapping each other are output from said overlap adder as results of addition over a plurality of the sampling time periods output from said overlap adder, wherein the given rate, the initial values, and the plurality of partial portions of the original waveform are determined on the basis of at least one of a first rate for performing stretch/compression control on a reproduction time length, a second rate for controlling a reproduction pitch of an audio waveform signal to be reproduced in the set of channels, and a third rate for controlling a formant, and wherein a plurality of audio waveform signals are reproduced in a group of a plurality of tracks, individual ones of the plurality of tracks corresponding to different sets of channels, wherein the audio signal generation apparatus further comprises:

a master sample counter for managing a reproduction tempo common to the plurality of audio waveform signals in the group, the master sample counter being configured to count a value of a master tempo magnification per sampling time period, the master tempo magnification being a ratio of the reproduction tempo to a predetermined master reference tempo; and sample counters provided for the individual tracks in the group, each of the sample counters being configured to count a value of a corresponding slave tempo magnification per sampling time period, the corresponding slave tempo magnification being indicative of a ratio of a tempo of the audio waveform signal reproduced in the corresponding track to the master reference tempo, wherein a deviation from a target value of a ratio of a count value of each of the sample counters for the individual tracks to a count value of the master sample counter is monitored so that a counting operation of the corresponding sample counter is corrected based on to reduce the deviation.

5. The audio signal generation apparatus as claimed in claim 4, wherein individual waveform data corresponding to individual performance parts of a music piece which have been previously generated from sampled performances of individual parts executed for a same portion of the music piece are allocated to individual ones of the plurality of tracks as the original waveform data, and wherein the plurality of audio waveform signals in the group of the plurality of tracks are reproduced based on the allocated original waveform data.

6. The audio signal generation apparatus as claimed in claim 5, wherein counting operations of the master sample counter and the sample counters for the individual tracks are controlled so that portions of the original waveform data allocated to the individual ones of the plurality of tracks are loop-reproduced.

7. The audio signal generation apparatus as claimed in claim 4, wherein another sample counter corresponding to one of the individual tracks is configured to function as the master sample counter.

* * * * *